US007264920B2

(12) United States Patent
Ohzeki et al.

(10) Patent No.: US 7,264,920 B2
(45) **Date of Patent: *Sep. 4, 2007**

(54) PHOTOTHERMOGRAPHIC MATERIAL AND IMAGE FORMING METHOD

(75) Inventors: Tomoyuki Ohzeki, Kanagawa (JP); Fumito Nariyuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/066,398

(22) Filed: Feb. 28, 2005

(65) Prior Publication Data

US 2005/0214699 A1 Sep. 29, 2005

(30) Foreign Application Priority Data

Mar. 25, 2004 (JP) ..... 2004-090592
Mar. 29, 2004 (JP) ..... 2004-097151
Nov. 29, 2004 (JP) ..... 2004-344789
Nov. 29, 2004 (JP) ..... 2004-344791

(51) Int. Cl.
*G03C 1/00* (2006.01)
*G03C 1/06* (2006.01)

(52) U.S. Cl. ..... 430/617; 430/618; 430/619; 430/620; 430/264; 430/598

(58) Field of Classification Search ..... 430/617–620, 430/598, 264
See application file for complete search history.

(56) References Cited

U.S. PATENT DOCUMENTS 4,152,160 A 5/1979 Ikienoue et al.
4,212,937 A 7/1980 Akashi et al.
4,396,712 A 8/1983 Kinoshita et al.
5,496,695 A 3/1996 Simpson et al.
5,637,449 A 6/1997 Harring et al.
6,331,386 B1 * 12/2001 Ezoe et al. ..... 430/619
6,440,649 B1 8/2002 Simpson et al.
6,573,033 B1 6/2003 Simpson et al.
6,576,410 B1 6/2003 Zou et al.
7,105,283 B2 * 9/2006 Ohzeki ..... 430/350
2002/0086252 A1 7/2002 Komatsu
2003/0224307 A1 12/2003 Yamamoto et al.
2004/0131983 A1 7/2004 Ohzeki et al.
2004/0137389 A1 7/2004 Fukui et al.
2005/0026093 A1 * 2/2005 Ohzeki ..... 430/617
2005/0064348 A1 3/2005 Ohta
2005/0069827 A1 3/2005 Nariyuki et al.
2005/0074707 A1 4/2005 Yamane et al.
2005/0118542 A1 6/2005 Mori et al.
2005/0202356 A1 * 9/2005 Fukui ..... 430/619
2005/0214702 A1 9/2005 Ohzeki
2005/0266361 A1 12/2005 Funakubo et al.

FOREIGN PATENT DOCUMENTS

EP 0423891 4/1991
EP 0803766 10/1997
EP 1276006 1/2003
JP A 62-215942 9/1987
JP 1096 310 5/2001
JP B 3229344 11/2001
JP 2002-365758 12/2002

* cited by examiner

*Primary Examiner*—Geraldina Visconti
(74) *Attorney, Agent, or Firm*—Margaret A. Burke; Sheldon J. Moss

(57) ABSTRACT

A photothermographic material having, on both sides of a support, an image forming layer including at least a photosensitive silver halide, a non-photosensitive organic silver salt, a reducing agent for silver ions, and a binder, and an image forming method utilizing the same, characterized in that the image forming layer on a first side has an infectious development property, and the image forming layer on the other side does not have an infectious development property or has an infectious development property that is smaller than that of the image forming layer on the first side. The invention provides a double-sided type photothermographic material having improved photographic properties and an image forming method utilizing the same.

28 Claims, 7 Drawing Sheets

PHOTOTHERMOGRAPHIC MATERIAL AND IMAGE FORMING METHOD

CROSS-REFERENCE TO RELATED APPLICATION

This application claims priority under 35 USC 119 from Japanese Patent Application Nos. 2004-490592, 2004-97151, 2004-344789, and 2004-344791, the disclosures of which are incorporated by reference herein.

BACKGROUND OF THE INVENTION

1. Field of the Invention

The present invention relates to a photothermographic material and an image forming method. More particularly, the invention relates to a double-sided type photothermographic material using a silver halide emulsion with a high silver iodide content and an image forming method utilizing the same. Further, the invention relates to a double-sided type photothermographic material whose photographic property is improved and an image forming method utilizing the same.

2. Description of the Related Art

In recent years, in the medical field and the graphic arts field, there has been a strong desire for a dry photographic process from the viewpoints of environmental conservation and economy of space. Further, the development of digitization in these fields has resulted in the rapid development of systems in which image information is captured and stored in a computer, and then when necessary processed and output by communicating it to a desired location where the image information is output onto a photosensitive material using a laser image setter or a laser imager, and developed to form an image at the location on the photosensitive material. It is necessary for the photosensitive material to be able to record an image with high-intensity laser exposure and that a clear black-tone image with a high resolution and sharpness can be formed. While various kinds of hard copy systems using a pigment or a dye, such as inkjet printers or electrophotographic systems, have been distributed as general image forming systems using such digital imaging recording material, images in the digital imaging recording material obtained by such a general image forming system are insufficient in terms of image quality (sharpness, granularity, gradation, and tone) needed for medical images used in making diagnoses and high recording speed (sensitivity). These kinds of digital imaging recording materials have not reached a level at which they can replace medical silver halide film processed with conventional wet development.

A photothermographic material using an organic silver salt has already been known. Generally, the photothermographic material has an image forming layer in which a photosensitive silver halide, a reducing agent a reducible silver salt (for example, an organic silver salt), and if necessary, a toner for controlling the color tone of silver are dispersed in a binder.

A photothermographic material forms a black silver image by being heated to a high temperature (for example, 80° C. or higher) after image wise exposure to cause an oxidation seduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which photothermographic materials are described, and the Fuji Medical Dry Imager FM-DP L is a practical example of a medical image forming system using a photothermographic material that has been marketed.

Since the image forming system utilizing an organic silver salt has no fixing step, undeveloped silver halides remain inside the film after thermal development. Thus, there have intrinsically been serious problems in the system.

One of them involves image instorability after a thermal developing process, particularly fogging due to print-out when the material is exposed to light. As a means to improve print-out, a method of using silver iodide is known. Silver iodide has the characteristic of causing less print-out than silver bromide or silver iodobromide having an iodide content of 5 mol % or less, and has a potential for fundamentally solving the problem. However, the sensitivity of silver iodide grains known until now is extremely low, and the silver iodide grains do not achieve a level of sensitivity that is applicable for an actual system. When means of preventing recombination between photoelectrons and holes is performed to improve the sensitivity, it is an inherent problem that the characteristic of being excellent in the print-out property will be lost.

As means of increasing the sensitivity of a silver iodide photographic emulsion, academic literature discloses addition of a halogen acceptor such as sodium nitrite, pyrogallol, hydroquinone or the like, immersion in an aqueous silver nitrate solution, sulfur sensitization at a pAg of 7.5, and the like. However, the sensitization effect of these halogen acceptors is very small and extremely insufficient for use in photothermographic materials.

On the other hand, attempts have also been made at applying the abovementioned photothermographic material as photosensitive material for photographing. The "photosensitive material for photographing" as used herein means a photosensitive material on which images are recorded by a one-shot exposure through a lens, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like. For example, an X-ray photothermographic material coated on both sides using a blue fluorescent intensifying screen described in Japanese Patent No. 3229344, a photothermographic material containing tabular silver iodobromide grains described in Japanese Patent Application Laid-Open (JP-A) No. 59-142539, and a photosensitive material for medical use containing tabular grains that have a high content of silver chloride and have (100) major faces, and that are coated on both sides of a support, which is described in JP-A No. 10-282606, are known. However, there have conventionally been no descriptions about a thermal developing apparatus for these double-sided type photothermographic materials.

Photosensitive materials comprising tabular silver iodide grains as silver halide grains are well known in the wet developing field as described in JP-A Nos. 59-11934 and 59-119350, but there have been no examples of the application of the silver iodide grains in a photothermographic material. The reasons for this are because, as mentioned above, the sensitivity is very low, there are no effective sensitization means, and the technical barriers become even higher in thermal development.

In order to be used as this kind of photosensitive material for photographing, the photothermographic material needs higher sensitivity as well as an even higher level of image quality, such as the degree of haze of an obtained image.

SUMMARY OF THE INVENTION

A first aspect of the invention is to provide a photothermographic material comprising, on both sides of a support, an image forming layer containing at least a photosensitive silver halide, a non-photosensitive organic silver salt, a reducing agent for silver ions, and a binder, wherein the image forming layer on a first side has an infectious development property, and the image forming layer on the other side does not have an infectious development property or has an infectious development property that is smaller than that of the image forming layer on the first side.

A second aspect of the invention is to provide an image forming method using the photothermographic material according to the first aspect, wherein the method comprises: (a) providing an assembly for forming an image by placing the photothermographic material between a pair of fluorescent intensifying screens, (b) putting an analyte between the assembly and an X-ray source, (c) irradiating the analyte with X-rays having an energy level in a range of 25 kVp to 125 kVp, (d) taking the photothermographic material out of the assembly, and (e) thermally developing the thus taken out photothermographic material by a heating means in a temperature range of 90° C. to 180° C.

DETAILED DESCRIPTION OF THE INVENTION

1. Photothermographic Material

Figure 1:
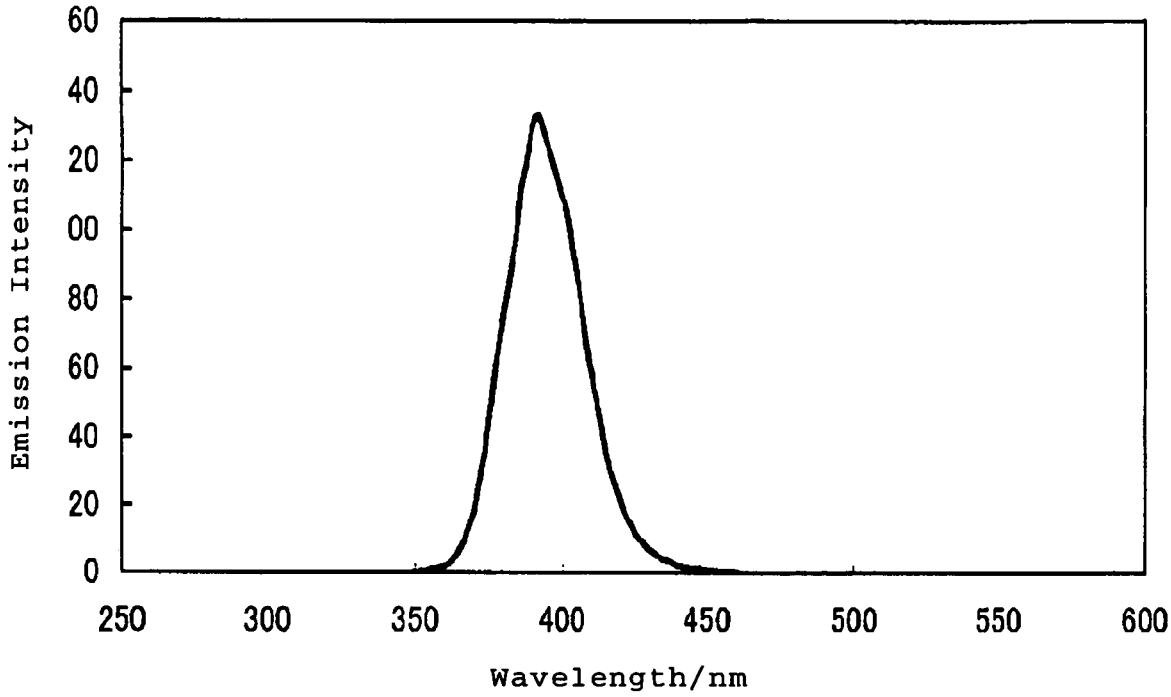
FIG. 1 shows an emission spectrum of a fluorescent intensifying screen A.

The photothermographic material of the present invention has, on the both sides of a support, an image forming layer comprising a photosensitive silver halide, a non-photosensitive organic silver salt, a reducing agent, and a binder. The photothermographic material may have a non-photosensitive layer such as an intermediate layer or a surface protective layer on the image forming layer. In the present invention, one of the image forming layers may be expressed as a front-side image forming layer, and the image forming layer on the other side may be expressed as a back-side image forming layer.

In the photothermographic material of the present invention, the image forming layer on a first side has an infectious development property and the image forming layer on the other side does not have an infectious development property or has an infectious development property smaller than that of the image forming layer of the first side.

More preferably, the photographic properties of the image forming layers on two sides are different from each other. Examples of the photographic properties mentioned above include sensitivity, development proceeding property, hue angle of an image, gradation, and maximum image density (Dmax).

(Infectious Development Property)

The infectious development property which is a characteristic of thermal development in the present invention is explained hereinafter.

"Infectious development" is one of the development mechanisms generally known for wet development system, for example, is explained in "KAITEI SYASHIN KOGAKU NO KISO-GINEN SHASHIN HEN" (The Basis of Photographic Technology—Silver Salt Photographic Science Section, revised edition), edited by the Society of Photographic Science and Technology of Japan, Corona Publishing Co., Ltd. (1998), pp. 339 to 341. "Infectious development" is a phenomenon in which a more powerful reducing product is generated by the oxidation product of a reducing agent generated by early development and accelerates the development.

In conventional thermal development, the developed silver is usually deposited in the region surrounding the latent image formed in the photosensitive silver halide grains. However, in the case where the image forming layer having the infectious development property of the present invention is used, because the nuclei capable of depositing developed silvers are formed around the sites where no silver halide grains exist, the developed silvers, which is the same as developed silver around photosensitive silver halide grains, is deposited therein with proceeding of the development. Accordingly, whether a layer has an infectious development property or not, and its degree of infectious development property can be quantitatively confirmed in the following manner. The image portions after thermal development are observed by the electron micrographs thereof and then the observed developed silver grains are classified into those formed on the silver halide grains, or those formed on other sites.

In the present invention, a layer having an infectious development property possesses numbers of developed silver grains in the maximum density area (Dmax part) more than the numbers of silver halide grains.

More specifically, an ultra thin section of a thickness of 0.1 μm is prepared by slicing the image forming layer of the undeveloped material in the direction parallel to the support using a diamond knife. The obtained ultra thin section is placed on a mesh and observed with a transmission electron microscope while cooled to a temperature of liquid nitrogen. The number (x) of silver halide grains per unit area is counted. In a similar manner, an ultra thin section is prepared from the image forming layer in the maximum density portion of the exposed and thermal developed photothermographic materials of the present invention, and observed with a transmission electron microscope. The number (y) of developed silver grains per unit area is counted.

In the present invention, a layer having an infectious development property has a ratio of y/x more than one, where y is the number of developed silver grains and x is the number of silver halide grains per unit area.

Regarding to the image forming layer having an infectious development property in the practice of the present invention, the ratio of y/x is preferably from 2 to 80, and more preferably from 5 to 50.

By the aid of infectious development, physical development nuclei are formed in the region surrounding organic silver salt that existed in the proximity of the photosensitive silver halide grains having latent images. Because the development initiation points are multiplied by a plurality of the physical development nuclei formed per one grain of silver halide grains having a latent image, the covering power of the developed silver may be increased to provide sufficient density with a small number of silver halide grains.

In the present invention, at least one of the front-side image forming layer and the back-side image forming layer has an infectious development property. Preferably the image forming layer on the other side does not have an infectious development property or a small infectious development property, and more preferably has an infectious development property smaller than that of the image forming layer of the first side.

In the practice of the present invention, as regards the small infectious development property set forth above, the ratio of y'/x' is preferably from 1 to 30, and more preferably from 1 to 10, where y' is the number of developed silver grains and x' is the number of silver halide grains per unit area of the image forming layer having a small infectious development property.

The ratio of infectious development properties (y/x)/(y'/x') of the practice of the present invention is preferably from 1.2 to 80, and more preferably from 2 to 50, wherein y/x is obtained for the first side layer having an infectious development property of the invention and y'/x' is obtained for the other side layer having a small infectious development property.

The photographic properties of the present invention are defined based on the following photographic characteristic curve. A photographic characteristic curve is a D-log E curve representing a relationship between the common logarithm (log E) of a light exposure, i.e., the exposure energy, and the optical density (D), i.e., a scattered light photographic density, by plotting the former on the abscissa and the latter on the ordinate.

A color tone of the image (in the present invention, sometimes expressed as a color tone of a developed silver image) can be determined from the evaluation by visual observation thereof, or by measurement of hue angles of each density portion. The hue angle, $h_{ab}$, can be calculated from the following formula;

$$h_{ab}=\tan^{-1}(b^*/a^*)$$

by using chromaticity coordinates a*, b* of L*, a*, b* color spaces recommended by Commission Internationale de l' Eclairage (CIE) in 1976, which have perceivable nearly equal color spaces.

In the present invention, the photographic properties of both sides are measured as follows. Both sides of the material are subjected to simultaneous exposure for the same exposure time using an exposing device having double beam sources and then thermal development. Thereafter, the layer to be measured is prepared by removing the image forming layer on the opposite side from the processed material and measured by a densitometer to obtain a photographic characteristic curve. And also evaluation of a color tone of a developed silver image by visual observation and the measurements of hue angle in each density portion are performed.

The front-side image forming layer and the backside image forming layer of the photosensitive material may have different photographic properties from each other. The said different photographic properties can be obtained by the same equivalent heating means like as the practical heating means, or by the different heating means to result in giving the different photographic properties. Either way will be acceptable.

Sensitivity in the present invention means a common logarithm of a reciprocal of the exposure value necessary for giving a density of fog+(optical density of 1.0) on the photographic characteristic curve. In the practice of the present invention, the difference in sensitivities between both sides of the material is preferably from 0.01 to 3.0, more preferably 0.05 to 2.0, and most preferably from 0.1 to 1.5.

The image forming layer having a different sensitivity can be prepared by utilizing photosensitive silver halide grains and additives. Examples of many sensitivity controlling means based on photosensitive silver halide grains include the difference in the grain size of the silver halide grain, the difference in the halide composition, the kind of chemical sensitizers and the level of sensitization, the kind and addition amount of spectral sensitizing dyes, and the difference in doping level by heavy metal ions. Examples of the additives to give a difference in sensitivity include the kind and addition amount of reducing agents, the kind and addition amount of antifoggants, the kind and addition amount of development accelerators, the kind and addition amount of color-tone adjusting agents, and the kind and addition amount of binders.

Development proceeding property in the present invention means the difference in the maximum density (Dmax) obtained by thermal development at the time period for development of (the time period for a standard thermal development)±2 seconds. The difference in development proceeding properties of the both sides in the practice of the present invention is preferably from 0.005 to 1, more preferably from 0.01 to 0.5, and most preferably from 0.05 to 0.3.

The image forming layer having a different development proceeding property can be prepared by utilizing non-photosensitive organic silver salts and additives. For example, as for non-photosensitive organic silver salts, the composition (for example, a silver behenate content) and the grain shape of the organic silver salts are effective. Examples of the additives to provide a difference in development proceeding property include the kind and addition amount of reducing agents, the kind and addition amount of antifoggants, the kind and addition amount of development accelerators, the kind and addition amount of color-tone-adjusting agents, and the kind and addition amount of binders.

Gradation in the present invention is expressed as a gradient of a line joining the points at fog+(optical density of 0.25) and fog+(optical density of 0.5) on the photographic characteristic curve (i.e., the value equals to tan when the angle between the line and the abscissa is). The difference in gradation of both sides is preferably from 0.005 to 0.3, more preferably from 0.01 to 2.5, and most preferably from 0.05 to 2.0.

The image forming layer having a different gradation can be prepared by modifying the photosensitive silver halide emulsions, the non-photosensitive organic silver salts, and the additives. For examples, the following means are effective such like, as for the photosensitive silver halide emulsions, the shape and grain size distribution of the silver halide grains, the kind of chemical sensitizers and the level of sensitization, as for the organic silver salts, the shape and grain size distribution of the organic silver salts, and as for the additives, the kind and addition amount of reducing agents, the kind and addition amount of antifoggants, the kind and addition amount of development accelerators, the kind and addition amount of color-tone-adjusting agents, and the kind and addition amount of binders.

Maximum density (Dmax) of the present invention is a density saturated with increasing the exposure value on the photographic characteristic curve. The difference in Dmax of both sides is preferably from 0.05 to 3.0, more preferably from 0.1 to 2.5, and most preferably from 0.2 to 2.0.

The image forming layer having a different maximum density can be prepared by modifying the photosensitive silver halide emulsions, the non-photosensitive organic silver salts, and the additives. For example, the following means are effective such as, as for the photosensitive silver halide emulsion, the shape, the grain size, the grain size distribution and coating amount of the silver halide grains, as for the organic silver salts, the shape, the grain size, the grain size distribution, and the coating amount of the organic silver salt, and as for the additives, the kind and addition amount of reducing agents, the kind and addition amount of antifoggants, the kind and addition amount of development accelerators, the kind and addition amount of color-tone adjusting agents, and the kind and addition amount of binders.

A color tone of a developed silver image in the present invention is a value determined by visual observation of the silver image obtained by thermal development, or measurement of hue angles on each density portion set forth above. The difference in the color tone of a developed silver image of both sides is, expressed by the difference in hue angles for the portion of an optical density of 0.5, preferably in a range from 0.5° to 60°, more preferably from 1° to 50°, and most preferably from 5° to 40°. The image forming layer having a different color tone of a developed silver image can be prepared by modifying the non-photosensitive organic silver salts and the additives. For example, the following means are effective for attaining the aim such as, for the non-photosensitive organic silver salts, the composition (for example, a silver behenate content) and the grain shape of the organic silver salts, and as for the additives, the kind and addition amount of reducing agents, the kind and addition amount of antifoggants, the kind and addition amount of development accelerators, the kind and addition amount of color-tone-adjusting agents, the kind and addition amount of binders.

The infectious development property set forth above can be adjusted by various means.

One of them is the incorporation of a nucleator into the image forming layer or the layer adjacent to the image forming layer. The other means is the incorporation of an infectious development reducing agent in the layer. The above means may be applied in combination. Furthermore, the combined use of a phosphoric acid compound may result in enhancing the infectious development property.

The means for adjusting the infectious development properties, the composition of the photothermographic material of the present invention and the preferred composition are described in detail hereinafter.

(Nucleator)

The nucleator used in the present invention is explained below.

The nucleator according to the invention is a compound, which can form a compound that can newly induce a development by the reaction with a developing product in consequence of an initial development. It was conventionally known to use a nucleator for the ultra-high contrast photosensitive materials suitable for the use in graphic arts. The ultra-high contrast photosensitive materials had an average gradient of ten or more and were unsuitable for conventional photographic materials, and especially unsuitable for the medical use where high diagnostic ability was required. And because the ultrahigh contrast photosensitive material had rough graininess and did not have enough sharpness, there was no potential for medical diagnostic use. The nucleator in the present invention completely differs from the nucleator in the conventional ultra-high contrast photosensitive material as regards the effect. The nucleator in the present invention does not make a hard gradation. The nucleator in the present invention is the compound that can cause development sufficiently, even if the number of photosensitive silver halide grains with respect to non-photosensitive silver salt of an organic acid is extremely low. Although that mechanism is not clear, when thermal development is performed using the nucleator according to the present invention, it becomes clear that a large number of developed silver grains exists than the number of photosensitive silver halide grains in the maximum density part, and it is presumed that the nucleator according to the present invention forms the new development points (development nuclei) in those portions where silver halide grains do not exist.

Because physical development nuclei are formed on plural organic silver salts which exist in the proximity of the photosensitive silver halide grains having latent images by the nucleator, the covering power of the developed silver can be increased without causing deterioration of graininess.

As the nucleator, hydrazine derivative compounds represented by the following formula (H), vinyl compounds represented by the following formula (G), and quaternary onium compounds represented by the following formula (P), cyclic olefine compounds represented by formulae (A), (B), and (C) are preferable examples.

Formula (H)

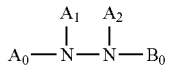

Formula (G)

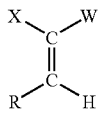

Formula (P)

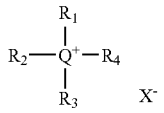

-continued

Formula (A)

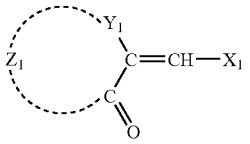

Formula (B)

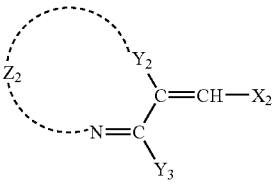

Formula (C)

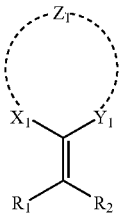

In formula (H), $A_0$ represents one selected from an aliphatic group, an aromatic group, a heterocyclic group, and a —$G_0$—$D_0$ group, each of which may have a substituent. $B_0$ represents a blocking group. $A_1$ and $A_2$ both represent a hydrogen atom, or one represents a hydrogen atom and the other represents one of an acyl group, a sulfonyl group, and an oxalyl group. Herein, $G_0$ represents one selected from a —CO— group, a —COCO— group, a —CS— group, a —C(=N$G_1D_1$) group, an —SO— group, an —$SO_2$— group, and a —P(O)($G_1D_1$)- group. $G_1$ represents one selected from a mere bonding hand, an —O— group, an —S— group, and an —N($D_1$)- group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like can be described.

In formula (H), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, and a benzyl group are described. These may be further substituted by a suitable substituent (e.g., an aryl group, an alkoxy group, an aryloxy group, an alkylthio group, an arylthio group, a sulfoxy group, a sulfonamide group, a sulfamoyl group, an acylamino group, a ureido group and the like).

In formula (H), the aromatic group represented by $A_0$ is preferably an aryl group of a single or condensed ring. For example, a benzene ring or a naphthalene ring is described. As a heterocycle represented by $A_0$, the heterocycle of a single or condensed ring containing at least one heteroatom selected from a nitrogen atom, a sulfur atom and an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. The arotamic group, heterocyclic group or -$G_0$-$D_0$ group, as $A_0$, may have a substituent. As $A_0$, an aryl group or a -$G_0$-$D_0$ group is particularly preferable.

And, in formula (H), $A_0$ preferably contains at least one of a diffusion-resistant group or an adsorptive group to silver halide. As a diffusion-resistance group, a ballast group usually used as non-moving photographic additive is preferable. As a ballast group, a photochemically inactive alkyl group, alkenyl group, alkyl group, alkoxy group, phenyl group, phenoxy group, alkylphenoxy group and the like are described and it is preferred that the substituent part has 8 or more carbon atoms in total.

In formula (H), as an adsorption promoting group to silver halide, thiourea, a thiourethane group, a mercapto group, a thioether group, a thione group, a heterocyclic group, a thioamido heterocyclic group, a mercapto heterocyclic group, and an adsorptive group described in JP-A No. 64-90439 are described.

In formula (H), $B_0$ represents a blocking group and preferably a -$G_0$-$D_0$ group. $G_0$ represents one selected from a —CO— group, a —COCO— group, a —CS— group, a —C(=N$G_1D_1$) group, an —SO— group, an —$SO_2$— group, and a —P(O)($G_1D_1$)- group. As preferable $G_0$ a —CO— group and a —COCO— group are described. $G_1$ represents one selected from a mere bonding hand, an —O— group, an —S— group, and an —N($D_1$)- group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described. $A_1$ and $A_2$ both represent a hydrogen atom, or one of $A_1$ and $A_2$ represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), and an oxalyl group (an ethoxalyl group or the like).

As specific examples of the compound represented by formula (H), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

The compounds represented by formula (H) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (G) is explained. In formula (G), although X and R are displayed in a cis form, a trans form for X and R is also included in formula (G). This is also similar to the structure display of specific compounds.

In formula (G), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, and an immonium group.

R represents one selected from a halogen atom, a hydroxy group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt, or the like), an amino group, an alkylamino group, a cyclic amino group (e.g., a pyrrolidino group), an acylamino group, an oxycarbonylamino group, a heterocyclic group (a 5 or 6-membered nitrogen containing heterocycle, e.g., a benztriazolyl group, an imidazolyl group, a triazolyl group, a tetrazolyl group, or the like), a ureido group, and a sulfonamide group. X and W, and X and R may bind each other to form a cyclic structure. As the ring formed by X and W, for example, pyrazolone, pyrazolidinone, cyclopentanedione, β-ketolactone, β-ketolactam, and the like are described.

Explaining formula (G) further, the electron-attracting group represented by X is a substituent which can have a positive value of substituent constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzooxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxysulfinyl and the like), a thiosulfinyl group (methylthiosulfinyl and the like), a sulfinamoyl group, a phosphoryl group, a nitro group, an imino group, a N-carbonylimio group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group or the like is also included. The substituent having σp value of 0.30 or more is particularly preferable.

As an alkyl group represented by W, methyl, ethyl, trifluoromethyl and the like are described. As an alkenyl group as W, vinyl, halogen substituted vinyl, cyanovinyl and the like are described. As an alkynyl group as W, acetylenyl, cyanoacetylenyl and the like are described. As an aryl group as W, nitrophenyl, cyanophenyl, pentafluorophenyl and the like are described, and as a heterocyclic group as W, pyridyl, pyrimidyl, triazinyl, succinimide, tetrazolyl, triazolyl, imidazolyl, benzooxazolyl and the like are described. As W, the electron-attracting group having a positive σp value is preferable, and that value is more preferably 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described. More preferably, a hydroxy group, an alkoxy group, an organic or inorganic salt of hydroxy group or mercapto group and a heterocyclic group are described, and particularly preferably, a hydroxy group and an organic or inorganic salt of hydroxy group or mercapto group are described.

And among the substituents of X and W described above, the group having a thioether bond in the substituent is preferable.

As specific examples of the compound represented by formula (G), compound 1-1 to 92-7 of chemical formula Nos. 27 to 50 described in JP-A No. 2002-131864 are described, however specific examples are not limited in these.

In formula (P), Q represents a nitrogen atom or a phosphorus atom. $R_1$, $R_2$, $R_3$, and $R_4$ each independently represent a hydrogen atom or a substituent, and $X^-$ represents an anion. In addition, $R_1$ to $R_4$ may link each other to form a ring.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group and the like are described.

As the ring formed by linking $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring and the like are described.

The group represented by $R_1$ to $R_4$ may have a substituent such as a hydroxy group, an alkoxy group, an aryloxy group, a carboxyl group, a sulfo group, an alkyl group, an aryl group, and the like. As $R_1$, $R_2$, $R_3$, and $R_4$, a hydrogen atom and an alkyl group are preferable.

As the anion represented by $X^-$, an organic or inorganic anion such as a halogen ion, a sulfate ion, a nitrate ion, an acetate ion, a p-toluenesulfonate ion and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) and (B) are explained in detail. In formula (A), $Z_1$ represents a nonmetallic atomic group capable to form a 5 to 7-membered ring structure with —$Y_1$—C(═CH—$X_1$)—C(═O)—. $Z_1$ is preferably an atomic group selected from a carbon atom, an oxygen atom, a sulfur atom, a nitrogen atom and a hydrogen atom, and several atoms selected from these are bound each other by single bond or double bond to form a 5 to 7-membered ring structure with —$Y_1$—C(═CH—$X_1$)—C(═O)—. $Z_1$ may have a substituent, and $Z_1$ itself may be an aromatic or a nonaromatic carbon ring, or $Z_1$ may be a part of an aromatic or a nonaromatic heterocycle, and in this case, a 5 to 7-membered ring structure formed by $Z_1$ with —$Y_1$—C(═CH—$X_1$) —C(═O)— forms a condensed ring structure.

In formula (B), $Z_2$ represents a nonmetallic atomic group capable to form a 5 to 7-membered ring structure with —$Y_2$—C(═CH—$X_2$)$_3$)═N—. $Z_2$ is preferably an atomic group selected from a carbon atom, an oxygen atom, a sulfur atom, a nitrogen atom and a hydrogen atom, and several atoms selected from these are linked each other by single bond or double bond to form a 5 to 7-membered ring structure with —$Y_2$—C(═CH—$X_2$) —C($Y_3$)═N—. $Z_2$ may have a substituent, and $Z_2$ itself may be an aromatic or a nonaromatic carbon ring, or $Z_2$ may be a part of an aromatic or a nonaromatic heterocycle and in this case, a 5 to 7-membered ring structure formed by $Z_2$ with —$Y_2$—C(═CH—$X_2$)—C($Y_3$)═N— forms a condensed ring structure.

In the case where $Z_1$ and $Z_2$ have a substituent, examples of substituent are selected from the compounds listed below. Namely, as typical substituent, for example, a halogen atom (fluorine atom, chlorine atom, bromine atom or iodine atom), an alkyl group (includes an aralkyl group, a cycloalkyl group and an active methine group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including the group in which ethylene oxy group units or propylene oxy group units are repeated), an aryloxy group, a heterocyclic oxy, group, an acyloxy group, an alkoxy carbonyloxy group, an aryloxy carbonyloxy group, a carbamoyloxy group, a sulfonyloxy group, an amino group, an alkylamino group , an arylamino group, a heterocyclic amino group, a N-substituted nitrogen containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amide or phosphoric ester structure, a silyl group, a stannyl group, and the like are described. These substituents may be further substituted by these substituents.

Next, $Y_3$ is explained. In formula (B), $Y_3$ represents a hydrogen atom or a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamide group, a ureido group, a thioureido group, an imide group, an alkoxy group, an aryloxy group, an alkylthio group, an arylthio group, a heterocyclic thio group, and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-butoxy group, or the like), an aryloxy group (e.g., a phenoxy group, a p-t-pentylphenoxy group, a p-t-octylphenoxy group, or the like), a heterocyclic oxy group (e.g., a benzotriazolyl-5-oxy group, a pyridinyl-3-oxy group, or the like), a mercapto group (or a salt thereof), an alkylthio group (e.g., methylthio group, an ethlythio group, a butylthio group, a dodecylthio group, or the like), an arylthio group (e.g., a phenylthio group, a p-dodecylphenylthio group, or the like), a heterocyclic thio group (e.g., a 1-phenyltetrazoyl-5-thio group, a 2-methyl-1-phenyltriazolyl-5-thio group, a mercaptothiadiazolylthio group, or the like), an amino group, an alkylamino group (e.g., a methylamino group, a propylamino group, an octylamino group, a dimethylamino group, or the like), an arylamino group (e.g., an anilino group, a naphthylamino group, an o-methoxyanilino group, or the like), a heterocyclic amino group (e.g., a pyridylamino group, a benzotriazole-5-ylamino group, or the like), an acylamino group (e.g., an acetamide group, an octanoylamino group, a benzoylamino group, or the like), a sulfonamide group (e.g., a methanesulfonamide group, a benzenesulfonamide group a dodecylsulfonamide group, or the like), and a heterocyclic group.

Herein, a heterocyclic group is an aromatic or nonaromatic, a saturated or unsaturated, a single ring or condensed ring, or a substituted or unsubstituted heterocyclic group. For example, a N-methylhydantoyl group, a N-phenylhydantoyl group, a succinimide group, a phthalimide group, a N,N'-dimethylurazolyl group, an imidazolyl group, a benzotriazolyl group, an indazolyl group, a morpholino group, a 4,4-methyl-2,5-dioxo-oxazolyl group, and the like are described.

And herein, a salt represents a salt of an alkali metal (sodium, potassium, or lithium), a salt of an alkali earth metal (magnesium or calcium), a silver salt, a quaternary ammonium salt (a tetraethylammonium salt, a dimethylcetylbenzylimmonium salt, or the like), a quaternary phosphonium salt, or the like. In formulae (A) and (B), $Y_1$ and $Y_2$ represent —C(═O)— or —$SO_2$—.

The preferable range of the compound represented by formulae (A) and (B) is described in JP-A No. 11-231459, paragraph Nos. 0027 to 0043. As specific examples of the compound represented by formulae (A) and (B), compound 1 to 110 of Table 1 to Table 8 in JP-A No. 11-231459 are described, however the invention is not limited in these.

Next, the compound represented by formula (C) is explained in detail. In formula (C), $X_1$ represents one selected from an oxygen atom, a sulfur atom, and a nitrogen atom. In the case where $X_1$ is a nitrogen atom, the bond of $X_1$ and $Z_1$ may be either a single bond or a double bond, and in the case of a single bond, a nitrogen atom may have a hydrogen atom or any substituent. As this substituent, for example, an alkyl group (includes an aralkyl group, a cycloalkyl group, an active methine group and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group, and the like are described. $Y_1$ represents the group represented by one selected from —C(═O)—, —C(═S)—, —SO—, —$SO_2$—, —C(═$NR_3$)—, and —($R_4$)C═N—. $Z_1$ represents a nonmetallic atomic group capable to form a 5 to 7-membered ring containing $X_1$ and $Y_1$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group, or an alkenyl group). When $Z_1$ forms a 5 to 7-membered ring containing $X_1$ and $Y_1$, the ring is a saturated or unsaturated heterocycle, and may be a single ring or may have a condensed ring. When $Y_1$ is the group represented by C(═$NR_3$), ($R_4$)C═N, the condensed ring of this case may be formed by binding $R_3$ or $R_4$ with the substituent of $Z_1$.

In formula (C), $R_1$, $R_2$, $R_3$, and $R_4$ each independently represent a hydrogen atom or a substituent. However, $R_1$ and $R_2$ never bind each other to form a ring structure.

When $R_1$ and $R_2$ represent a monovalent substituent, the following groups are described as a monovalent substituent.

For example, a halogen atom (fluorine atom, chlorine atom, bromine atom, or iodine atom), an alkyl group (including an aralkyl group, a cycloalkyl group, an active methine group, and the like), an alkenyl group, an alkynyl group, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, a carboxyl group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, an heterocyclic amino group, a N-substituted nitrogen containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amide or phosphoric ester structure, a silyl group, a stannyl group, and the like are described. These substituents may be further substituted by these monovalent substituents.

When $R_3$ and $R_4$ represent a substituent, the same substituent as what $R_1$ and $R_2$ may have except the halogen atom can be described as the substituent. Furthermore, $R_3$ and $R_4$ may further link to $Z_1$ to form a condensed ring.

Next, among the compounds represented by formula (C), preferable compounds are described. In formula (C), $Z_1$ preferably is an atomic group which forms a 5 to 7-membered ring with $X_1$ and $Y_1$, and consists of the atoms selected from 2 to 4 carbon atoms, a nitrogen atom, a sulfur atom, and an oxygen atom A heterocycle, which is formed by $Z_1$ with $X_1$ and $Y_1$, preferably contains 3 to 40 carbon atoms in total, more preferably 3 to 25 carbon atoms in total and most preferably 3 to 20 carbon atoms in total. $Z_1$ preferably comprises at least one carbon atom.

In formula (C), $Y_1$ is preferably —C(═O)—, —C(═S)—, —$SO_2$—, or —($R_4$)C═N—, particularly preferably, —C(═O)—, —C(═S)—, or —$SO_2$—, and most preferably, —C(═O)—.

In formula (C), in the case where $R_1$ and $R_2$ represent a monovalent substituent, the monovalent substituent represented by $R_1$ and $R_2$ is preferably one of the following groups having 0 to 25 carbon atoms in total, namely, those are an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a hydroxy group and a salt thereof, a mercapto group and a salt thereof, and an electron-attracting group. Herein, an electron-attracting group means the substituent capable to have a positive value of Hammett substituent constant σp, and specifically a cyano group, a sulfamoyl group, an alkylsulfonyl group, an arylsulfonyl group, a sulfonamide group, an imino group, a nitro group, a halogen atom, an acyl group, a formyl group, a phosphoryl group, a carboxyl group (or a salt thereof), a sulfo group (or a salt thereof), a saturated or unsaturated heterocyclic group, an alkenyl group, an alkynyl group, an acyloxy group, an acylthio group, a sulfonyloxy group, and an aryl group substituted by these electron-attracting group are described. These substituents may have any substituents.

In formula (C), when $R_1$ and $R_2$ represent a monovalent substituent, more preferable are an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a sulfonamide group, a heterocyclic group, a hydroxy group or a salt thereof, a mercapto group or a salt thereof, and the like. In formula (C), $R_1$ and $R_2$ particularly preferably are a hydrogen atom an alkoxy group, an aryloxy group, an alkylthio group, an arylthio group, a heterocyclic group, a hydroxy group or a salt thereof, a mercapto group or a salt thereof, or the like. In formula (C), most preferably, one of $R_1$ and $R_2$ is a hydrogen atom and another is an alkoxy group, an aryloxy group, an alkylthio group, an arylthio group, a heterocyclic group, a hydroxy group or a salt thereof, or a mercapto group or a salt thereof.

In formula (C), when $R_3$ represents a substituent, $R_3$ is preferably an alkyl group having 1 to 25 carbon atoms in total (including an aralkyl group, a cycloalkyl group, an active methine group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group, or the like. An alkyl group and an aryl group are particularly preferable.

In formula (C), when $R_4$ represents a substituent, $R_4$ is preferably an alkyl group (including an aralkyl group, a cycloalkyl group, an active methine group, and the like) having 1 to 25 carbon atoms in total, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, or the like. Particularly preferably, an alkyl group, an aryl group, an alkoxy group, an aryloxy group, a heterocyclic oxy group, an alkylthio group, an arylthio group, a heterocyclic thio group, and the like are described. When $Y_1$ represents $C(R_4)=N$, the carbon atom in $Y_1$ binds with the carbon atom substituted by $X_1$ or $Y_1$.

Specific compounds represented by formula (C) are represented by A-1 to A-230 of chemical formula Nos. 6 to 18 described in JP-A No. 11-133546, however the invention is not limited in these.

The addition amount of the above nucleator is in a range of $10^{-5}$ mol to 1 mol per 1 mol of organic silver salt, and preferably, in a range of $10^{-4}$ mol to $5\times10^{-1}$ mol.

The nucleator described above may be incorporated into photothermographic material by being added into the coating solution, such as in the form of a solution, an emulsion dispersion, a solid fine particle dispersion, or the like.

As well known emulsion dispersing method, there can be mentioned a method comprising dissolving the nucleator in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the nucleator in a proper solvent such as water or the like, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the water dispersion.

The nucleator is particularly preferably used as solid particle dispersion, and is added in the form of fine particles having average particle size from 0.01 μm to 10 μm, preferably from 0.05 μm to 5 μm and, more preferably from 0.1 μm to 2 μm. In the invention, other solid dispersions are preferably used with this particle size range.

In the photothermographic material which is subjected to a rapid development where time period for development is 20 seconds or less, the compound represented by formulae (H) or (P) is used preferably, and the compound represented by formula (H) is used particularly preferably, among the nucleators described above.

In the photothermographic material where low fog is required, the compound represented by formulae (G), (A), (B), or (C) is used preferably, and the compound represented by formulae (A) or (B) is particularly preferably used. Moreover, in the photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

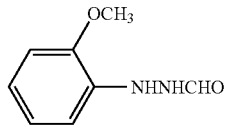

SH-2

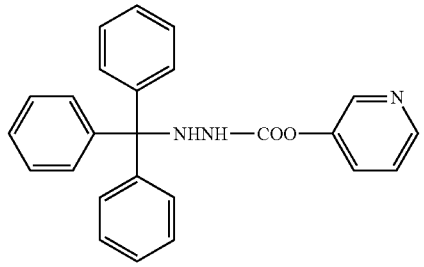

SH-3

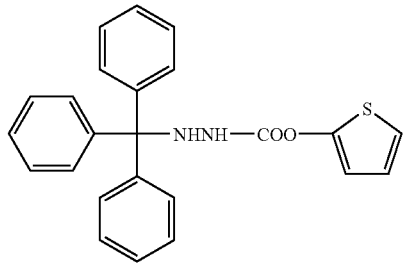

SH-4

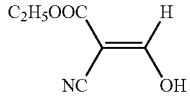

SH-5

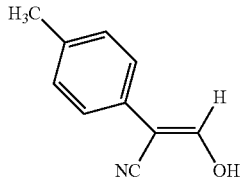

-continued

SH-6

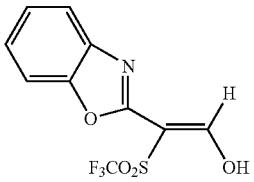

SH-7

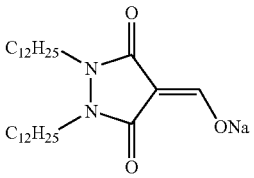

SH-8

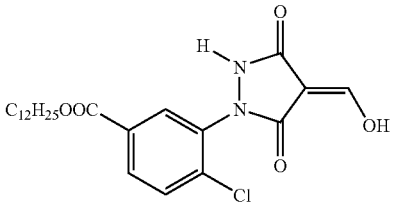

SH-9

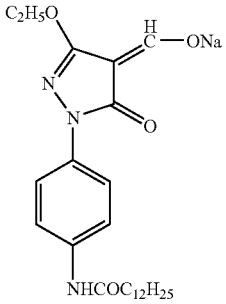

SH-10

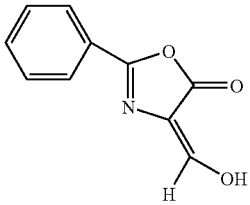

SH-11

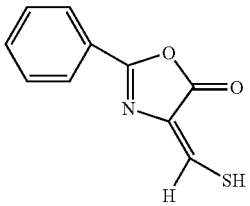

SH-12

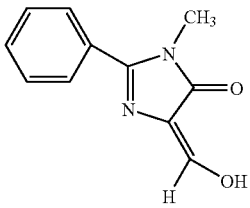

The nucleator of the present invention can be added to the image forming layer or the layer adjacent to the image forming layer, however, it is preferably added to the image forming layer. The addition amount of nucleator is in a range of $10^{-5}$ mol to 1 mol per 1 mol of organic silver salt, and preferably, in a range of $10^{-4}$ mol to $5\times10^{-1}$ mol. The nucleator may be added either only one kind or, two or more kinds in combination.

(Infectious Development Reducing Agent)

As the infectious development reducing agent used in the present invention, any infectious reducing agent may be used.

A preferable infectious development reducing agent used in the present invention is the compound represented by the following formula (R1).

Formula (R1)

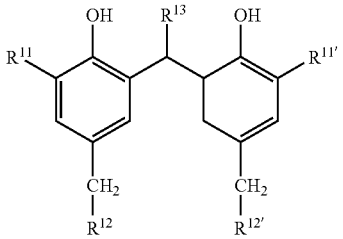

In formula (R1) described above, $R^{11}$ and $R^{11'}$ each independently represent a secondary or tertiary alkyl group having 3 to 20 carbon atoms. $R^{12}$ and $R^{12'}$ each independently represent a hydrogen atom or a group being connected through a nitrogen, oxygen, phosphorus, or sulfur atom. $R^{13}$ represents a hydrogen atom or an alkyl group having 1 to 20 carbon atoms.

Formula (R1) described above is explained in detail. As $R^{11}$ and $R^{11'}$ described above, a secondary or tertiary allyl group having 3 to 12 carbon atoms is preferable. Specifically, an isopropyl group, a tert-butyl group, a tert-amyl group, a 1,1-dimethylpropyl group, a 1,1-dimethylbutyl group, a 1,1-dimethylhexyl group, a 1,1,3,3-tetramethylbutyl group, a 1,1-dimethyldecyl group, a 1-methylcyclohexyl group, a tert-octyl group, a 1-methylcyclopropyl group, and the like are preferable, and a tert-butyl group, a tert-amyl group, a tert-octyl group, and a 1-methylcyclohexyl group are more preferable, and a tert-butyl group is most preferable.

In the case where $R^{12}$ and $R^{12'}$ are an aryloxy group, an arylthio group, an anilino group, a heterocyclic group, or a heterocyclic thio group, these group may have a substituent. As the said substituent, although any group may be possible as far as it is capable of substituting for a hydrogen atom on a benzene ring or a heterocycle, and, an alkyl group, an aryl group, a heterocyclic group, a halogen atom, an alkoxy group, a hydroxy group, an aryloxy group, an alkylthio group, an arylthio group, an amino group, an acyl group, an acyloxy group, an acylamino group, an alkoxycarbonyl group, a carbamoyl group, a sulfonyl group, a sulfonamide group, a sulfonyloxy group, a sulfamoyl group, a sulfoxido group, a ureido group, a urethane group, and the like are described. In the case where $R^{12}$ and $R^{12'}$ are an alkoxy group, a carbonyloxy group, an acyloxy group, an alkylthio group, an amino group, an acylamino group, a ureido group or a urethane group, these groups may further have a substituent and as examples of the said substituent, an alkoxy group, an alkoxycarbonyl group, an acyloxy group, an sulfonyl group, a carbonyl group, an alkylthio group, an aryloxy group, an arylthio group, a sulfonamide group, an acylamino group, and the like are described. As $R^{12}$ and $R^{12'}$ described above, a hydrogen atom, a hydroxy group, an amino group, and an anilino group are more preferable, and further, a hydrogen atom, a methoxy group, or a benzyloxy group is most preferable.

As $R^{13}$ described above, a hydrogen atom or an alkyl group having 1 to 15 carbon atoms is preferable, and an alkyl group having 1 to 8 carbon atoms is more preferable. As the said alkyl group, a methyl group, an ethyl group, a propyl group, an isopropyl group, or a 2,4,4-trimethylpenthyl group is preferable. As $R^{13}$ described above, a hydrogen atom, a methyl group, an ethyl group, a propyl group, or an isopropyl group is particularly preferable.

Typical examples of the reducing agent represented by formula (R1) of the present invention are shown below, however the present invention is not limited in these.

R1-1

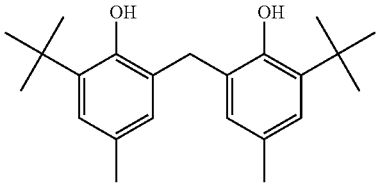

R1-2

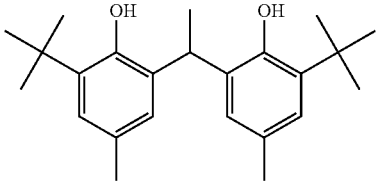

R1-3

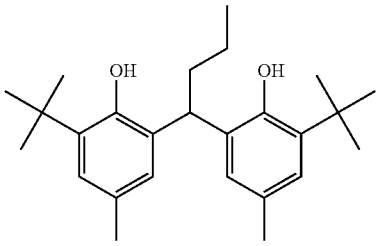

R1-4

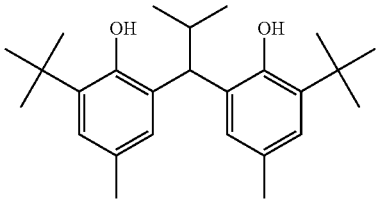

R1-5

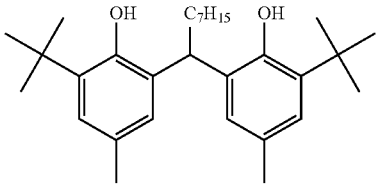

-continued

R1-6

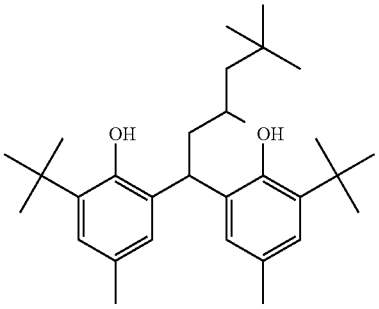

R1-7

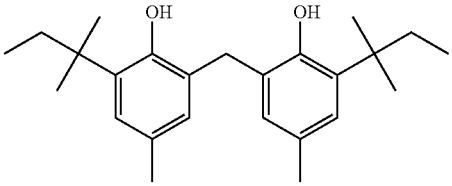

R1-8

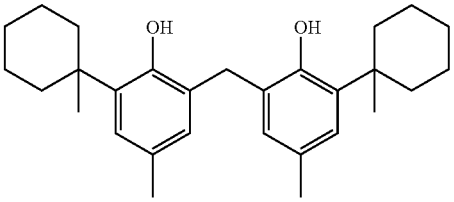

R1-9

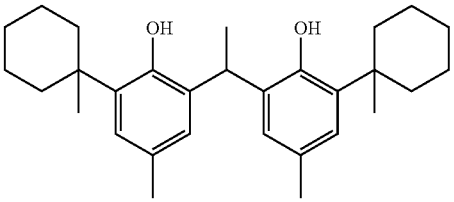

R1-10

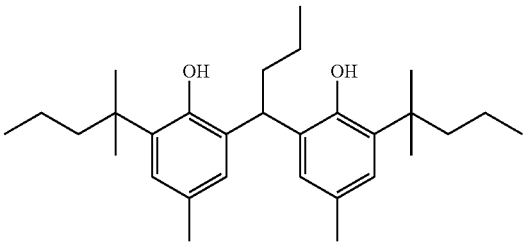

R1-11

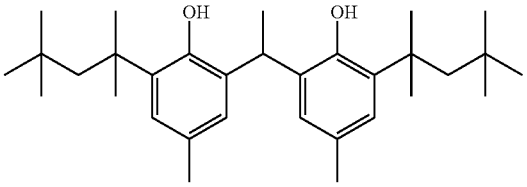

R1-12

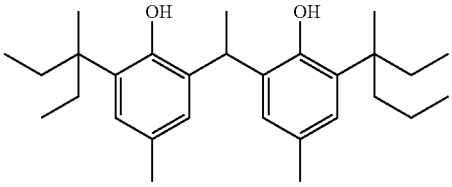

-continued
R1-13
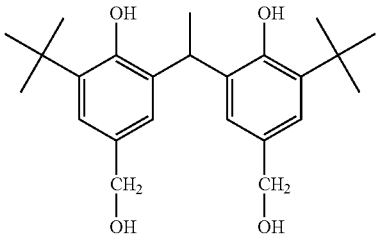
R1-14
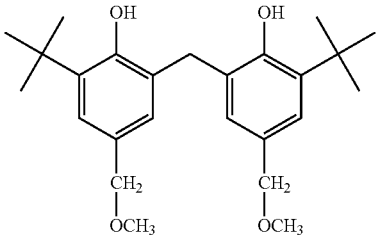
R1-15
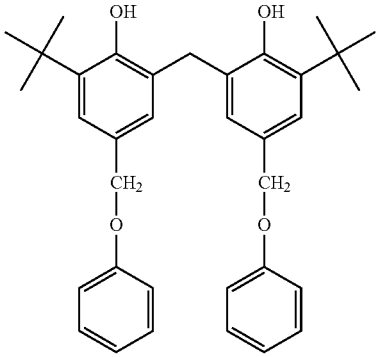
R1-16
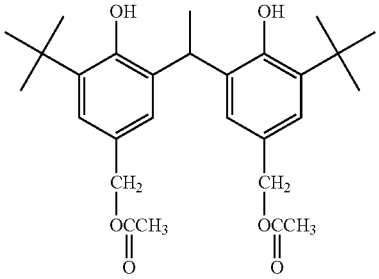
R1-17
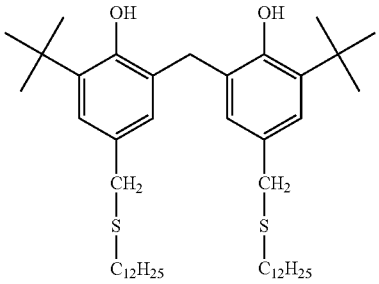
-continued
R1-18
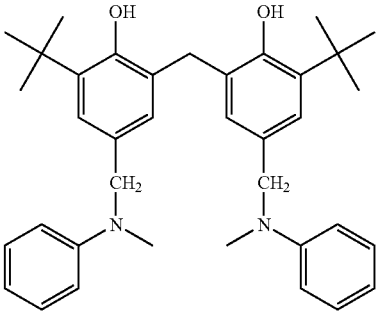
R1-19
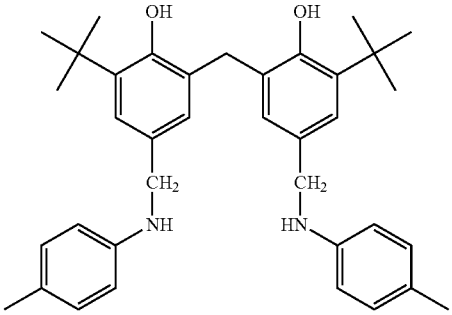
R1-20
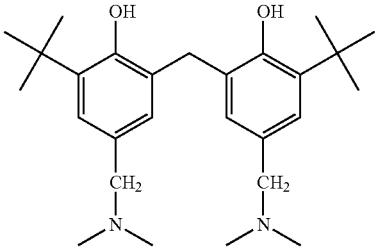
R1-21
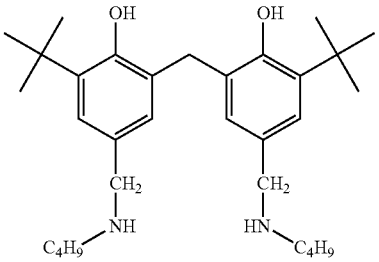
R1-22
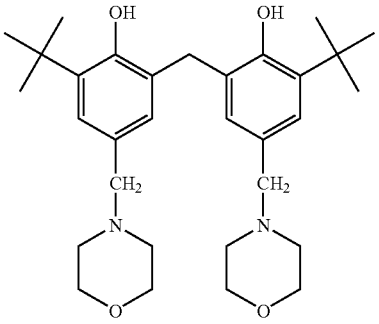

-continued
R1-23
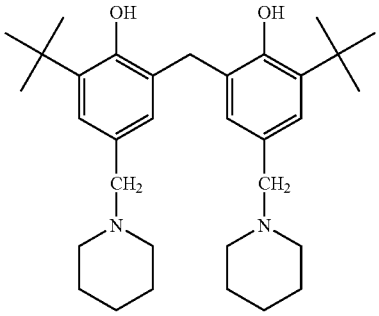
R1-24
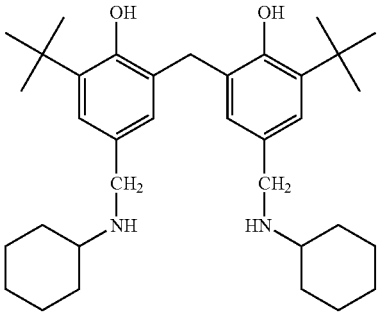
R1-25
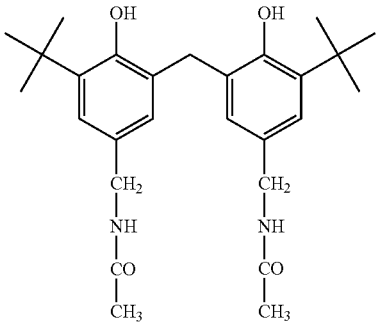
R1-26
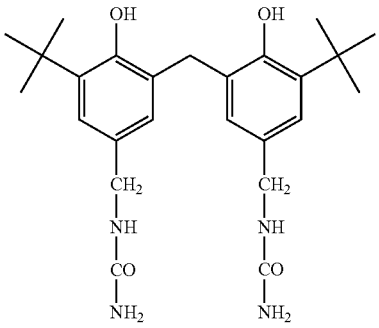
-continued
R1-27
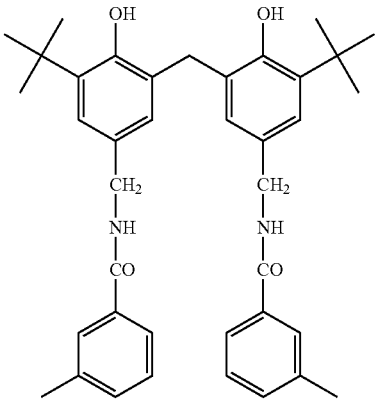
R1-28
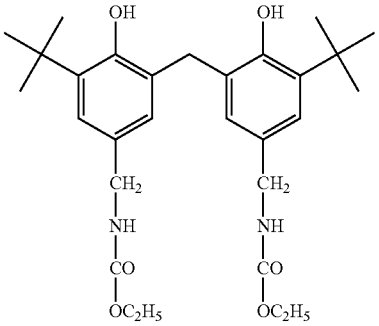
R1-29
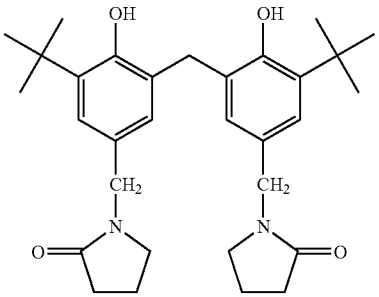
R1-30
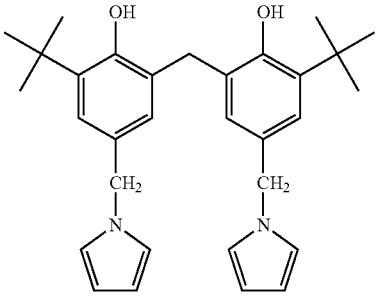

-continued

R1-31

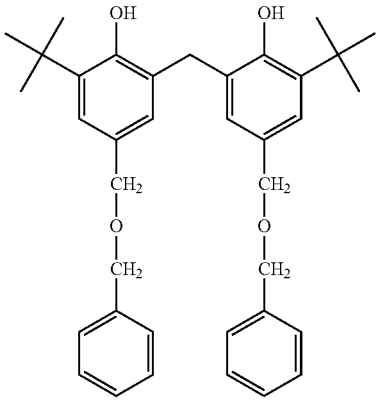

R1-32

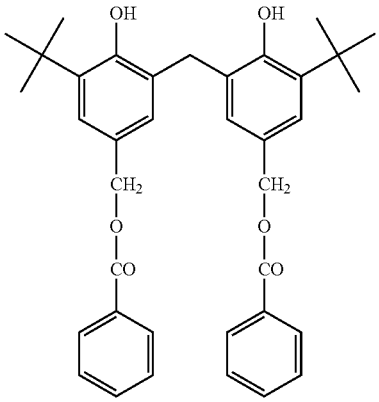

R1-33

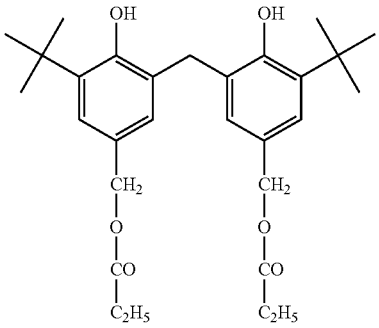

R1-34

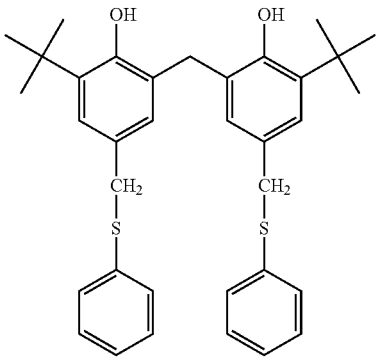

-continued

R1-35

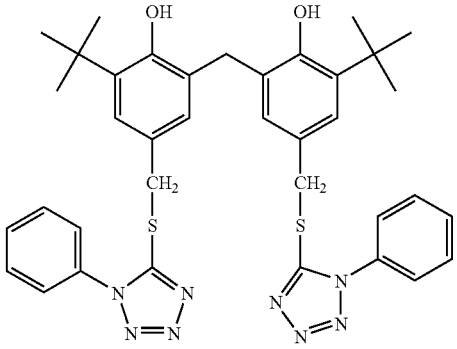

R1-36

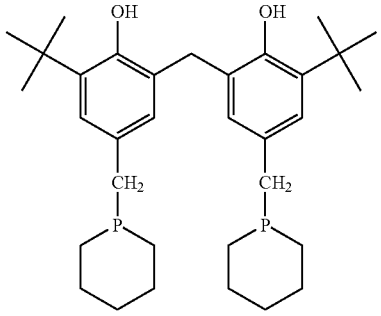

The addition amount of the reducing agent represented by the above-described formula (R1) is preferably from 0.01 $g/m^2$ to 5.0 $g/m^2$, and more preferably from 0.1 $g/m^2$ to 3.0 $g/m^2$. It is preferably contained in the range from 5 mol % to 50 mol % and, more preferably, 10 mol % to 40 mol %, per 1 mol of silver in the image forming layer. The reducing agent represented by the above-described formula (R1) is preferably contained in the image forming layer.

In the invention, other reducing agents may be used in combination with the reducing agent represented by formula (R1). The reducing agent which can be used in combination may be any substance (preferably, organic substance) capable of reducing silver ions into metallic silver. Examples of the reducing agent are described in JP-A No. 1165021 (column Nos. 0043 to 0045) and European Patent (EP) No. 0803764 (p. 7, line 34 to p. 18, line 12).

In the invention, the reducing agent which can be used in combination is preferably a so-called hindered phenolic reducing agent or a bisphenol agent having a substituent at the ortho-position to the phenolic hydroxy group.

In the case where plural reducing agents are used, the ratio of combination by mole is 1/99 to 99/1, and preferably 5/95 to 95/5.

The reducing agent of the invention can be added in the image forming layer which comprises an organic silver salt and a photosensitive silver halide, or in the layer adjacent to the image forming layer, but it is preferably contained in the image forming layer.

The reducing agent of the invention may be incorporated into photothermographic material by being added into the coating solution, such as in the form of a solution, an emulsion dispersion, a solid fine particle dispersion, or the like.

As well known emulsion dispersing method, there can be mentioned a method comprising dissolving the reducing agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

As solid fine particle dispersing method, there can be mentioned a method comprising dispersing the reducing agent in a proper solvent such as water or the like, by means of ball mill, colloid mill, vibrating ball mill, sand mill, jet mill roller mill, or ultrasonics, thereby obtaining solid dispersion. A dispersing method using a sand mill is preferable. There can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). An antiseptic (for instance, benzisothiazolinone sodium salt) can be added in the water dispersion.

In the invention, the reducing agent is particularly preferably used as a solid particle dispersion, and the reducing agent is added in the form of fine particles having average particle size from 0.01 μm to 10 μm, more preferably, from 0.05 μm to 5 μm and, further preferably, from 0.1 μm to 1 μm.

(Reducing Agent for Organic Silver Salts)

The photothermographic material of the invention preferably contains a reducing agent for organic silver salts. The reducing agent may be any substance (preferably, organic substance) capable of reducing silver ions into metallic silver. Examples of the reducing agent are described in JP-A No. 1165021 (column Nos. 0043 to 0045) and EP No. 0803764A1 (page 7, line 34 to page 18, line 12).

In the invention, when the image forming layer contains a nucleator, preferable reducing agent is the compound represented by the following formula (R).

Formula (R)

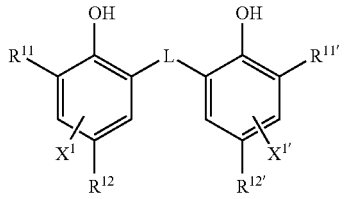

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Each of the substituents is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring.

$X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —$CHR^{13}$ group. $R^{13}$ represents a hydrogen atom or an alkyl group having 1 to 20 carbon atoms in which the alkyl group may have a substituent.

Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, and the like.

Examples of the substituent for the alkyl group can include, similar to substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a secondary or tertiary alkyl group having 3 to 15 carbon atoms. Specifically, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group, and the like can be described. $R^{11}$ and $R^{11'}$ are, more preferably, a tertiary alkyl group having 4 to 12 carbon atoms and, among them, a t-butyl group, a t-amyl group, and a 1-methylcyclohexyl group are further preferred and, a t-butyl group is most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are methyl group, ethyl group, propyl group, isopropyl group, and t-butyl group.

$X^1$ and $X^{1'}$ are preferably a hydrogen atom, a halogen atom, or an alkyl group, and more preferably, a hydrogen atom.

L is preferably a —$CHR^{13}$— group.

$R^{13}$ is preferably a hydrogen atom or an alkyl group having 1 to 15 carbon atoms. Preferable examples of the alkyl group can include a methyl group, an ethyl group, a propyl group, an isopropyl group, and a 2,4,4-trimethylpentyl group. Particularly preferable $R^{13}$ is a hydrogen atom, a methyl group, a propyl group, or an isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably an ethyl group.

When $R^{13}$ is a primary or secondary alkyl group having 1 to 8 carbon atoms, $R^{12}$ and $R^{2'}$ are preferably methyl group. The primary or secondary alkyl group having 1 to 8 carbon atoms as $R^{13}$ is preferably a methyl group, an ethyl group, a propyl group, or an isopropyl group, and more preferably a methyl group, an ethyl group, or a propyl group.

When all of $R^{11}$, $R^{11'}$, $R^{12}$, and $R^{12'}$ are a methyl group, $R^{13}$ is preferably a secondary alkyl group. In this case, the secondary alkyl group as $R^{13}$ is preferably an isopropyl group, an isobutyl group, or a 1-ethylpentyl group, and more preferably an isopropyl group.

The above reducing agent has different thermal development properties depending on the combination of $R^{11}$, $R^{11'}$, $R^{12}$, $R^{12'}$, and $R^{13}$. Since these properties can be controlled by using two or more kinds of the reducing agents in combination in various mixing ratios, it is preferable to use two or more kinds of the reducing agents depending on the purpose.

While examples of the compound represented by formula (R) of the invention are listed below, the invention is not restricted to these.

R-1

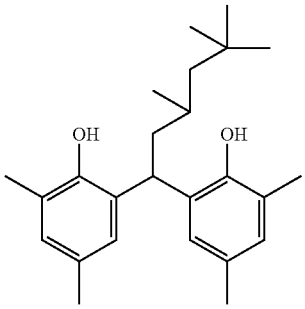

R-2

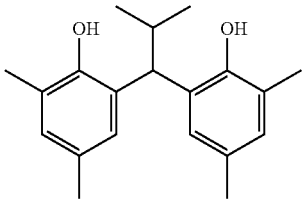

R-3

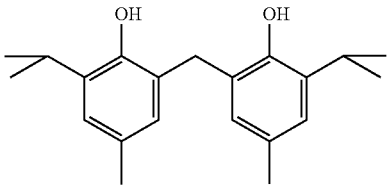

R-4

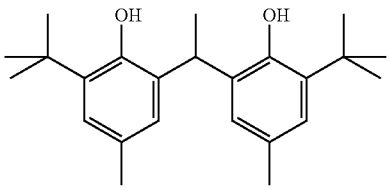

R-5

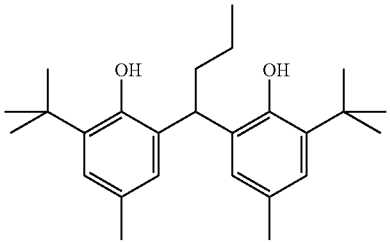

-continued

R-6

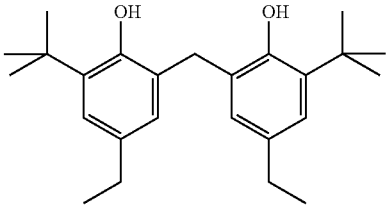

R-7

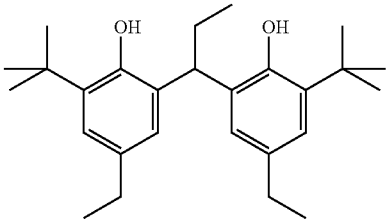

R-8

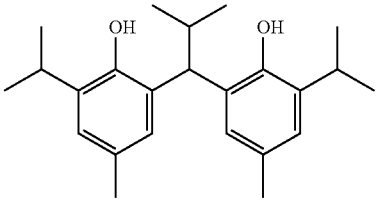

R-9

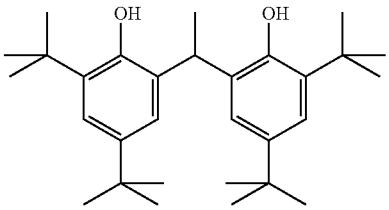

R-10

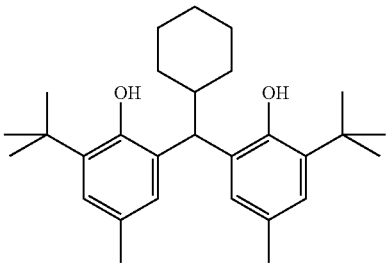

R-11

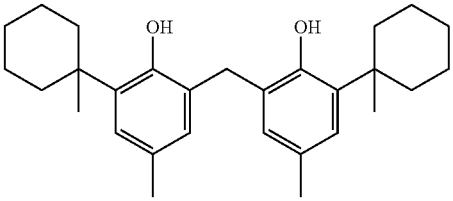

R-12

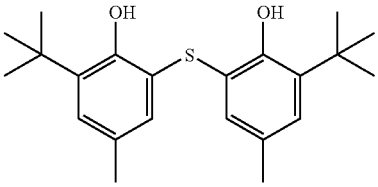

-continued

R-13

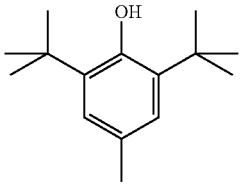

R-14

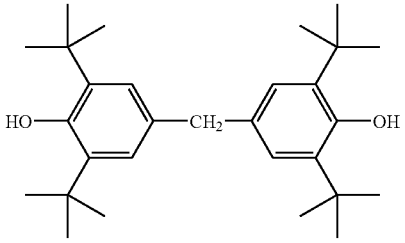

R-15

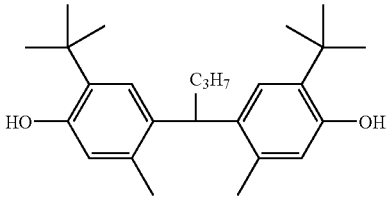

R-16

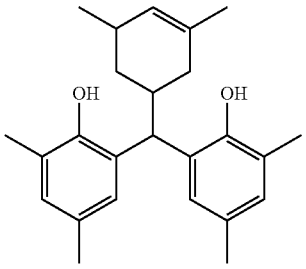

R-17

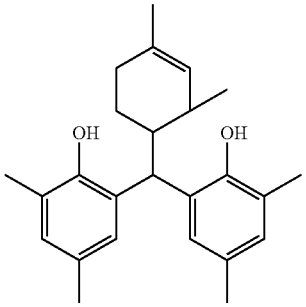

R-18

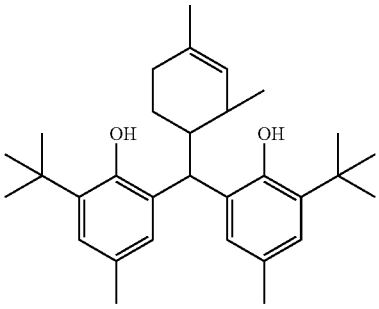

In the invention, the addition amount of the reducing agent is preferably in a range from 0.01 g/m$^2$ to 5.0 g/m$^2$, and more preferably, from 0.1 g/m$^2$ to 3.0 g/m$^2$. It is preferably contained in a range from 5 mol % to 50 mol %, and more preferably from 10 mol % to 40 mol %, per 1 mol of silver in the image forming layer.

The reducing agent of the invention can be added in the image forming layer which comprises an organic silver salt and a photosensitive silver halide, or in the layer adjacent to the image forming layer, but it is preferably contained in the image forming layer.

In the invention, the reducing agent may be incorporated into photothermographic material by being added into the coating solution in a form and by an adding method similar to those in the aforementioned infectious development reducing agent.

(Photosensitive Silver Halide)

The photosensitive silver halide used in the present invention is preferably a tabular grain which has a silver iodide content of 40 mol % or higher. More preferably, the photosensitive silver halide grain in the present invention has a mean equivalent spherical diameter of 0.2 μm to 10.0 μm and 50% or more of the projected area of the photosensitive silver halide is occupied by tabular grins having an aspect ratio of 2 or more, and further preferably, has a mean equivalent spherical diameter of 0.3 μm to 5 μm and 50% or more of the projected area of the photosensitive silver halide is occupied by the tabular grains having an aspect ratio of 3 to 100.

1) Halogen Composition

The photosensitive silver halide used in the present invention preferably has a silver iodide content of 40 mol % or higher. Other components are not particularly limited and can be selected from silver chloride, silver bromide, and organic silver salts such as silver phosphate and the like. By using such a silver halide having a high silver iodide content, a preferable photothermographic material having excellent image storability after a developing process, particularly showing remarkably small increase in fogging in irradiation with light can be designed.

Further, it is preferable that the silver iodide content is 80 mol % or higher, and it is extremely preferable from the standpoint of image storability against irradiation with light after a developing process particularly when the silver iodide content is 90 mol % or higher.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used.

Silver iodide of the invention typically can assume either a β phase or a γ phase. The term "β phase" described above means a high silver iodide structure having a wurtzite structure of a hexagonal system and the term "γ phase" means a high silver iodide structure having a zinc blende structure of a cubic crystal system. An average content of γ phase in the present invention is determined by a method presented by C. R. Berry. In the method, an average content of γ phase is calculated from the peak ratio of the intensity owing to γ phase (111) to that owing to β phases (100), (101), and (002) in powder X ray diffraction method. Detail description, for example, is described in Physical Review, volume 161, No. 3, p. 848 to 851 (1967).

2) Grain Size and Grain Form

As for the silver halide of high silver iodide according to the invention, any size can be selected. The tabular grains according to the invention preferably have a mean equivalent spherical diameter of 0.2 μm to 10.0 μm, more preferably 0.3 μm to 5.0 μm, and most preferably 0.5 μm to 3.0 μm. The term "equivalent spherical diameter" used here means a diameter of a sphere having the same volume as the volume of silver halide grain. As for measuring method, the volume of a grain is calculated from projected area and thickness of individual grains by observation through electron microscope, and thereafter the equivalent spherical diameter is determined by converting the volume to a sphere having the volume equivalent to the obtained volume.

The silver halide having high silver iodide content of the invention can take a complicated form, and as the preferable form, there are listed, for example, connecting grains as shown in R. L. JENKINS et al., J. of Phot. Sci., vol. 28 (1980), p164, FIG. 1. Tabular grains as shown in FIG. 1 of the same literature can also be preferably used. Silver halide grains which are rounded at corners can also be used preferably. The surface indices (Miller indices) of the outer surface of a photosensitive silver halide grain is not particularly restricted, and it is preferable that the ratio occupied by the [100] face is large, because of showing high spectral sensitization efficiency when a spectral sensitizing dye is adsorbed. The ratio is preferably 50% or more, more preferably 65% or more and, further preferably 80% or more. The ratio of the [100] face, Miller index, can be determined by a method described in T. Tani; J. Imaging Sci., vol. 29, page 165, (1985) utilizing adsorption dependency of the [111] face and [100] face in adsorption of a sensitizing dye.

The silver halide grain according to the invention is preferably a tabular grain.

In the invention, 50% or more of a projected area of the silver halide is occupied by grains having an aspect ratio of 2 or more. Preferably, the photosensitive silver halide used in the present invention is obtained by adhering silver halide by means of epitaxial growth onto tabular silver halide grain having an aspect ratio of 2 to 100.

50% or more of a projected area of the silver halide is preferably occupied by tabular grains having an aspect ratio of 3 to 100, and more preferably, tabular grains having an aspect ratio of 5 to 50.

The mean grain thickness is preferably 0.005 μm to 0.40 μm, more preferably 0.01 μm to 0.30 μm, and most preferably 0.03 μm to 0.20 μm.

The "epitaxy" or "epitaxial" is used in the art as the term to indicate that the silver salt has a crystal form having an orientation controlled by tabular host grains.

In order to form the sensitized sites on a tabular host grain, silver salts formed with epitaxial growth can be applied. By controlling the sites deposited by the epitaxial growth, a selective local sensitization on tabular host grain can be performed. Accordingly, at one or more regular portions, the sensitization sites can be formed. The "regular" means that the sensitization sites have a predictable and orderly relations, preferably mutually, to the major crystal faces of the tabular grains. By controlling the epitaxial deposition to the major crystal faces of the tabular grains, it is possible to control the number and the space between the horizontal direction of the sensitization sites.

Especially, on at least one part of the major crystal faces of tabular host grain, it is preferred to control silver salt epitaxy, and substantially to exclude the epitaxial deposition. In tabular host grains, an epitaxial deposition of silver salt tend to be formed at an edge portion and/or a corner portion of grains.

When the epitaxial depositions are restricted to selected portions of tabular grains, the sensitivity is increased, in comparison with randomly epitaxial growth deposition of silver salts on the major crystal faces of tabular grains. For at least one part of the major crystal faces, substantially no epitaxial deposition of silver salts is formed, and for a selected site, the silver salts is deposited in a limited range. The above range of the deposition can be changed extensively within the scope of this invention. Generally, the lesser the epitaxial coverage on the major crystal faces, the more the sensitivity increases. Silver salts formed by the epitaxial growth are preferably within less than a half, more preferably 25% or less, of the area of the major crystal faces of tabular grains. In the case where the silver salts are formed by epitaxial growth on the corner portion of tabular silver halide grain, they are preferably restricted within less than 10%, more preferably less than 5%, of the area of the major crystal faces. In some embodiments, it is observed that the epitaxial deposition is initiated at the site of the edge surface of tabular grains. Accordingly, depending on the condition, the epitaxy is restricted to a selected area of the edge portion, and the epitaxial deposition on the major crystal faces is effectively excluded.

When the silver halide grain having a latent image center is developed completely, the sites and numbers of the latent image center can not determined. However, by arresting the development before the propagation of the development from the region surrounding the latent image center, partially developed grains can be observed with a magnification and also partially developed sites can be clearly determined. These sites correspond generally to the latent image center, and generally these latent image centers correspond to the sensitized sites.

Silver salt formed by epitaxy can be selected from arbitrary silver salts which are generally capable of epitaxial growth on silver halide grains, and known in the art as useful for photographic use. Especially, the silver salts are preferably selected from those known in the photographic art as effective for shell formation in core-shell type-silver halide grains. Besides useful silver halides known in the photographic chemical use, examples of preferred silver salts, which are known to deposit on silver halide grains, include silver cyanate, silver carbonate, silver ferricyanate, silver arsenate, silver arsenite, and silver chromate, and mixtures thereof. Among them, preferred are silver chloride, silver bromide, silver thiocyanate, and mixtures thereof. Especially, at least silver bromide is preferably included.

According to the selected silver salts and the intended usage, the silver salts can be adhered effectively in the presence of a modifying agent to the tabular silver halide grains. From the host grains, the iodide can extrude the silver epitaxy. The host grains can contain any anion other than iodide ion, up to the limit of the solubility into silver iodide.

The silver halide grain used in the present invention preferably has one or more dislocation lines. More preferably the silver halide grain has 5 or more dislocation lines, and most preferably 10 or more dislocation lines.

It is preferred that 50% or more, more preferably 80% or more, of a total projected area of silver halide grains is occupied by tabular grains having one or more dislocation lines. Especially, 80% or more of the total projected area is preferably occupied by silver halide grains having 10 or more dislocation lines.

Concerning the dislocation line of silver halide crystals, the following references indicate that a dislocation line existing in the crystal can be observed by a method using an X-ray diffraction analysis or a transmission electron microscope, and various types of dislocations may be formed in the crystal by stressing the crystal.

(1) C. R. Berry, J. Appl. Phys., 27, 636 (1956)

(2) C. R. Berry, D. C. Skilman, J. Appl. Phys., 35, 2165 (1964)

(3) J. F Hamilton, Phot. Sci. Eng., 11, 57 (1967)

(4) T. Shiozawa, J. Soc. Photo. Sci. Jap., 34, 16 (1971)

(5) T. Shiozawa, J. Phot. Sci. Jap., 35, 213 (1972)

On the other hand, concerning the influence on photographic properties by a dislocation line, the reference; G C. Famell, R. B. Flint, and J. B. Chanter, J. Phot. Sci., 13, 25 (1965) describes that there are some close relations between the sites where a latent image is formed and the defects that existed in grains, with respect to the tabular silver bromide grain having a large size and a high aspect ratio.

JP-A Nos. 63-220238 and 1-201649 disclose tabular silver halide grains having dislocations formed intentionally. The tabular grains having formed dislocations exhibit an excellent photographic property such as sensitivity and reciprocity failure compared with tabular grains having no dislocations. Photosensitive materials using the above tabular silver halide grains having dislocations are excellent in sharpness and granularity.

However, in these grains, dislocation lines are formed irregularly on the edge portion of the tabular grains, and the numbers of dislocation lines are different for individual grains.

3) Coating Amount

Generally, in the case of a photothermographic material where silver halide grains remained in the layer after thermal development, the increase of the coating amount of silver halide grains may result in depressing the transparency of the film and degrading the image quality. Therefore, the coating amount is limited to a low level in spite of the demand for increasing sensitivity. However, in the case of the present invention, the haze of the film can be lowered by the thermal developing process, so more silver halide grains can be coated on the material. In the practice of the present invention, the coating amount of the silver halide is preferably from 0.5 mol % to 100 mol % per 1 mol of silver contained in the non-photosensitive organic silver salt, and more preferably from 5 mol % to 50 mol %.

4) Method of Grain Formation

The method of forming photosensitive silver halide is well-known in the relevant art and, for example, methods described in Research Disclosure No. 17029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

Concerning the method of forming tabular grains of silver iodide, the methods described in the aforementioned JP-A Nos. 59-119350 and 59-119344 are preferably used.

5) Heavy Metal

The photosensitive silver halide grain of the invention can contain metals or complexes of metals belonging to groups 6 to 12 of the periodic table. The metal or the center metal of the metal complex from groups 6 to 12 of the periodic table is preferably rhodium, ruthenium, or iridium. The metal complex may be used alone, or two or more kinds of complexes comprising identical or different species of metals may be used together. The content is preferably in a range from $1\times10^{-9}$ mol to $1\times10^{-3}$ mol, per 1 mol of silver. The heavy metals, metal complexes and the addition method thereof are described in JP-A No. 7-225449, in paragraph Nos. 0018 to 0024 of JP-A No. 11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion, and lithium ion, ammonium ion, and alkyl ammonium ion (for example, tetramethyl ammonium ion, tetraethyl ammonium ion, tetrapropyl ammonium ion, and tetra(n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization, and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since silver salt of hexacyano iron (II) is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 1184574, in paragraph Nos. 0025 to 0031 of JP-A No. 11-65021, and paragraph Nos. 0242 to 0250 of JP-A No. 11-119374.

6) Gelatin

As the gelatin contained in the photosensitive silver halide emulsion used in the invention, various kinds of gelatins can be used. It is necessary to maintain an excellent dispersion state of a photosensitive silver halide emulsion in a coating solution containing an organic silver salt, and gelatin having a low molecular weight of 500 to 60,000 is preferably used. These gelatins having a low molecular weight may be used at grain formation step or at the time of dispersion after desalting treatment and it is preferably used at the time of dispersion after desalting treatment.

7) Chemical Sensitization

The photosensitive silver halide in the present invention is preferably chemically sensitized by at least one of chalcogen sensitizing method, gold-chalcogen sensitizing method, and reduction sensitizing method.

As the chalcogen sensitization, sulfur sensitization, selenium sensitization, and tellurium sensitization are exemplary techniques. Among them, tellurium sensitization is preferred.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolin-2-thiones, disulfides or polysulfides (e.g., dimorphorinedisulfide, cystine, or lenthionine), polythionates, and sulfur element, and active gelatin can be used. Specifically, thiosulfates, thioureas, and rhodanines are preferred.

In selenium sensitization, unstable selenium compounds can be used. These unstable selenium compounds are described in Japanese Patent Application Publication (JP3) Nos. 43-13489 and 44-15748, JP-A Nos. 4-25832, 4-109340, 4-271341, 540324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyltriphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used. Furthermore, non-unstable selenium compounds such as selenius acid, salts of selenocyanic acid, selenazoles, and selenides described in JPB Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride, or ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarmonyl)telluride), telluroureas (e.g., N,N'-dimethylethylenetellurourea or N,N'-diphenylethylenetellurourea), telluramides, or telluroesters may be used. Specifically, diacyl(di)tellurides and phosphinetellurides are preferred. Especially, the compounds described in paragraph No. 0030 of JP-A No. 11-65021 and compounds represented by formula (II), (M), and (IV) in JP-A No. 5-313284 are preferred.

The gold-chalcogen sensitization of the invention is a combination of the above chalcogen sensitization and the gold sensitization described below. Specifically, the sensitization include gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization. It is preferred that at least sulfur sensitization is combined with another sensitization.

In gold sensitization, gold sensitizer described in Chimie et Physique Photographique, written by P. Grafkides, (Paul Momtel, 5th ed., 1987) and Research Disclosure (vol. 307, Item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. U.S. Pat. No. 6,918,57, and the like can also be used. Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, Item 307105), can also be used.

The addition amount of chalcogen sensitizer used in the invention may vary depending on the silver halide grain used, the chemical ripening condition and the like, and it is about $10^{-8}$ mol to $10^{-1}$ mol, and preferably, about $10^{-7}$ mol to $10^{-2}$ mol, per 1 mol of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol per 1 mol of silver halide.

At the chemical sensitization step of the invention, especially, at the chalcogen sensitization step or gold-chalcogen sensitization step, it is preferred that water-soluble thiocyanate (e.g., potassium thiocyanate, sodium thiocyanate, ammonium thiocyanate, or the like) is used. The addition amount thereof is $1\times10^{-3}$ or more, preferably from $2\times10^{-3}$ mol to $8\times10^{-1}$ mol. more preferably from $3\times10^{-3}$ mol to $2\times10^{-}$mol, and particularly preferably from $5\times10^{-3}$ mol to $1\times10^{-1}$ mol, per 1 mol of silver halide in each case.

In the reduction sensitization according to the invention, reduction sensitizer is used. As the specific compounds, ascorbic acid, borane compounds such as dimethylamine borane and the like, stannous chloride, aminoimino methane sulfinic acid, hydrazine derivatives, silane compounds, polyamine compounds and the like are described. The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The reduction sensitization can be used alone or in combination with the aforementioned chalcogen sensitization or the gold-chalcogen sensitization. However, when it is used in combination with the gold-chalcogen sensitization, it is preferably perfomed inside the silver halide grain.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol, per 1 mol of silver halide.

In the invention, the chemical sensitization can be performed at any stage, at a grain formation step or after a grain formation step, as long as it is before coating, and particularly at a grain formation step or after a grain formation step. Further, it can be performed at any stage, before, at the time, or after the spectral sensitization step.

There is no particular restriction on the condition for the chemical sensitization in the invention and, appropriately, the pAg is 8 or lower, preferably, 7.0 or lower and, particularly preferably, 6.5 or lower, and the pAg is 3 or higher, and preferably, 4.0 or higher, the pH is 3 to 10, and preferably, 4 to 9; and temperature is at 20° C. to 95° C., and preferably, 25° C. to 80° C.

In the silver halide emulsion used in the invention, a thiosulfonate compound may be added by the method shown in EP-A No. 293917.

8) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. Particularly, the photothermographic material of the invention is preferably spectrally sensitized to have a spectral sensitive peak in a range of 600 nm to 900 nm, or in a range of 300 nm to 500 nm. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (1) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238, and 2002-23306. These sensitizing dyes may be used alone or, two or more kinds of them may be used in combination.

In the invention, the sensitizing dye may be added at any amount according to the properties of sensitivity and fog, but it is preferably added from $10^{-6}$ mol to 1 mol, and more preferably from $_{10}{}^{-4}$ mol to $10^{-1}$ mol, per 1 mol of silver halide in the image forming layer.

The photothermographic material of the invention may also contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547 and 10-111543, and the like.

9) Compound that can be One-Electron-Oxidized to Provide a One-Electron Oxidation Product which Releases one or more Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

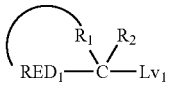

-continued

Formula (2)

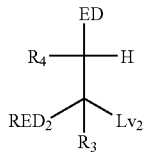

In formulae (1) and (2), $RED_1$ and $RED_2$ each independently represent a reducible group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

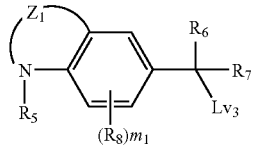

Formula (4)

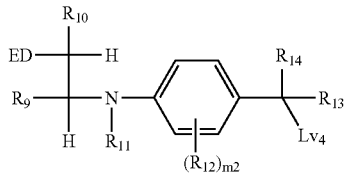

Formula (5)

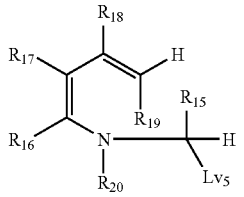

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bind each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

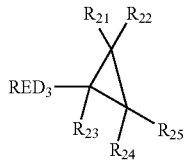

-continued

Formula (7)

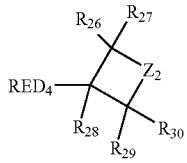

In formulae (6) and (7), $RED_3$ and $RED_4$ each independently represent a reducible group. $R_{21}$ to $R_{30}$ ea independently represent a hydrogen atom or a substituent. $Z_2$ represents one selected from —$CR_{111}R_{112}$—, —$NR_{113}$—, and —O—. $R_{111}$ and $R_{112}$ each independently represent a hydrogen atom or a substituent. $R_{113}$ represents one selected from a hydrogen atom, an alkyl group, an aryl group, and a heterocyclic group.

Formula (8)

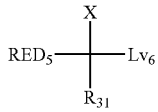

In formula (8), $RED_5$ is a reducible group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, and a heterocyclic amino group. $Lv_6$ is a leaving group and represents a carboxyl group or a salt thereof, or a hydrogen atom.

Reaction formula (1)

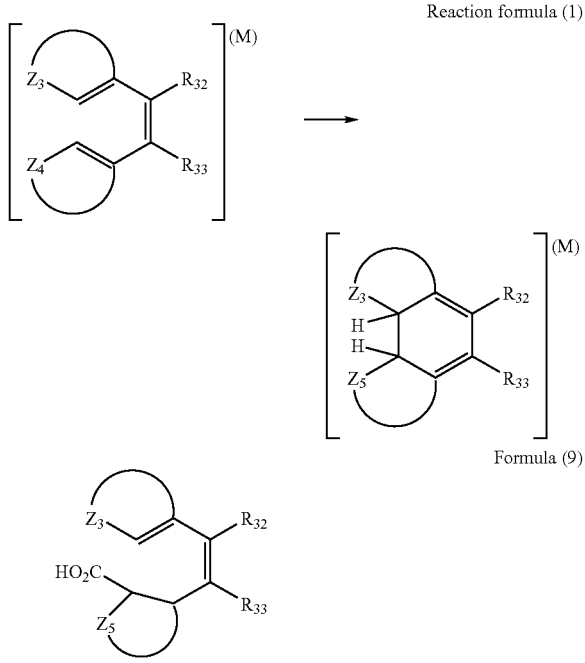

Formula (9)

The compound represented by formula (9) is a compound that undergoes a bonding reaction represented by reaction fomula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hrdrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

$RED_6$-Q-Y Formula (10)

In formula (10), $RED_6$ represents a reducible group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

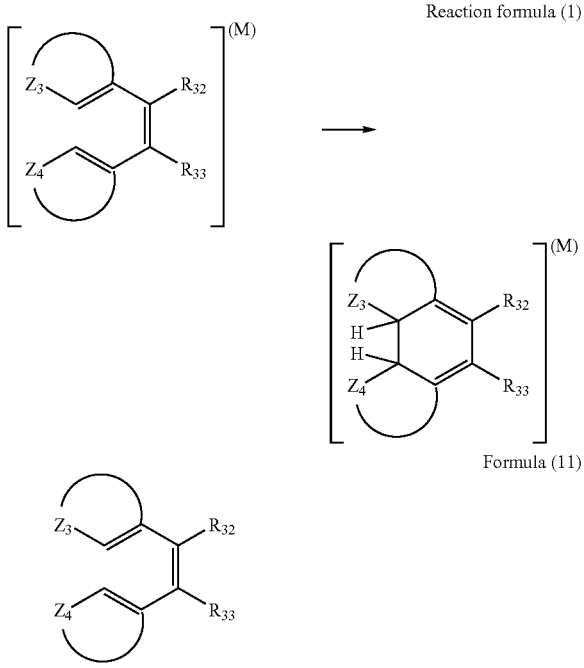

Formula (11)

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from each other.

As preferable adsorptive group, a nitrogen containing heterocyclic group substituted by a mercapto group (e.g., a 2-mercaptothiazole group, a 3-mercapto-1,2,4-triazole group, a 5-mercaptotetraaole group, a 2-mercapto -1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen containing heterocyclic group and the like) are a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group including quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used, and a 5 or 6-membered aromatic heterocyclic group containing a quaternary nitrogen atom is further preferably used. Particularly preferably, a pyrydinio group, a quinolinio group, or an isoquinolinio group is used. The nitrogen containing heterocyclic group including a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 and 2 having a quaternary salt of nitrogen or phosphorus as an adsorptive group is represented by formula (X).

$$(P\text{-}Q_1)_i\text{—}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a connecting group, and typically represent one selected from a single bond, an alkylene group, an arylene group, a heterocyclic group, —O—, —S—, $NR_N$, (═O)—, —$SO_2$, —SO—, —P(═O)—, and the group which consists of combinations thereof. Herein, $R_N$ represents one selected from a hydrogen atom, an alkyl group, an aryl group, and a heterocyclic group. S represents a residue which is obtained by removing one atom from the compound represented by Group 1 or 2. i and j are an integral number of 1 or more, and are selected in a range of i+j=2 to 6. It is preferred that i is 1, 2, or 3 and j is 1 or 2. It is more preferred that i is 1 or 2 and j is 1. And, it is particularly preferred that i is 1 and j is 1. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

Specific examples of the compounds of Groups 1 and 2 according to the invention are shown below without intention of restricting the scope of the invention.

1

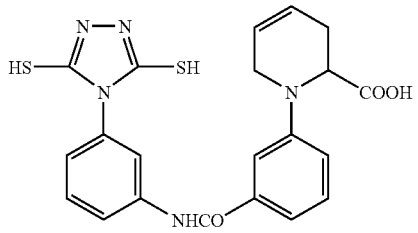

2

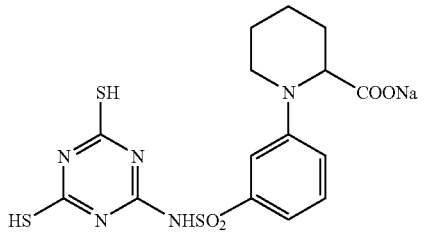

3

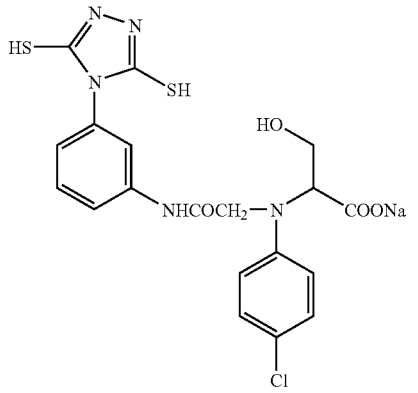

4

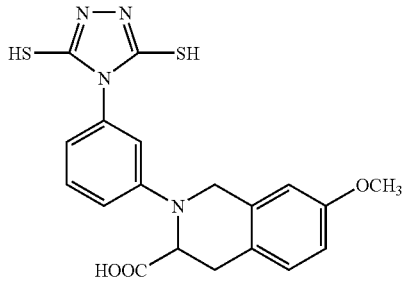

5

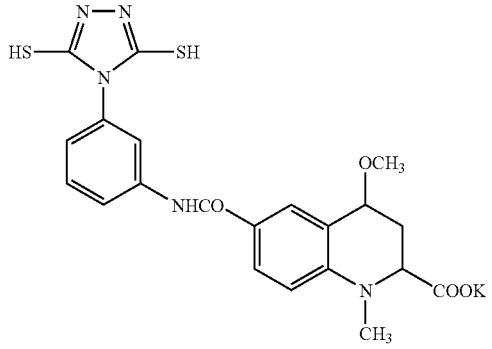

6

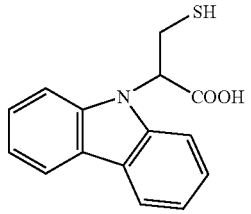

-continued
7
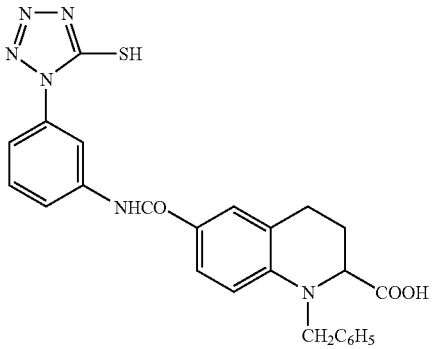
8
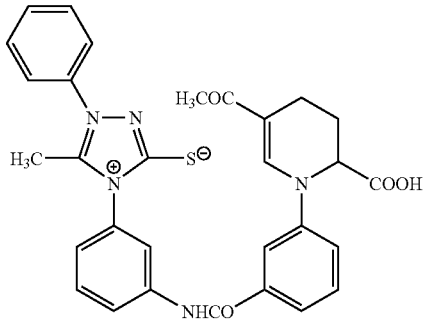
9
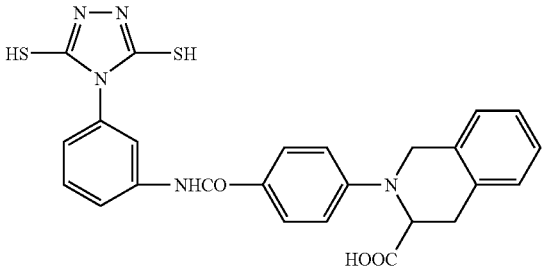
10
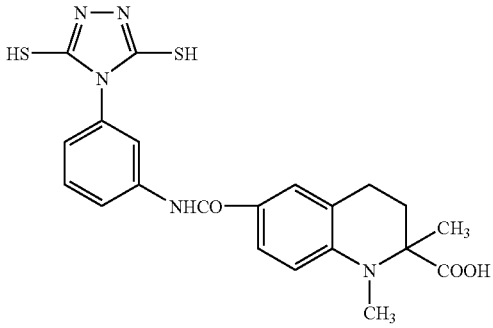
11
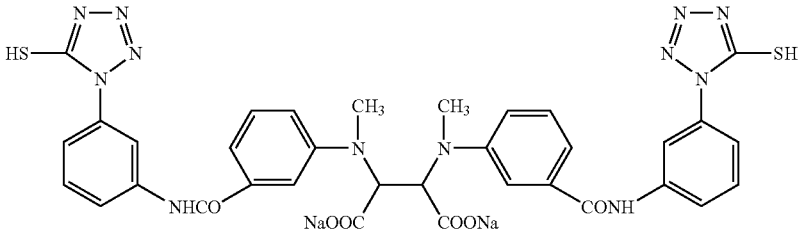
12
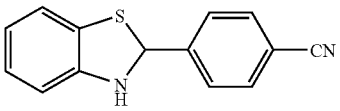
13
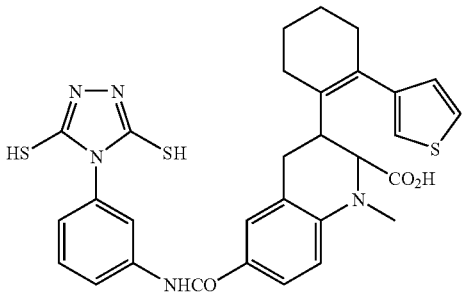
14
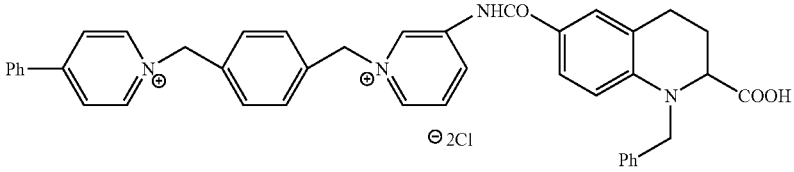

-continued
15
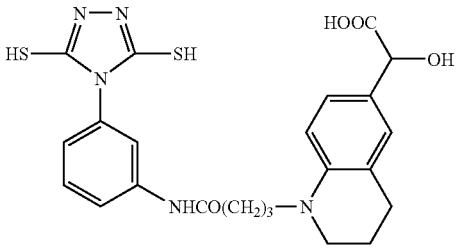
16
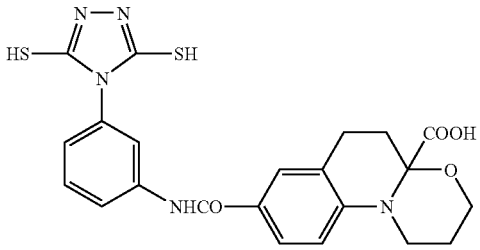
17
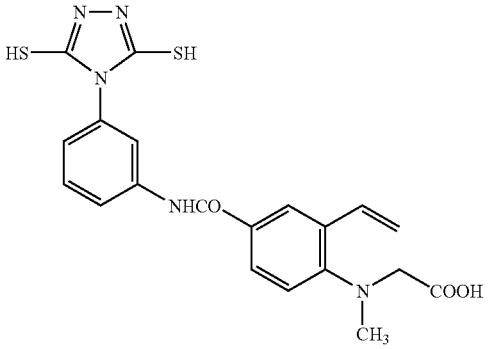
18
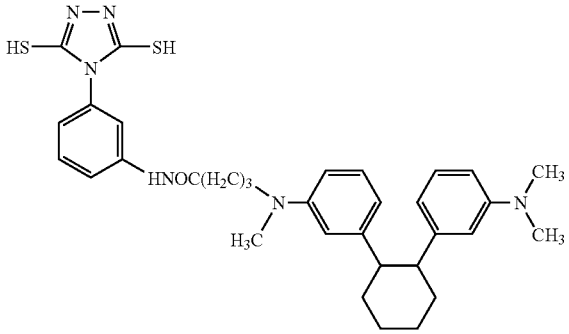
19
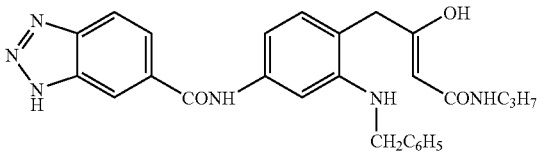
20
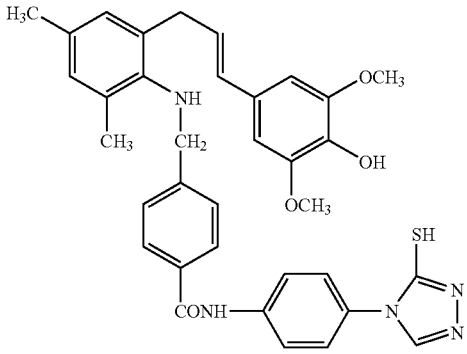
21
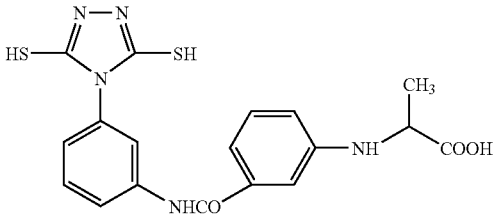
22
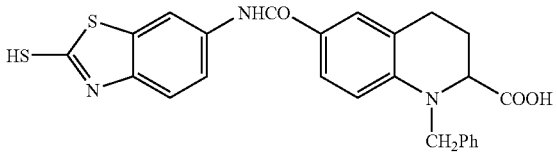
23
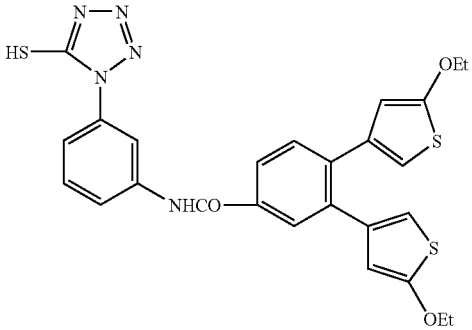
24
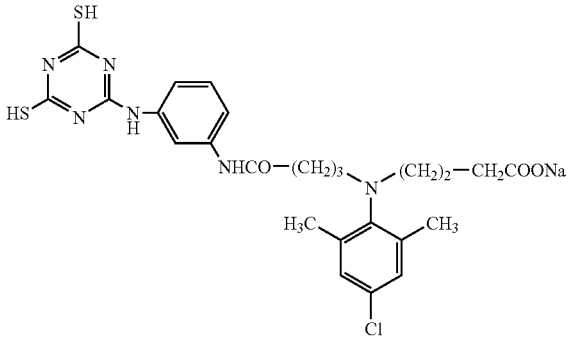

-continued
25
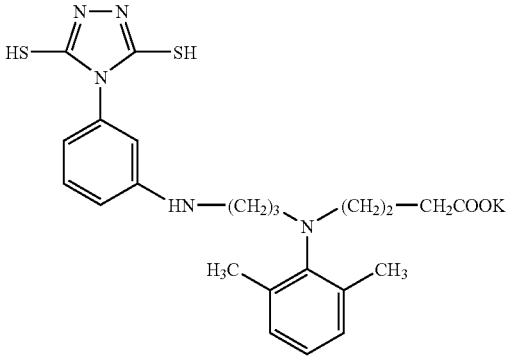
26
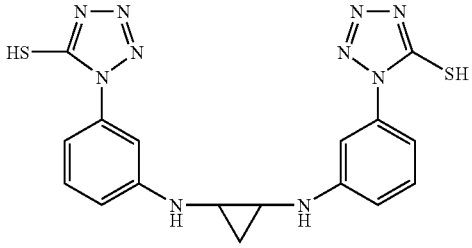
27
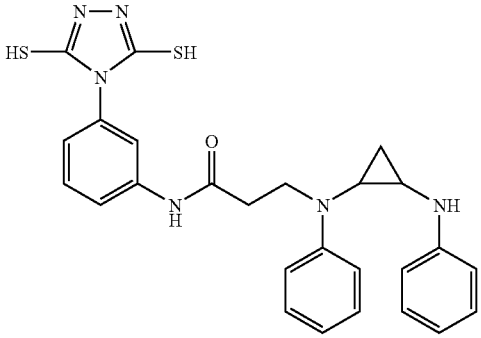
28
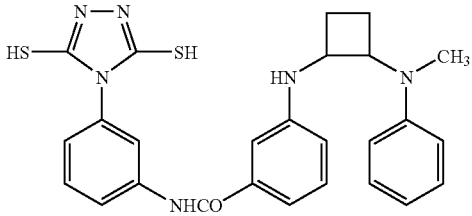
29
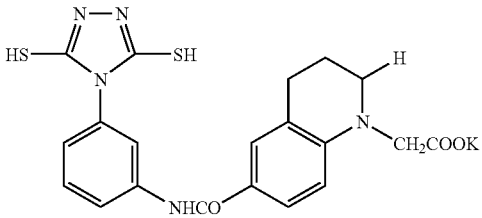
30
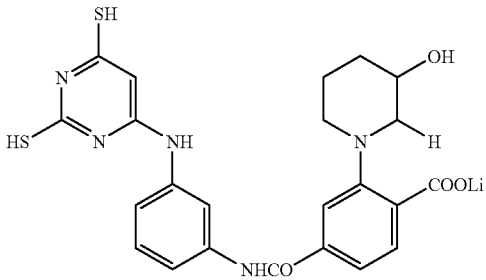
31
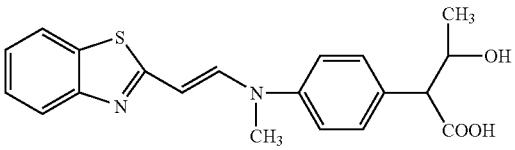
32
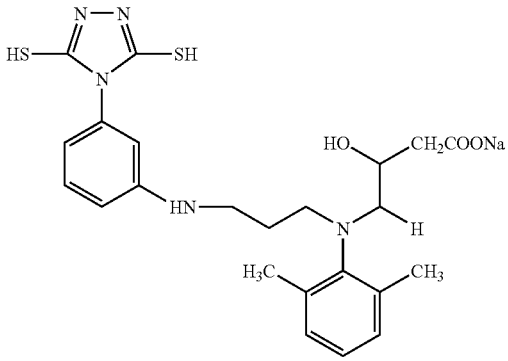

-continued
33
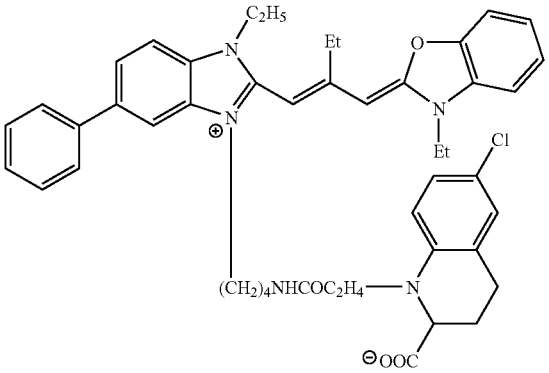
34
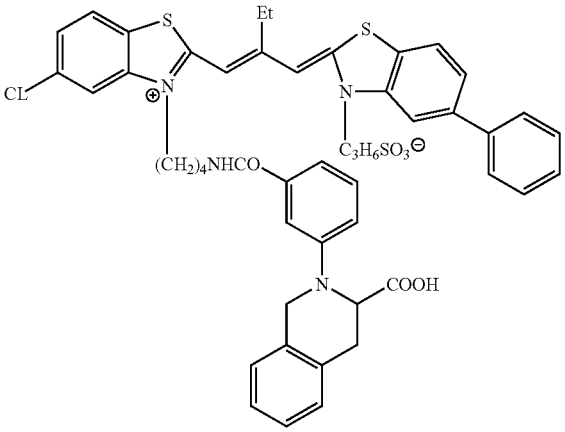
35
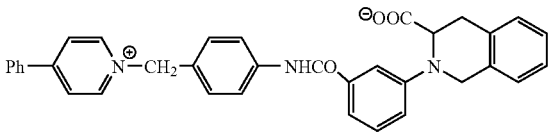
36
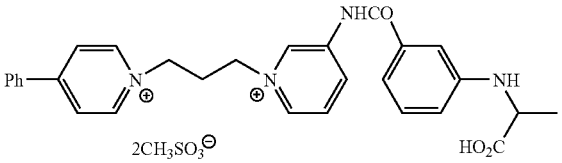
37
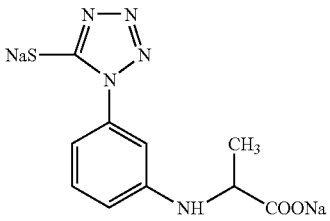
38
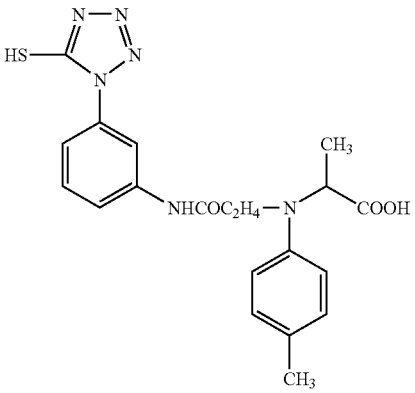
39
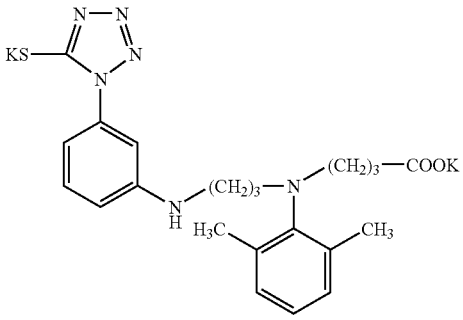
40
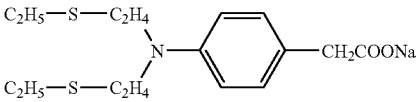

-continued

41

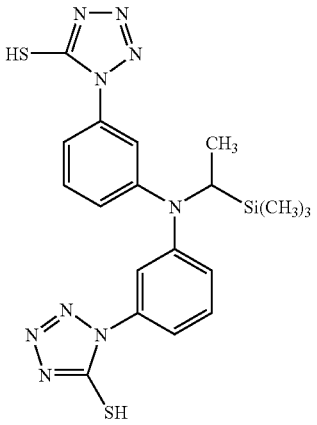

42

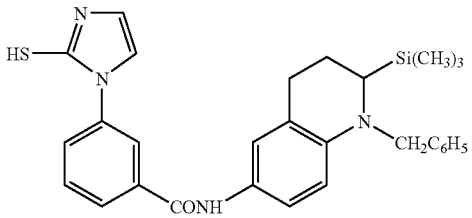

43

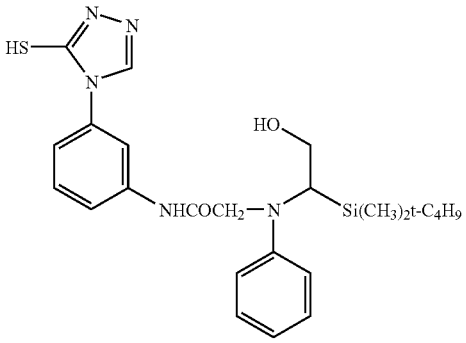

44

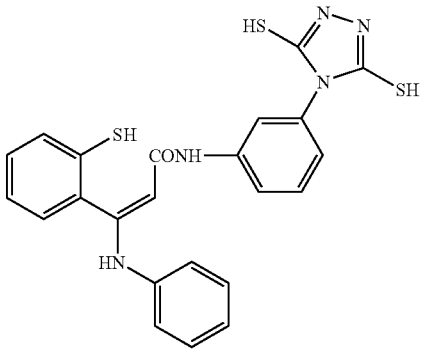

45

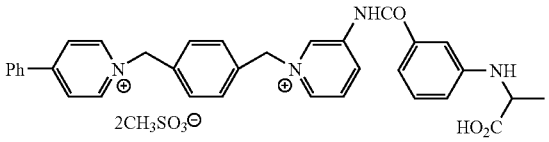

46

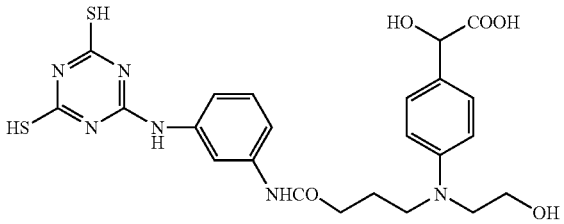

47

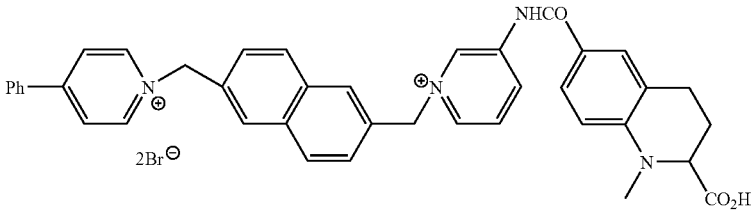

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added after the photosensitive silver halide grain formation step and before the desalting step; in the chemical sensitization step Oust before the chemical sensitization to immediately after the chemical sensitization); or before coating.

It is preferred that the compound of Groups 1 and 2 used in the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably added to the image forming layer. The compound may be added to a surface protective layer or an intermediate layer, in combination with its addition to the image forming layer, to be diffused to the image forming layer in the coating step. These compounds may be added before or after addition of a sensitizing dye. Each compound is contained in the image forming layer preferably in an amount of $1\times10^{-9}$ mol to $5\times10^{-2}$ mol, more preferably $1\times10^{-8}$ mol to $2\times10^{-3}$ mol per 1 mol of silver halide.

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

A—(W)n—B Formula (I)

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^+$, $K^+$, $Mg^+$, $Ag^+$, $Zn^{2+}$ and the like), an ammonium ion, a heterocyclic group comprising a quaternary nitrogen atom, a phosphonium ion and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamate ester group.

The heterocyclic group containing at least one atom selected from a nitrogen atom, a sulfur atom, a selenium atom and a tellurium atom represents a nitrogen atom containing heterocyclic group having —NH— group, as a partial structure of heterocycle, capable to form a silver iminate (>NAg) or a heterocyclic group, having an —S— group, a —Se— group, a —Te— group or a ═N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzophthiophene group, a benzothiazole group, a benzoxazole group, a thiadiazole group, an oxadiazole group, a triazine group, a selenoazole group, a benzoselenazole group, a tellurazole group, a benzotellurazole group, and the like are described.

The sulfide group or disulfide group as an adsorptive group contains all groups having "—S—" or "—S—S—" as a partial structure.

The cationic group as an adsorptive group mean the group containing a quaternary nitrogen atom, such as an ammonio group or nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4- dimercaptotriazine group, a 3,5-dimercapto-1,2,4-triazole group, a 2,5-dimercapto-1,3-thiazole group, or the like) or a nitrogen atom containing heterocyclic group having a —NH— group capable to form an imino-silver (>NAg) as a partial structure of heterocycle (e.g., a benzotriazole group, a benzimidazole group, an indazole group, or the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward photographic properties. For example, a divalent linking group, which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducible group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), aninines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducible group represented by B in formula (1), can be measured by using the measuring method described in Akira Fujishinia, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

In formula (I), a reducible group represented by B preferably is a residue which is obtained by removing one hydrogen atom from hydroxylamines, hydroxamic acids, hydroxyureas, hydroxysemicarbazides, reductones, phenols, acylhydrazines, carbamoylhydrazines, 3-pyrazolidones, or the like.

The compound of formula (I) in the present invention may have the ballasted group or polymer chain in it generally used in the non-moving photographic additives as a coupler. And as a polymer, for example, the polymer described in JP-A No. 1-100530 can be selected.

The compound of formula (I) in the present invention may be bis or tris type of compound. The molecular weight of the compound represented by formula (I) in the present invention is preferably from 100 to 10,000 and more preferably from 120 to 1,000 and particularly preferably from 150 to 500.

The examples of the compound represented by formula (I) in the present invention are shown below, but the present invention is not limited in these.

(1)

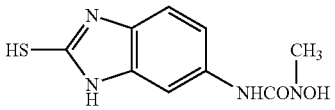

(2)

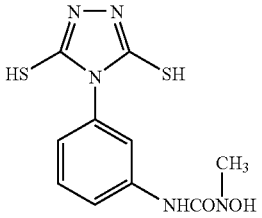

-continued (3)

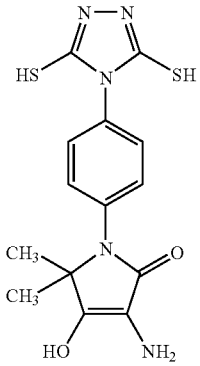

(4)

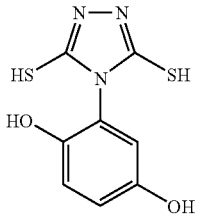

(5)

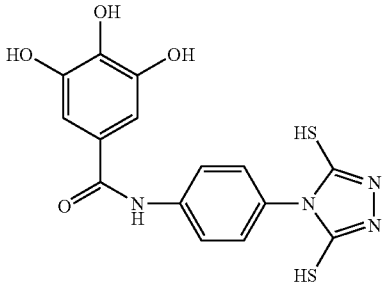

(6)

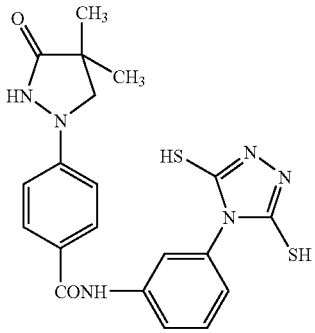

(7)

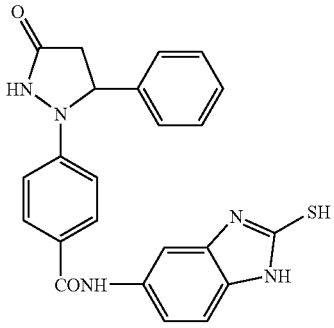

-continued (8)

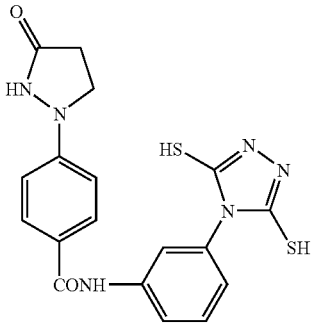

(9)

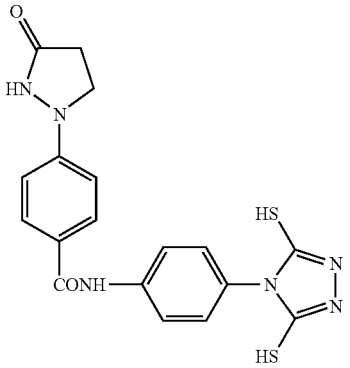

(10)

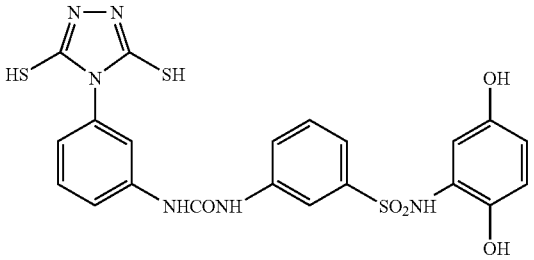

(11)

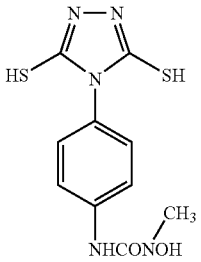

(12)

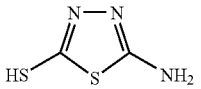

(13)

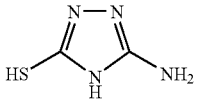

Further, example compounds 1 to 30 and 1"-1 to 1"-77 shown in EP No.1308776A2, pages 73 to 87 are also described as preferable examples of the compound having an adsorptive group and a reducible group according to the invention.

These compounds can be easily synthesized by any known method.

The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound may be added in several times, during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds may be added as an emulsified dispersion by dissolving them in an organic solvent having a high boiling point and also may be added as a solid dispersion.

11) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Mixing Silver Halide and Organic Silver Salt

The photosensitive silver halide in the invention is particularly preferably formed in the absence of the non-photosensitive organic silver salt and chemically sensitized. This is because sometimes sufficient sensitivity can not be attained by the method of forming the silver halide by adding a halogenating agent to an organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Hamby and M. F. Edwards, translated by Koji Takahashi (Nikkan Kogyo Shinbunsha, 1989).

(Compound which Substantially Reduces Visible Light Absorption by Photosensitive Silver Halide)

In the present invention, it is preferred that the photothermographic material contains a compound which substantially reduces visible light absorption by photosensitive silver halide after thermal development versus before thermal development.

In the present invention, it is particularly preferred that a silver iodide complex-forming agent is used as the compound which substantially reduces visible light absorption by photosensitive silver halide after thermal development.

<Silver Iodide Complex-Forming Agent>

As for the silver iodide complex-forming agent according to the present invention, at least one of a nitrogen atom or a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion and the silver complex forming agent. As a general guide, it is possible to obtain a large stability constant by a chelate effect from intramolecular chelate ring formation, by means of increasing the acid-base dissociation constant and the like.

In the present invention, the ultra violet-visible light absorption spectrum of the photosensitive silver halide can be measured by a transmission method or a reflection method. When the absorption derived from other compounds added to the photothermographic material overlaps with the absorption of photosensitive silver halide, the ultra violet-visible light absorption spectrum of photosensitive silver halide can be observed by using, independently or in combination, the means of difference spectrum and removal of other compounds by solvent and the like.

As a silver iodide complex-forming agent according to the present invention, a 5 to 7-membered heterocyclic compound containing at least one nitrogen atom is preferable. In the case where the compound does not have a mercapto group, a sulfide group, or a thione group as a substituent, the said nitrogen containing 5 to 7-membered heterocycle may be saturated or unsaturated, and may have another substituent. The substituent on a heterocycle may bind to each other to form a ring.

As preferable examples of 5 to 7-membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phtharazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$; $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naththilizine, or phenanthroline derivative, the acid dissociation constant (pKa) of a conjugated acid of nitrogen containing heterocyclic part in acid dissociation equilibrium of the said compound preferably is 3 to 8 in the mixture solution of tetrahydrofuran/water (3/2) at 25° C., and more preferably, the pKa is 4 to 7.

As the heterocyclic compound, pyridine, pyridazine, or phtharazine derivative is preferable, and particularly preferable is pyridine or phthalazine derivative.

In the case where these heterocyclic compounds have a mercapto group, a sulfide group or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

Formula (1)

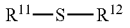

Formula (2)

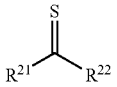

In formula (1), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7-membered nitrogen containing heterocyclic type silver iodide complex-forming agent mentioned above can be described.

Further, the compound represented by formula (3) described below can also be used preferably.

Formula (3)

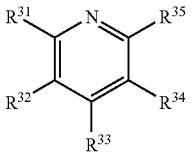

In formula (3), $R^{31}$ to $R^{35}$ each independently represent a hydrogen atom or a substituent. As the substituent represented by $R^{31}$ to $R^{35}$, the substituent of a 5 to 7-membered nitrogen containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bind each other to form a saturated or an unsaturated ring. A preferred substituent is a halogen atom, an allyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part preferably is 3 to 8 in the mixed solution of tetrahydrofuran/water (3/2) at 25° C., and particulary preferably 4 to 7.

Furthermore, the compound represented by formula (4) is also preferable.

Formula (4)

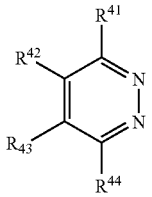

In formula (4), $R^{41}$ to $R^{44}$ each independently represent a hydrogen atom or a substituent. $R^{41}$ to $R^{44}$ may bind each other to form a saturated or an unsaturated ring. As the substituent represented by $R^{41}$ to $R^{44}$, the substituent of a 5 to 7-membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one subsutituent. As examples of $R^{51}$ to $R^{56}$ in formula (5), the substituent of a 5 to 7-membered nitrogen containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

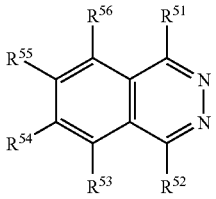

Further, the compound represented by formula (6) described below is also a preferable embodiment.

Formula (6)

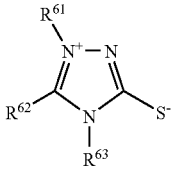

In formula (6), $R^{61}$ to $R^{63}$ each independently represent a hydrogen atom or a substituent. As examples of the substituent represented by $R^{62}$, the substituent of a 5 to 7-membered nitrogen containing heterocyclic type silver iodide complex-forming agent mentioned above can be described.

As the compound preferably used, the compound represented by the following formula (7) is described.

$$R^{71}—S—(L)_n—S—R^{72}$$ Formula (7)

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group, and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

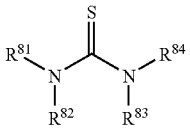

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6) and (7) are more preferable and, the compounds represented by formulae (3) and (5) are particularly preferable.

Preferable examples of silver iodide complex-forming agent are described below, however the present invention is not limited in these.

(1)

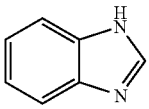

-continued (2)

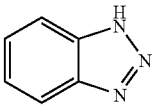

(3)

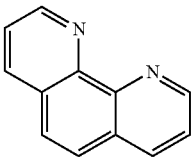

(4)

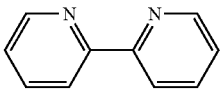

(5)

$C_5H_{11}SC_5H_{11}$ (6)

$C_4H_9SCH_2CH_2SC_4H_9$ (7)

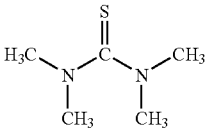

(8)

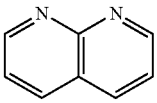

(9)

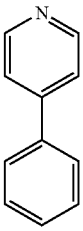

(10)

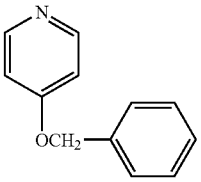

(11)

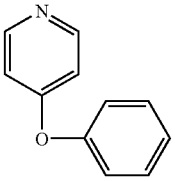

(12)

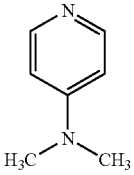

-continued
(13)
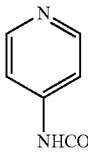
(14)
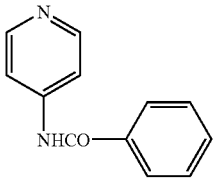
(15)
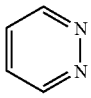
(16)
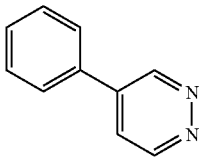
(17)
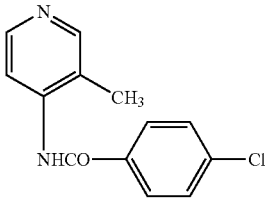
(18)
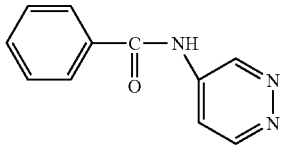
(19)
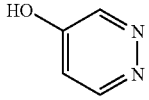
(20)
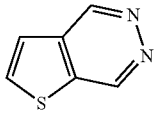
(21)
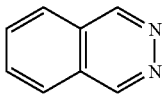
(22)
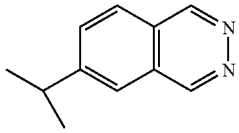
(23)
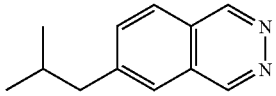
-continued
(24)
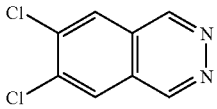
(25)
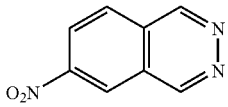
(26)
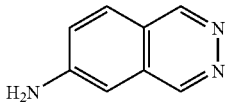
(27)
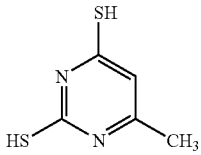
(28)
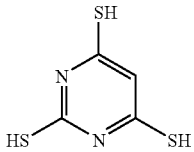
(29)
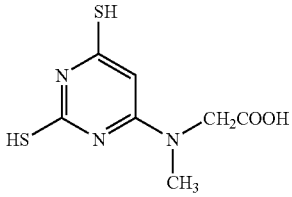
(30)
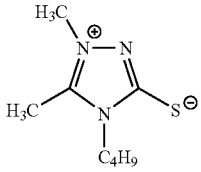
(31)
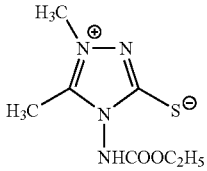
(32)
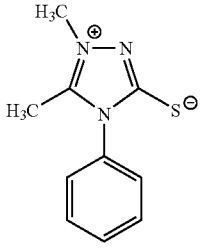

-continued (33)

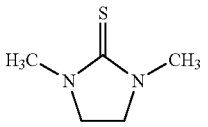

(34)

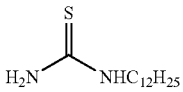

(35)

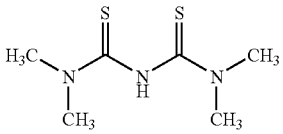

(36)

$HO(CH_2)_3S(CH_2)_2S(CH_2)_3OH$ (37)

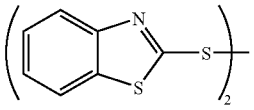

(38)

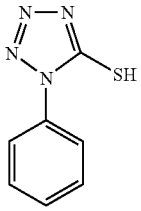

(39)

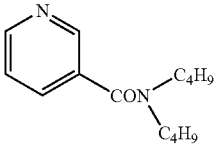

(40)

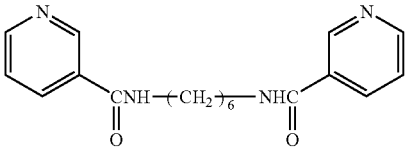

(41)

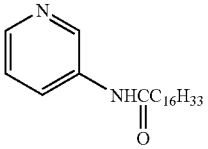

(42)

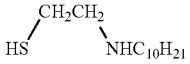

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

In the present invention, an absorption intensity of ultra violet-visible light absorption spectrum of photosensitive silver halide after thermal development preferably becomes 80% or less as compared with before thermal development, more preferably 40% or less and, particularly preferably 10% or less.

The silver iodide complex-forming agent according to the invention may be incorporated into a photothermographic material by being added into the coating solution, such as in the form of a solution, an emulsion dispersion, a solid fine particle dispersion, or the like.

Well known emulsion dispersing methods include a method comprising dissolving the silver iodide complex-forming agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion. In this case, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Depending on the dispersing conditions, the amount of Zr and the like generally incorporated in the dispersion is in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in the water dispersion.

The silver iodide complex-forming agent according to the invention is preferably used in the form of a solid dispersion.

The silver iodide complex-forming agent according to the invention is preferably used in the range from 1 mol % to 5000 mol %, more preferably, from 10 mol % to 1000 mol % and, further preferably, from 50 mol % to 300 mol %, with respect to the photosensitive silver halide in each case.

(Organic Silver Salt)

The organic silver salt used in the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such a non-photosensitive organic silver salt is disclosed, for example, in JP-A No. 10-62899 (paragraph Nos. 0048 to 0049), EP No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver behenate, silver arachidinate, silver stearate, silver oleate, silver laurate, silver capronate, silver myristate, silver palmitate and mixtures thereof. In the present invention, among the organic silver salts, it is preferred to use an organic silver salt with a silver behenate content of 50 mol % or more, and particularly preferably, 75 mol % to 98 mol %.

There is no particular restriction on the shape of the organic silver salt usable in the invention and it may be needle-like, bar-like, tabular, or flake shaped.

In the invention, a flake shaped organic silver salt is preferred. In the present specification, the flake shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a main plate with b and c being as the sides. a in average is preferably 0.01 μm to 0.3 μm and, more preferably, 0.1 μm to 0.23 μm c/b in average preferably 1 to 6, more preferably 1 to 4, further preferably 1 to 3 and, particularly preferably 1 to 2.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Methods known in the art may be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163827, 2001-163889, 2001-163890, 11-203413, 2001-188313, 2001-83652, 2002-6442, 2002-31870, and the like.

In the invention, the photothermographic material can be prepared by mixing an aqueous dispersion of an organic silver salt and an aqueous dispersion of a photosensitive silver salt. A method of mixing two or more kinds of aqueous dispersions of organic silver salts and two or more kinds of aqueous dispersions of photosensitive silver salts upon mixing are used preferably for controlling the photographic properties.

While an organic silver salt in the invention can be used in a desired amount, an amount of an organic silver salt is preferably in the range from 0.1 g/m$^2$ to 5 g/m$^2$, more preferably 1 g/m$^2$ to 3 g/m$^2$, and particulary preferably 1.2 g/m$^2$ to 2.5 g/m$^2$, with respect to the amount of silver.

(Development Accelerator)

In the photothermographic material of the invention, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (1) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. Further, phenolic compounds described in JP-A Nos. 2002-311533 and 2002-341484 are also preferable. Naphthalic compounds described in JP-A No. 2003-66558 are particularly preferable. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is more preferred to use hydrazine compounds described in the specification of JP-A Nos. 2002-156727 and 2002-278017, and naphtholic compounds described in the specification of WP-A No. 2003-66558.

Particularly preferred development accelerators of the invention are compounds represented by the following formulae (A-1) and (A-2).

$$Q_1\text{-NHNH-}Q_2 \qquad \text{Formula (A-1)}$$

(wherein, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by $Q_1$ is, preferably, 5 to 7-membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings, in which the rings described above are condensed to each other, are also preferred.

The rings described above may have substituents and in a case where they have two or more substituents, the substituents may be identical or different with each other. Examples of the substituents can include halogen atom, alkyl group, aryl group, carbonamide group, alkylsulfonamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfonamide group, arylsulfonamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N2-hexyldecyl)carbamoyl N-phenylcarbamoyl, N4-dodecyloxyphenyl) carbamoyl, N2-chloro-5-dodecyloxycarbonylphenyl) carbamoyl, N-naphthylcarbaoyl, N-3-pyridylcarbamoyl, and N-benzylcarbamoyl.

The acyl group represented by $Q_2$ is an acyl group having preferably 1 to 50 carbon atoms and, more preferably 6 to 40 carbon atoms and can include, for example, formyl, acetyl, 2-methylpropanoyl, cyclohexylcarbonyl, octanoyl 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group having preferably 2 to 50 carbon atoms, and more preferably, 6 to 40 carbon atoms and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group preferably having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group preferably having 0 to 50 carbon atoms, and more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy) propyl}sulfamoyl, N2-chloro-5-dodecyloxycarbonylphenyl)sulfamoyl, and N-(2-tetradecyloxyphenyl)sulfamoyl.

The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6-membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

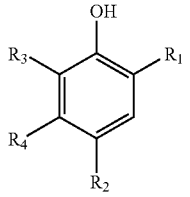

In formula (A-2), $R_1$ represents one selected from an alkyl group, an acyl group, an acylamino group, a sulfonamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), and a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). Among them, an acylamino group (including a ureido group or a urethane group) is more preferred. $R_2$ is preferably a halogen atom (more preferably, a chlorine atom, a bromine atom), an alkoxy group (for example, a methoxy group, a butoxy group, a n-hexyloxy group, a n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, alkyl group, or an acylamino group, and more preferably an alkyl group or an acylamino group. Examples of the preferred substituent thereof are similar to those for $R_1$. In a case where $R_4$ is an acylamino group, $R_4$ may preferably link with $R_3$ to form a carbostyryl ring.

In a case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, one of an alkoxy group and an aryloxy group and, particularly preferably an alkoxy group.

Preferred specific examples for the development accelerator of the invention are to be described below. The invention is not restricted to them.

A-1

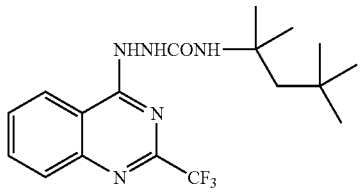

A-2

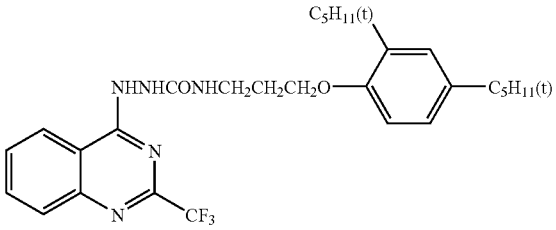

A-3

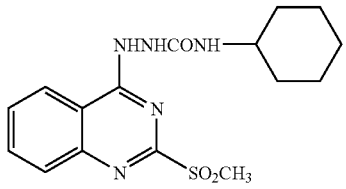

A-4

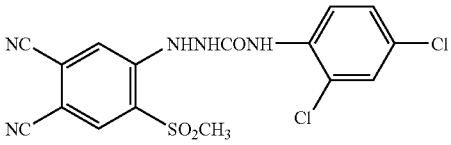

A-5

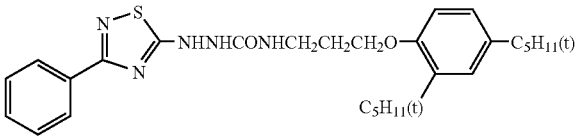

A-6

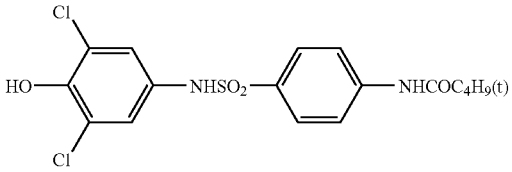

-continued

A-7

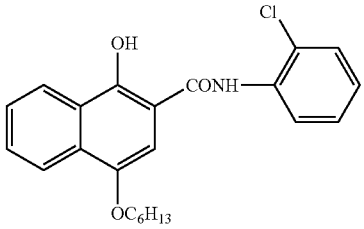

A-8

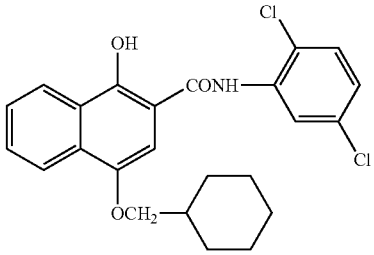

A-9

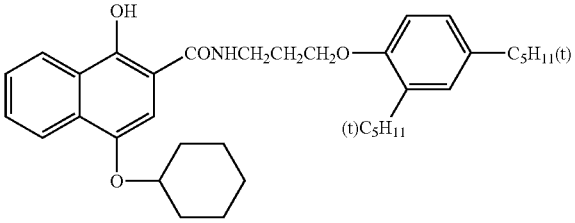

A-10

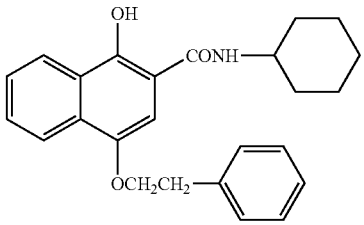

A-11

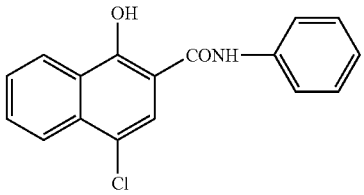

A-12

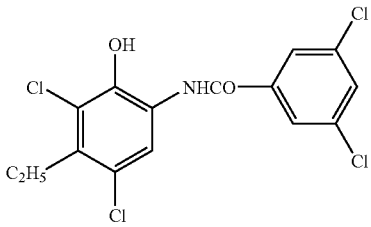

(Hydrogen Bonding Compound)

In the invention, in the case where the reducing agent has an aromatic hydroxy group (OH) or an amino group, it is preferred to use in combination, a non-reducing compound having a group capable of reacting with these groups of the reducing agent, and that is also capable of forming a hydrogen bond therewith.

As a group capable of forming a hydrogen bond, there can be mentioned a phosphoryl group, a sulfoxide group, a sulfonyl group, a carbonyl group, an amide group, an ester group, a urethane group, a ureido group, a tertiary amino group, a nitro-containing aromatic group, and the like. Preferred among them are a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

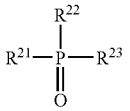

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-ethylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-hexylamino group, a dicyclohexylamino group, a diphenylamino group, an N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an aryl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

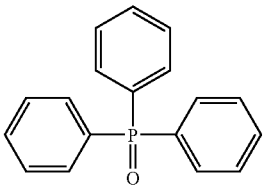

D-2

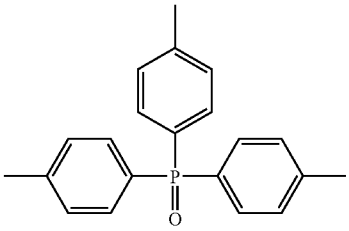

D-3

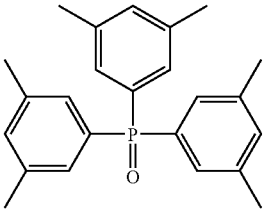

D-4

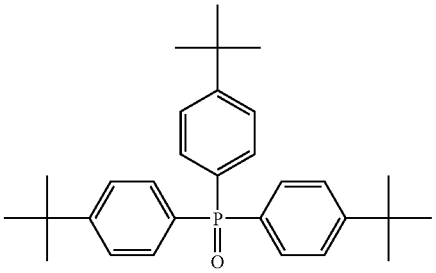

D-5

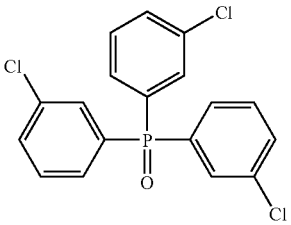

-continued

D-6

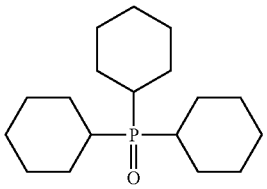

D-7

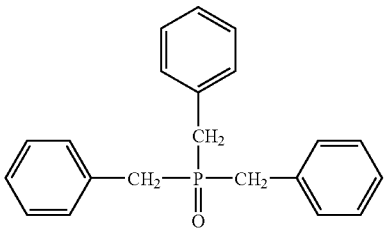

D-8

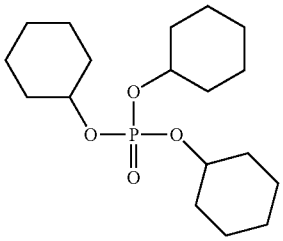

D-9

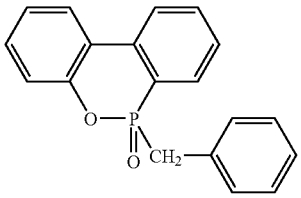

D-10

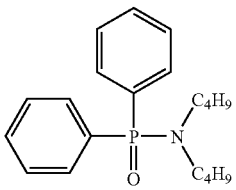

D-11

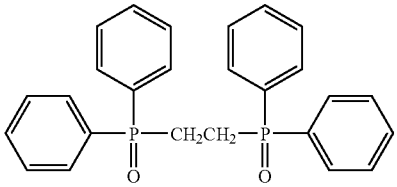

D-12

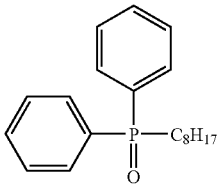

D-13

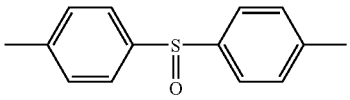

-continued

D-14

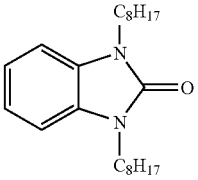

D-15

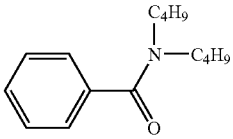

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into the coating solution in the form of solution, emulsion dispersion, or solid fine particle dispersion, similar to the case of the reducing agent. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill and the like.

The hydrogen bonding compound of the invention is preferably used in the range from 1 mol % to 200 mol %, more preferably from 10 mol % to 150 mol %, and further preferably, from 30 mol % to 100 mol %, with respect to the reducing agent.

(Binder)

Any kind of polymer may be used as the binder for the image forming layer of the invention. Suitable as the binder are those that are transparent or translucent, and that are generally colorless, such as natural resin or polymer and their copolymers; synthetic resin or polymer and their copolymer, or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) or poly(vinyl butyral)), polyester, polyurethane, phenoxy resin, poly(vinylidene chloride), polyepoxide, polycarbonate, poly(vinyl acetate), polyolefin, cellulose esters, and polyamide. A binder may be used with water, an organic solvent or emulsion to form a coating solution.

In the present invention, the glass transition temperature (Tg) of the binder of the image forming layer is in the range from 10° C. to 80° C., preferably from 20° C. to 70° C. and, more preferably from 23° C. to 65° C.

In the specification, Tg is calculated according to the following equation.

$$1/Tg=\Sigma(Xi/Tgi)$$

where the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n.

Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced.

Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent.

As water-admixing organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "equilibrium water content under 25° C. and 60% RH" as referred herein can be expressed as follows:

$$\text{Equilibrium water content under 25° C. and 60\% RH}=[(W1-W0)/W0]\times 100(\text{\% by weight})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in the range from 1 nm to 50,000 nm, and preferably from 5 nm to 1,000 nm. There is no particular limitation concerning particle size distribution of the dispersed particles, and they may be widely distributed or may exhibit a monodisperse particle size distribution.

In the invention, preferred embodiment of the polymers capable of being dispersed in aqueous solvent includes hydrophobic polymers such as acrylic polymers, poly(ester), rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer.

The molecular weight of these polymers is, in number average molecular weight, in the range from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27MAA(3)-(molecular weight 37000, Tg 61° C.)

P-2; Latex of MMA(70)-2EHA(20)-St(5)-AA(5)-(molecular weight 40000, Tg 59° C.)

P-3; Latex of -St(50)-Bu(47)MAA(3)-(crosslinking, Tg −17° C.)

P-4; Latex of -St(68)Bu(29)-AA(3)-(crosslinking, Tg 17° C.)

P-5; Latex of -St(71)Bu(26)-AA(3)-(crosslinking, Tg 24° C.)

P-6; Latex of-St(70)-Bu(27)-IA(3)-(crosslinking)

P-7; Latex of-St(75)-Bu(24)-AA(1)-(crosslinking, Tg 29° C.)

P-8; Latex of St(60)-Bu(35)-DVB(3) AA(2)-(crosslink g)

P-9; Latex of-St(70)-Bu(25)-DVB(2)-AA(3)-(crosslinking)

P-10; Latex of -VC(50) MA(20)A(20)AN(5)-AA(5)-(molecular weight 80000)

P-11; Latex of -VDC(85)MMA(5)FA(5)MAk(5)-(molecular weight 67000)

P-12; Latex of -Et(90)MAA(10)-(molecular weight 12000)

P-13; Latex of-St(70)-2EHA(27)AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)AA(3)-(crosslinking, Tg 20.5° C.).

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two or more kinds depending on needs.

Particularly preferable as the polymer latex for use in the invention is that of styrene-butadiene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Preferable range of molecular weight is similar to that described above.

As the latex of styrene-butadiene copolymer preferably used in the invention, there can be mentioned P-3 to P-8, P-14, and P-15, or commercially available LACSTAR 3307B, LACSTAR 7132C, Nipol Lx416, and the like.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, or the like.

These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is preferably in a range of from 1/10 to 10/1, and more preferably from 1/5 to 4/1.

The image forming layer is, in general, a photosensitive layer containing a photosensitive silver halide, i.e., the photosensitive silver salt; in such a case, the weight ratio for total binder to silver halide (total binder/silver halide) is in a range of from 400 to 5, more preferably, from 200 to 10.

The total amount of binder in the image forming layer of the invention is preferably in a range from 0.2 $g/m^2$ to 30 $g/m^2$, and more preferably from 1 $g/m^2$ to 15 $g/m^2$. As for the image forming layer of the invention, there may be added a crosslinking agent for crosslinking, or a surfactant and the like to improve coating properties.

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more.

Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

1) Organic Polyhalogen Compound

It is preferred that the photothermographic material of the invention contains a compound expressed by formula (H) below as an antifoggant.

$$Q\text{-}(Y)n\text{-}C(Z_1)(Z_2)X \qquad \text{Formula (H)}$$

In formula (H), Q represents one selected from an alkyl group, an aryl group, and a heterocyclic group; Y represents a divalent linking group; n represents 0 or 1; $Z_1$ and $Z_2$ each represent a halogen atom; and X represents a hydrogen atom or an electron-attracting group.

In the case where Q is an aryl group in formula (H), Q preferably is a phenyl group substituted by an electron-attracting group whose Hammett substituent constant op yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting groups are a halogen atom, a carbamoyl group and an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably one of a bromine atom and an iodine atom, and more preferably, a bromine atom.

Y preferably represents —C(=O)—, —SO—, —$SO_2$—, —C(=O)N(R)—, or —$SO_2$N(R)—, more preferably, —C(=O)—, —$SO_2$—, or —C(=O)N(R)—; and particularly preferably, —$SO_2$— or —C(=O)N(R)—. Herein, R represents a hydrogen atom, an aryl group, or an alkyl group, preferably a hydrogen atom or an alkyl group, and particularly preferably a hydrogen atom.

n represents 0 or 1, and preferably represents 1.

Specific examples of the compound expressed by formula (H) of the invention are shown below.

H-1

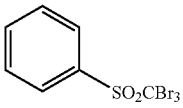

H-2

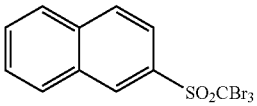

H-3

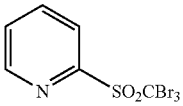

H-4

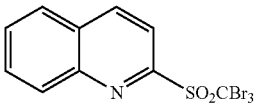

H-5

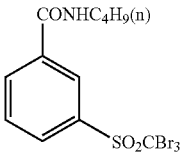

H-6

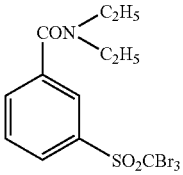

H-7

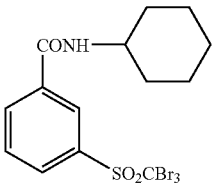

H-8

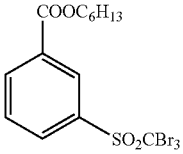

H-9

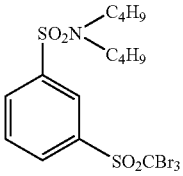

-continued

H-10

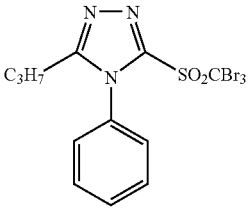

H-11

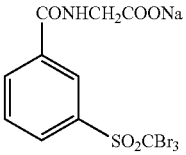

H-12

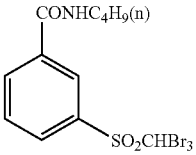

H-13

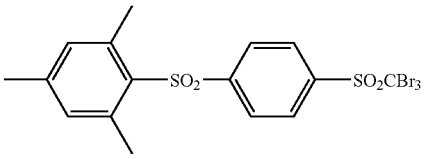

H-14

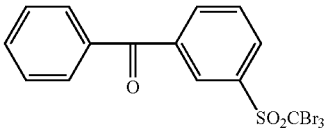

H-15

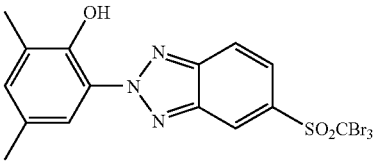

H-16

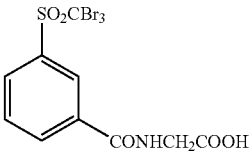

H-17

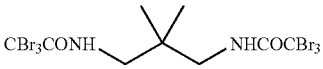

H-18

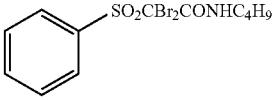

H-19

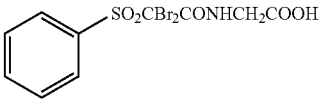

The compounds expressed by formula (H) of the invention are preferably used in an amount of from $10^{-4}$ mol to 0.8 mol, more preferably, $10^{-3}$ mol to 0.1 mol, and further preferably, $5\times10^{-3}$ mol to 0.05 mol, per 1 mol of non-photosensitive silver salt incorporated in the image forming layer.

Particularly, when the silver halide having a high silver iodide content of the invention is used, it is most preferred to use the antifoggant in a range of $5\times10^{-3}$ mol to 0.03 mol to obtain a sufficient antifogging effect.

In the invention, usable methods for incorporating the antifoggant into the photothermographic material are those described above in the method for incorporating the reducing agent.

The melting point of the compound represented by formula (H) is preferably 200° C. or lower, and more preferably 170° C. or lower.

As other organic polyhalogen compounds usable in the invention, there can be mentioned the compounds described in paragraph number 0111 to 0112 of JP-A No. 11-65021. Particularly, organic halogen compounds represented by formula (P) described in JP-A No. 2000-284399, organic polyhalogen compounds represented by formula (II) described in JP-A No. 10-339934, and organic polyhalogen compounds described in JP-A No. 2001-033911 are preferable.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

As an antifoggant, stabilizer and stabilizer precursor usable in the invention, there can be mentioned those disclosed in paragraph number 0070 of JP-A No. 10-62899 and in line 57 of page 20 to line 7 of page 21 of EP No. 0803764A1, the compounds described in WP-A Nos. 9-281637 and 9-329864.

The photothermographic material of the invention may further contain an azolium salt in order to prevent fogging. Azolium salts useful in the present invention include a compound expressed by formula (XI) described in JP-A No. 59-193447, a compound described in JP No. 55-12581, and a compound expressed by formula (II) in 1P-A No. 60-153039. The azolium salt may be added to any part of the photothermographic material, but as an additional layer, it is preferred to select a layer on the side having thereon the image forming layer, and more preferred is to select the image forming layer itself.

The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like.

In the invention, the azolium salt may be added at any amount, but preferably, it is added in a range from $1\times10^{-6}$ mol to 2 mol, and more preferably, from $1\times10^{-3}$ mol to 0.5 mol per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by formula (1) of JP-A No. 10-186572 and specific examples thereof shown in paragraph Nos. 0033 to 0052, in lines 36 to 56 in page 20 of EP No. 0803764A1, in JP-A No. 2001-100358 and the like. Among them, mercapto-substituted heterocyclic aromatic compound is preferred.

2) Toner

In the photothermographic material of the present invention, the addition of a toner is preferred. The description of the toner can be found in JP-A No.10-62899 (paragraph Nos. 0054 to 0055), EP No.0803764A1 (page 21, lines 23 to 48), JP-A Nos.2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3 dihydro-1,4-phtalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalatine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly with regard to a combination with silver halide having a high silver iodide content, preferred is a combination of phthalazines and phthatic acids.

The addition amount of phthalazines is preferably from 0.01 mol to 0.3 mol per 1 mol of organic silver salt, more preferably from 0.02 mol to 0.2 mol, and particularly preferably from 0.02 mol to 0.1 mol. The addition amount of the compound is a very important factor for accelerating the development of the silver halide emulsion having high silver iodide content used for the present invention. The adequate selection of the addition amount may be capable of providing sufficient development performance while depressing fog.

3) Plasticizer and Lubricant

Plasticizers and lubricants usable in the image forming layer of the invention are described in paragraph No.0117 of JP-A No. 11-65021. Lubricants are described in paragraph Nos. 0061 to 0064 of JP-A No.11-84573.

4) Dyes and Pigments

From the viewpoint of improving image tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Phosphoric Acid Compound

The photothermographic material of the present invention preferably contains a phosphoric acid compound selected from a phosphoric acid, a salt thereof (phosphate), and an ester thereof (phosphate ester).

"Phosphoric acid" is a general name of an acid formed by hydration of diphosphorus pentaoxide. Examples include trimetaphosphoric acid, tetrametaphosphoric acid, hexametaphosphoric acid, orthophosphoric acid, pyrophosphoric acid, triphosphoric acid, tetraphosphoric acid, and the like. These acids can be made from diphosphorus pentoxide as the raw material. But these acids also can be made by oxidizing red phosphorus with concentrated nitric acid. For the industrial preparation, phosphorite is used as the raw material. The raw material is not limited to the diphosphorus pentoxide. As the structure, any acids formed by hydration of diphoshorus pentaoxide may be applied.

The phosphate is a salt of the acid formed by hydration of diphosphorus pentaoxide and has a counter ion selected from an alkali metal ion, an alkaline earth metal ions, a metal ion belong to the groups IIIa to VIIa, VIII, Ib to IIIb in the periodic table, and an ammonium ion. Hydrogen phosphates are also included. Specific examples of the phosphates and hydrogen phosphates include, but are not limited to, $Na_3PO_4$, $Na_2HPO_4$, $NaH_2PO_4$, $K_3PO_4$, $Al(H_2PO_4)_3$, $Zn(H_2PO_4)_2$, $Ag_3PO_4$, $Ca_3(PO_4)_2$, $(NH_4)_3PO_4$, $AlPO_4$, $Zn_3(PO_4)_2$, $Na_3(P_3O_9)$, $Na_4(P_4O_{12})$ and the like, but the invention is not limited in these.

The phosphate ester is an ester of phosphoric acid and alcohol, and expressed by the following formula (PE).

Formula (PE)

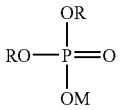

Wherein, R represents one selected from a hydrogen atom, an alkali metal, an ammonium group, an alkyl group, an aryl group, and a heterocyclic group, and at least one of R represents an alkyl group, an aryl group, or a heterocyclic group. The alkyl group, the aryl group, and the heterocyclic group may be further substituted. M represents one selected from a hydrogen atom, an alkali metal, and an ammonium group.

Specific examples of the compounds represented by formula (PE) are shown below, but the invention is not limited to these examples.

PE-1

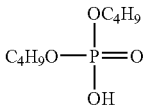

PE-2

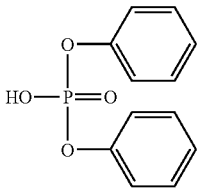

PE-3

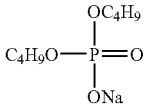

PE-4

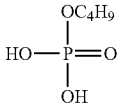

-continued

PE-5

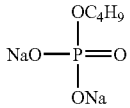

PE-6

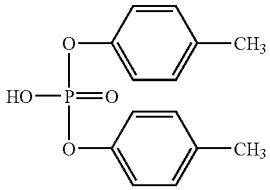

PE-7

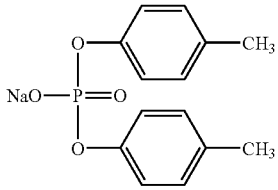

PE-8

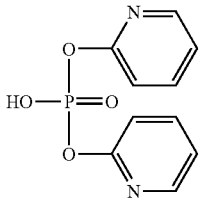

The phosphoric acid compound preferred for the present invention is the phosphoric acid and the phosphate described above. More preferable are orthophosphoric acid, hexametaphosphoric acid, and the salts of these acids. Particularly preferred examples include orthophosphoric acid, sodium dihydrogen orthophosphate, disodium hydrogen orthophosphate, hexametaphosphoric acid, sodium hexametaphosphate, ammonium hexametaphosphate, potassium dihydrogen orthophosphate, dipotassium hydrogen orthophosphate, and potassium hexametaphosphate.

The phosphoric acid compound in the practice of the present invention is added to the image forming layer or to a layer adjacent to the image forming layer in order to attain the desired effects using a small amount.

The addition amount of the phosphoric acid compound of the invention (i.e., the coating amount per 1 $m^2$ of the photothermographic material) may be set as desired depending on sensitivity and fog, but preferred is in an amount of 0.1 $mg/m^2$ to 500 $mg/m^2$, and more preferably, 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Other Constituting Components)

The photothermographic material according to the invention can have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention may comprise a surface protective layer with an object to prevent adhesion of the image forming layer. The surface protective layer may be a single layer, or plural layers. Description on the surface protective layer may be found in paragraph Nos. 0119 to 0120 of JP-A No. 1165021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Lid.).

The coating amount of polyvinyl alcohol (per 1 $m^2$ of support) in the protective layer (per one layer) is preferably in the range from 0.3 $g/m^2$ to 4.0 $g/m^2$, and more preferably, from 0.3 $g/m^2$ to 2.0 $g/m^2$.

The coating amount of total binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

2) Antihalation Layer

The photothermographic material of the present invention can comprise an antihalation layer provided to the side farther from the light source with respect to the image forming layer. Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially remain after image formation, and is preferred to employ a means for decoloring by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the bleaching dye is determined depending on the usage of the dye. In general, it is used at an amount as such that the optical density (absorbance) exceeds 0.1 when measured at the desired wavelength. The optical density is preferably in the range from 0.2 to 2. The addition amount of dyes to obtain optical density in the above range is generally from about 0.001 $g/m^2$ to 1 $g/m^2$.

By decoloring the dye in such a manner, the optical density after thermal development can be lowered to 0.1 or lower. Two or more kinds of bleaching dyes may be used in combination in a photothermographic material. Similarly, two or more kinds of base precursors may be used in combination.

In the case of thermal decolorization by the combined use of a bleaching dye and a base precursor, it is advantageous from the viewpoint of thermal decolorization efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

3) Matting Agent

A matting agent may be preferably added to the surface protective layer and to the back layer in order to improve transportability. Description of the matting agent can be found in paragraphs Nos. 0126 to 0127 of JP-A No.11-65021.

The addition amount of the matting agent is preferably in the range from 1 $mg/m^2$ to 400 $mg/m^2$, and more preferably, from 5 $mg/m^2$ to 300 $mg/m^2$, with respect to the coating amount per 1 $m^2$ of the photothermographic material.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, by using Japan Industrial Standard (JIS) P8119 "The method of testing Beck's smoothness for papers and sheets using Beck's test apparatus", or TAPPI standard method T479.

The matting degree of the back layer in the invention is preferably in a range of 1200 seconds or less and 10 seconds or more; more preferably, 800 seconds or less and 20 seconds or more; most preferably, 500 seconds or less and 40 seconds or more, when expressed by Beck smoothness.

In the present invention, a matting agent is preferably contained in an outermost layer, in a layer which can function as an outermost layer, or in a layer nearer to outer surface, and also preferably is contained in a layer which can function as a so-called protective layer.

4) Polymer Latex

A polymer latex can be incorporated in the surface protective layer and the back layer of the present invention.

As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate(33.5% by weight)/ethyl acrylate(50% by weight)/methacrylic acid (16.5% by weight) copolymer, a latex of methyl methacrylate(47.5% by weight)/butadiene(47.5% by weight)Aitaconic acid(5% by weight) copolymer, a latex of ethyl acrylate/methacrylic acid copolymer, a latex of methyl methacrylate(58.9% by weight)/2-ethylhexyl acrylate(25.4% by weight)/styrene (8.6% by weight)/2-hydroethyl methacrylate(5.1% by weight)/acrylic acid(2.0% by weight) copolymer, a latex of methyl methacrylate(64.0% by weight)/styrene(9.0% by weight)/butyl acrylate(20.0% by weight)/2-hydroxyethyl methacrylate(5.0% by weight)/acrylic acid(2.0% by weight) copolymer, and the like.

The polymer latex is preferably contained in an amount of 10% by weight to 90% by weight, particularly preferably, of 20% by weight to 80% by weight of the total weight of binder (including water-soluble polymer and polymer latex) in the surface protective layer or the back layer.

5) Surface pH

The surface pH of the photothermographic material according to the invention preferably yields a pH of 7.0 or lower, more preferably, 6.6 or lower, before thermal developing process. Although there is no particular restriction concerning the lower limit, the lower limit of pH value is about 3, and the most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No.0123 of the specification of JP-A No.2000-284399.

6) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "EKFMAI KONGO GUUTSU (Liquid Mixing Technology)" (NiMkan Kogyo Shinbunsha, 1989), and the like.

7) Surfactant

As the surfactant applicable in the invention, there can be used those disclosed in paragraph No. 0132 of JP-A No. 11-65021.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably. In the invention, the fluorocarbon surfactants described in JP-A No. 2000-206560 are particularly preferably used.

8) Antistatic Agent

The photothermographic material of the invention may contain an electrically conductive layer including various kinds of metal oxides or electrically conductive polymers known to the public. The antistatic layer may serve as an undercoat layer described above, or a back surface protective layer, and the like, but can also be placed specially. As to the antistatic layer, technologies described in paragraph No. 0135 of JP-A No. 11-65021, JP-A Nos. 56-143430, 56-143431,58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898 can be applied.

9) Support

As the transparent support, preferably used is polyester, particularly, polyethylene terephthalate, which is subjected to heat treatment in the temperature range from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet light emission screen, PEN is preferably used, but the present invention is not limited thereto. As the PEN, polyethylene-2,6-naphthalate is preferred. The "polyethylene-2,6-naphthalate" herein means that the structure repeating units essentially may consist of ethylene-2,6-naphthalene dicarboxylate units and also may include un-copolymerized polyethylene-2,6-naphthalene dicarboxylate, and the copolymer comprising 10% or less, and preferably 5% or less, of the structure repeating units modified with the other components and mixtures or constituents of other polymers.

Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at a proper reaction condition. The polyethylene-2,6-naphthalate of the present invention may be copolymerezed or blended polysters, where one or more kinds of suitable third component (denaturing agent) is added before the completion of polymerization of the polyethylene-2,6-naphthalate. As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid, and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol, and the like are described. Polyethylene-2,6-naphthalate and the modified polymers thereof may include, for example, the polymer where the terminal hydroxy group and/or the carboxyl group is blocked by mono-functional compounds such as benzoic acid, benzoyl benzoic acid, benzyloxy benzoic acid, methoxy polyalkylene glycol, or the like, or the polymer modified with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-1 described in Examples of JP-A No. 8-240877), or may be uncolored.

Exemplified embodiments of the support are described in paragraph No. 0134 of JP-A No. 11-65021.

As to the support, it is preferred to apply undercoating technology, such as water-soluble polyester described in JP-A No. 11-84574, a styrenebutadiene copolymer described in JP-A No. 10-186565, a vinylidene chloride copolymer described in JP-A No. 2000-39684.

10) Other Additives

Furthermore, antioxidant, stabilizing agent, plasticizer, UV absorbent, or a film-forming promoting agent may be added to the photothermographic material. A solvent described in paragraph No. 0133 of JP-A No. 11-65021 may be added. Each of the additives is added to either of the image forming layer (photosensitive layer) or the non-photosensitive layer. Reference can be made to WO No. 98/36322, EP No. 803764A1, JP-A Nos. 10-186567 and 10-18568, and the like.

11) Coating Method

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the image forming layer in the invention is preferably a so-called thixotropic fluid. For the details of this technology, reference can be made to JP-A No. 11-52509.

Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa·s, and more preferably, from 5 mPa·s to 80 mPa·s.

12) Means for Discriminating Between the Back and Front

When the photothermographic material of the present invention is processed, it is required to discriminate between the front side having a front-side image forming layer and the backside having a back-side image forming layer.

Any kinds of the means for discriminating between the back and front of the material used for the conventional wet processed photosensitive material can be applied for the photothermographic material described above.

For example, the following means are known in the art.

(1) Providing a notch on the edge portion of the sheet, (2) providing provide an embossed pattern on the edge portion of the sheet, and (3) providing a mark by some marker.

14) Wrapping Material

In order to suppress fluctuation from occurring on the photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and further preferably, 1.0 $mL \cdot atm^{-1}m^{2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and further preferably, 1 $g \cdot atm^{-1}m^{-2}day^{-1}$ or lower. As specific examples of a wrapping material having low oxygen transmittance and/or vapor transmittance, reference can be made to, for instance, the wrapping material described in JP-A Nos.8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766,09-281637, 09-297367, 09-304869,09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

2. Image Forming Method 2-1. Exposure

The photothermographic material of the present invention is a "double-sided type" having image forming layers on both sides of the support.

(Double-Sided Type Photothermographic Material)

The photothermographic material of the present invention is preferably applied for an image forming method to record radiation images using a fluorescent intensifying screen.

For the image forming method, the photothermographic material can be preferably employed as described below: where the photothermographic material is exposed with a monochromatic light having the same wavelength as the main emission peak wavelength of the fluorescent intensifying screen and having a half band width of 15±5 nm, and after a thermal developing process, an exposure value required for a density of fog+0.5 for an image obtained by removing the image forming layer that is disposed on the opposite side of an exposure face is 0.005 Lux·sec to 0.07 Lux·sec.

The image forming method using the photothermographic materials described above comprises the steps of:

(a) providing an assembly for forming an image by placing the photothermographic material between a pair of fluorescent intensifying screens, (b) putting an analyte between the assembly and an X-ray source, (c) applying imagewise exposure to the analyte using X-rays having an energy level in a range of 25 kVp to 125 kVp, (d) taking the photothermographic material out of the assembly, and (e) heating the thus taken out photothermographic material in a temperature range of 90° C. to 180° C.

The photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+(optical density of 0.1) and a density of fog+(optical density of 0.5) is from 0.5 to 0.9, and the average gamma (γ) made at the points of a density of fog+(optical density of 1.2) and a density of fog+(optical density of 1.6) is from 3.2 to 4.0. For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photogaraphic property, the photographic properties mentioned have the advantage of that the depiction in low density portion on the mediastinal region and the heart shadow region having little X-ray transmittance becomes excellent, and that the density becomes easy to view, and that the contrast in the images on the lung field region having much X-ay transmittance becomes excellent.

The photothermographic material having the preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high contrast for the lower layer. In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in the range from 1:20 to 1:50 based on silver amount.

The techniques such as an emulsion sensitizing method, kinds of additives and constituents employed in the production of the photothermographic material of the present invention are not particularly limited. For example, various kinds of techniques described in JP-A Nos. 2-68539,2-103037 and 2-115837 can be applied.

As the techniques for crossover cut, dyes or combined use of dye and mordant described in JP-A No. 2-68539, (from page 13, left lower column, line 1 to page 14, left lower column, line 9) can be employed.

Next the fluorescent intensifying screen employed in the practice of the present invention is explained below. The radiographic intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate fluorescent substances ($CaWO_4$, $MgWO_4$, $CaWO_4$:Pb, and the like), terbium activated rare earth sulfoxide fluorescent substances ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium activated rare earth phosphate fluorescent substances ($YPO_4$:Tb, $GdPO_4$:Tb, LPO4:Tb, and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb, and the like), thulium activated rare earth oxyhalogen fluorescent substances (LaOBr:Tm, LaOCl:Tm, and the like), barium sulfate fluorescent substances ($BaSO_4$:Pb, $BaSO_4$:$Eu^{2+}$, (Ba, Sr)$SO_4$:$Eu^{2+}$, and the like), divalent europium activated alkali earth metal phosphate fluorescent substances ($(Ba_2PO_4)_2$:$Eu^{2+}$, $(Ba_2PO_4)_2$:$Eu^{2+}$, and the like), divalent europium activated alkali earth metal fluorinated halogenide fluorescent substances (BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, (Ba,Mg)$F_2$.BaCl.KCl:$Eu^{2+}$, and the like), iodide fluorescent substances (CsI:Na, CsI:Tl, NaI, KI:Tl, and the like), sulfide fluorescent substances (ZnS:Ag(Zn,Cd)S:Ag, (Zn,Cd)S:Cu, (Zn,Cd)S:Cu, Al, and the like), hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

The fluorescent intensifying screen which is more preferred for the present invention is a screen where 50% or more of the emission light has a wavelength region from 350 nm to 420 nm. Especially, as the fluorescent substance, a divalent europium activated fluorescent substance is preferred, and a divalent europium activated barium halide fluorescent substance is more preferred. The emission wavelength region is preferably from 360 nm to 420 nm, and more preferably from 370 nm to 420 nm. Moreover, the preferred fluorescent screen can emit 70% or more of the above region, and more preferably 85% or more thereof.

The ratio of the emission light can be calculated from the following method; the emission spectrum is measured where an antilogarithm of the emission wavelength is plotted on the abscissa axis at equal interval and a number of the emitted photon is plotted on the ordinate. The ratio of the emission light in the wavelength region from 350 nm to 420 nm is defined as a value dividing the area from 350 nm to 420 nm on the chart by the entire area of the emission spectrum. The photothermographic materials of the present invention used in combination with the fluorescent substance emitting the above wavelength region can attain high sensitivity.

In order that most of the emission light of the fluorescent substance may exist in the above wavelength region, the narrower half band width is preferred. The preferred half band width is from 1 nm to 70 nm, more preferably from 5 nm to 50 nm, and still more preferably from 10 nm to 40 nm.

So long as the fluorescent substance has the above emission, the fluorescent substance used in the present invention is not particularly limited, but the europium activated fluorescent substance where the divalent europium is an emission center is preferred to attain high sensitivity as the purpose of the invention.

Specific examples of these fluorescent substances are described below, but the scope of the present invention is not limited to the examples.

BaFCl:Eu, BaFBr:Eu, BaFI:Eu, and the fluorescent substances where their halogen composition is changed; $BaSO_4$:Eu, SrFBr:Eu, SrFCl:Eu, SrFI:Eu, $(Sr,Ba)Al_2Si_2O_8$:Eu, $SrB_4O_7F$:Eu, $SrMgP_2O_7$:Eu, $Sr_3(PO_4)_2$:Eu, $Sr_2P_2O_7$:Eu, and the like.

More preferred fluorescent substance is a divalent europium activated barium halide fluorescent substance expressed by the following formula:

$$MX_1X_2:Eu$$

wherein, M represents Ba as a main component, but a small amount of Mg, Ca, Sr, or other compounds may be included. $X_1$ and $X_2$ each represent a halogen atom, and can be selected from F, Cl, Br and I. Herein, $X_1$ is more preferably a fluorine atom. $X_2$ can be selected from Cl, Br, and I and the mixture with other halogen composition may be used preferably. More preferably X=Br. Eu represents an europium atom. Eu as an emission center is preferably contained at a ratio from $10^{-7}$ to 0.1, based on Ba, more preferably from $10^{-4}$ to 0.05. Preferably the mixture with a small quantity of other compounds can be included. As most preferred fluorescent substance, BaFCl:Eu, BaFBr:Eu and $BaFBr_{1-x}I_x$:Eu can be described.

<Fluorescent Intensifying Screen>

The fluorescent intensifying screen preferably consists of a support, an undercoat layer on the support, a fluorescent substance layer, and a surface protective layer.

The fluorescent substance layer is prepared as follows. A dispersion solution is prepared by dispersing the fluorescent substance particles described above in an organic solvent solution containing binder resins. The thus-prepared solution is coated directly on the support (or on the undercoat layer such as a light reflective layer provided beforehand on the support) and dried to form the fluorescent substance layer. Besides the above method, the fluorescent substance layer may be formed by the steps of coating the above dispersion solution on the temporary support, drying the coated dispersion to form a fluorescent substance layer sheet, peeling off the sheet from the temporary support, and fixing the sheet onto a permanent support by means of an adhesive agent.

The particle size of the fluorescent substance particles used in the present invention is not particularly restricted, but is usually in a range of from about 1 μm to 15 μm, and preferably from about 2 μm to 10 μm. The higher volume filling factor of the fluorescent substance particles in the fluorescent substance layer is preferred, usually in the range of from 60% to 85%, preferably from 65% to 80%, and particularly preferably from 68% to 75%. (The ratio of the fluorescent substance particles in the fluorescent substance layer is usually 80% by weight or more, preferably 90% by weight or more, and particularly preferably 95% by weight or more). Various kinds of known documents have described the binder resins, organic solvents, and the various additives used for forming the fluorescent substance layer. The thickness of the fluorescent substance layer may be set arbitrary according to the target sensitivity, but is preferably in a range of from 70 μm to 150 μm for the front side screen, and in a range of from 80 μm to 400 μm for the backside screen. The X-ray absorption efficiency of the fluorescent substance layer depends on the coating amount of the fluorescent substance particles in the fluorescent substance layer.

The fluorescent substance layer may consist of one layer, or may consist of two or more layers. It preferably consists of one to three layers, and more preferably, one or two layers. For example, the layer may be prepared by coating a plurality of layers comprising the fluorescent substance particles with different particle size having a comparatively narrow particle size distribution. In that case, the particle size of the fluorescent substance particles contained in each layer may gradually decrease from the top layer to the bottom layer provided next to the support. Especially, the fluorescent substance particles having a large particle size is preferably coated at the side of the surface protective layer and fluorescent substance particles having a small particle size is preferably coated at the side of the support. Hereto, the small particle size of fluorescent substance is preferably in the range from 0.5 μm to 2.0 μm and the large size is preferably in the range from 10 μm to 30 μm. The fluorescent substance layer may be formed by mixing the fluorescent substance particles with different particle sizes, or the fluorescent substances may be packed in a particle size graded structure as described in JP-A No. 55-33560 (page 3, line 3 on the left column to page 4, line 39 on the left column). Usually, a variation coefficient of a particle size distribution of the fluorescent substance is in a range of from 30% to 50%, but a monodispersed fluorescent substance particles with a variation coefficient of 30% or less can also be preferably used.

Attempts to attain a desired sharpness by dying the fluorescent substance layer with respect to the emission light wavelength are practiced. However, the layer with least dying is preferably required. The absorption length of the fluorescent substance layer is preferably 100 μm or more, and more preferably 1000 μm or more.

The scattering length of the fluorescent substance layer is preferably designed to be from 0.1 μm to 100 μm, and more preferably from 1 μm to 100 μm. The scattering length and the absorption length can be calculated from the equation based on the theory of Kubelka-Munk mentioned below.

As for the support, any support can be selected from various kinds of supports used in the well-known radiographic intensifying screen depending on the purpose. For example, a polymer film containing white pigments such as titanium dioxide or the like, and a polymer film containing black pigments such as carbon black or the like may be preferably used. An undercoat layer such as a light reflective layer containing a light reflective agent may be preferably coated on the surface of the support (the surface of the fluorescent substance layer side). The light reflective layer as described in JP-A No. 2001-124898 may be preferably used. Especially, the light reflective layer containing yttrium oxide described in Example 1 of the above patent or the light reflective layer described in Example 4 thereof is preferred. As for the preferred light reflective layer, the description in JP-A No. 23001-124898 (paragraph 3, 15 line on the right side to paragraph 4, line 23 on the right side) can be referred.

A surface protective layer is preferably coated on the surface of the fluorescent substance layer. The light scattering length measured at the main emission wavelength of the fluorescent substance is preferably in a range of from 5 μm to 80 μm, and more preferably from 10 μm to 70 μm, and particularly preferably from 10 μm to 60 μm. The light scattering length indicates a mean distance in which a light travels straight until it is scattered. Therefore a short scattering length means that the light scattering efficiency is high. On the other hand, the light absorption length, which indicates a mean free distance until a light is absorbed, is optional. From the viewpoint of the screen sensitivity, no absorption by the surface protective layer favors preventing the desensitization. In order to compensate the scattering loss, a very slightly absorption may be allowable. A preferred absorption length is 800 μm or more, and more preferably 1200 μm or more. The light scattering length and the light absorption length can be calculated from the equation based on the theory of Kubelka-Munk using the measured data obtained by the following method.

Three or more film samples comprising the same component composition as the surface protective layer of the aimed sample but a different thickness from each other are prepared, and then the thickness (μm) and the diffuse transmittance (%) of each of the samples is measured. The diffuse transmittance can be measured by means of a conventional spectrophotometer equipped with an integrating sphere. For the measurement of the present invention, an automatic recording spectrophotometer (type U-3210, manufactured by Hitachi Ltd.) equipped with an integrating sphere of 150ϕ (150-0901) is used. The measuring wavelength must correspond to the wavelength of the main emission peak of the fluorescent substance in the fluorescent substance layer having the surface protective layer. Thereafter, the film thickness (μm) and the diffuse transmittance (%) obtained in the above measurement is introduced to the following equation (A) derived from the theoretical equation of Kubelka-Munk. For example, the equation (A) can be derived easily, under the boundary condition of the diffuse transmittance (%), from the equations 5·1·12 to 5·1·15 on page 403 described in "Keikotai Hando Bukku" (the Handbook of Fluorescent Substance) (edited by Keikotai Gakkai, published by Ohmsha Ltd. 1987).

$$T/100=4\beta/[(1+\beta)^2\cdot\exp(\alpha d)-(1-\beta)^2\cdot\exp(-\alpha d)] \quad \text{Equation (A)}$$

wherein, T represents a diffuse transmittance (%), d represents a film thickness (μm) and, α and β are defined by the following equation respectively.

$$\alpha=[K\cdot(K+2S)]^{1/2}$$

$$\beta=[K/(K+2S)]^{1/2}$$

T (diffuse transmittance: %) and d (film thickness: μm) measured from three or more film samples are introduced respectively to the equation (A), and thereby the value of K and S are determined to satisfy the equation (A). The scattering length (μm) and the absorption length (μm) are defined by 1/S and 1/K respectively.

The surface protective layer may preferably comprise light scattering particles dispersed in a resin material. The light refractive index of the light scattering particles is usually 1.6 or more, and more preferably 1.9 or more. The particle size of the light scattering particles is in a range of from 0.1 μm to 1.0 μm. Examples of the light scattering particles may include the fine particles of aluminum oxide, magnesium oxide, zinc oxide, zinc sulfide, titanium oxide, niobium oxide, barium sulfate, lead carbonate, silicon oxide, polymethyl methacrylate, styrene, and melamine.

The resin materials used to form the surface protective layer are not particularly limited, but poly(ethylene terephthalate), poly(ethylene naphthalate), polyamide, aramid, fluororesin, polyesters, or the like are preferably used. The surface protective layer can be formed by the step of dispersing the light scattering particles set forth above in an organic solvent solution containing the resin material (binder resin) to prepare a dispersion solution, coating the dispersion solution on the fluorescent substance layer directly (or via an optionally provided auxiliary layer), and then drying the coated solution. By other way, the surface protective sheets prepared separately can be overlaid on the fluorescent substance layer by means of an adhesive agent. The thickness of the surface protective layer is usually in a range of from 2 μm to 12 μm, and more preferably from 3.5 μm to 10 μm.

In addition, in respect with the preferred producting methods and the materials used for the process of the radiographic intensifying screen, references can be made to various publications, for example, JP-A No. 9-21899 (page 6, line 47 on left column to page 8, line 5 on left column), JP-A No.6-347598 (page 2, line 17 on right column). to page 3, line 33 on left column) and (page 3, line 42 on left column to page 4, line 22 on left column).

In the fluorescent intensifying sheets used for the present invention, the fluorescent substance is preferably packed in a particle size graded structure. Especially, the fluorescent substance particles having a large particle size are preferably coated at the side of the surface protective layer and fluorescent substance particles having a small particle size are preferably coated at the side of the support. The small particle size of fluorescent substance is preferably in the range from 0.5 μm to 2.0 μm, and the large size is preferably in the range from 10 μm to 30 μm.

(Combined Use with Ultraviolet Fluorescent Intensifying Screen)

As for the image forming method using a photothermographic material according to the present invention, it is preferred that the image forming method is performed in combination with a fluorescent substance having a main emission peak at 400 nm or lower. More preferably, the image forming method is performed in combination with a fluorescent substance having a main emission peak at 380 nm or lower. As the screen having a main emission peak at 400 nm or lower, the screens described in JP-A No.6-11804 and WO No.93/01521 are used, but the present invention is not limited to these. As the techniques of crossover cut of ultraviolet light, the technique described in JP-A No. 8-76307 can be applied. As a ultraviolet absorbing dye, the dye described in JP-A No. 2001-144030 is particularly preferable.

2-2. Thermal Development

Although any method may be used for the development of the photothermographic material of the invention, the thermal developing process is usually performed by elevating the temperature of the photothermographic material exposed imagewise. The temperature for the development is preferably in the range from 80° C. to 250° C., more preferably, from 100° C. to 140° C., and further preferably 110° C. to 130° C. Time period for development is usually in the range from 1 second to 60 seconds, but for the image forming method of the present invention, a rapid development where time period for development is 15 seconds or less is preferable, and more preferable is from 7 seconds to 15 seconds.

In the process for thermal development, either a drum type heater or a plate type heater can be used, but a plate type heater process is preferred. A preferable process for thermal development by a plate type heater is a process described in JP-A NO. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO.54-30032, which allows for passage of moisture and organic solvents included in the photothermographic material out of the system, and also allows for suppressing the change of shapes of the support of the photothermographic material upon rapid heating of the photothermographic material.

It is preferred that the heater is more stably controlled, and a top part of one sheet of the photothermographic material is exposed and thermal development of the exposed part is started before exposure of the end part of the sheet has completed, for downsizing the thermal developing apparatus and for reducing the time period for thermal development. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, there exist various problems described above, so it is particularly preferred to use the photothermographic materials of the invention in combination with the process.

Preferred embodiments of a thermal developing method and a thermal developing apparatus used for the present invention are explained hereinafter in detail with reference to the attached drawings.

Figure 2:
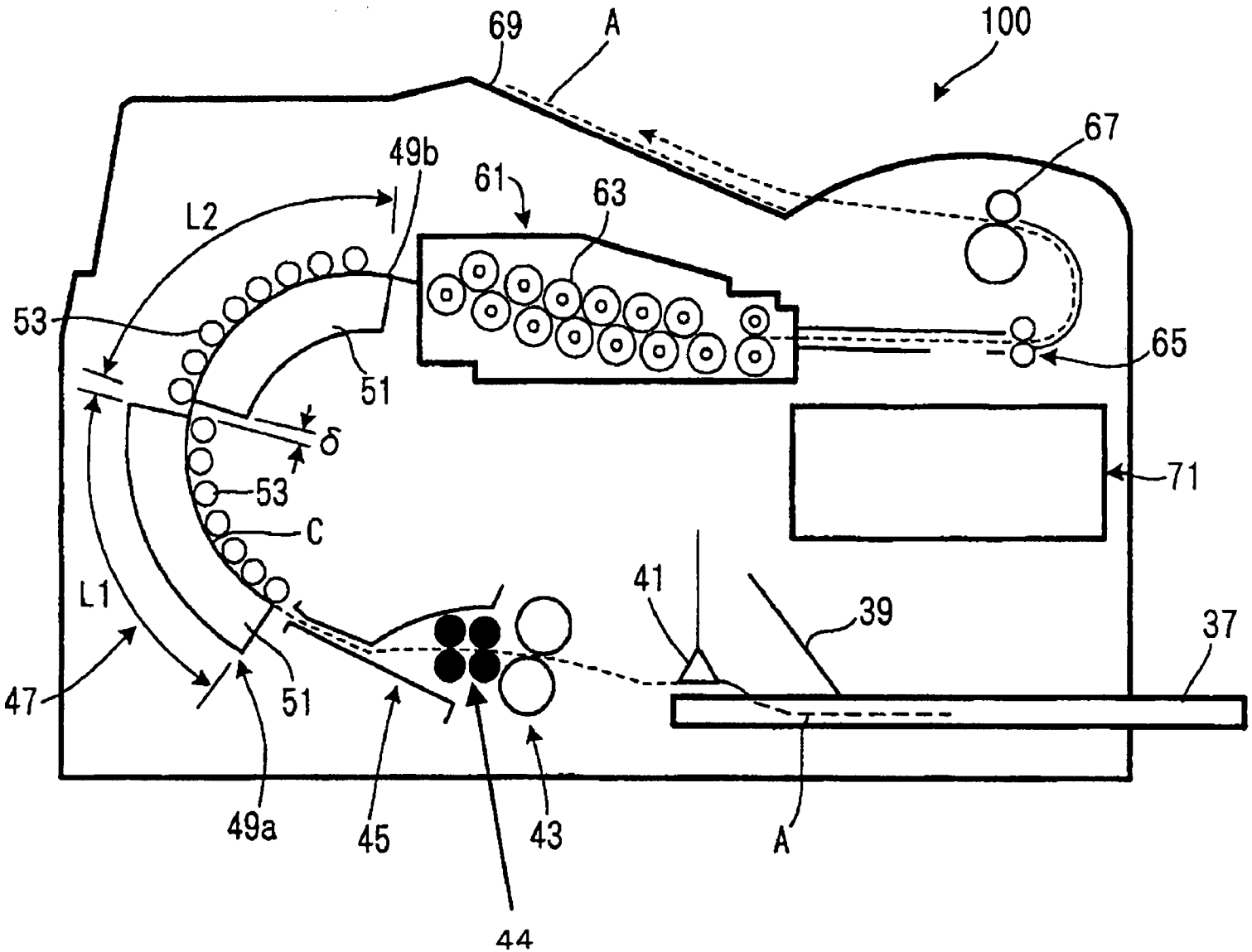
FIG. 2 is a structural diagram illustrating a first embodiment of a thermal developing apparatus according to the present invention.
Figure 3:
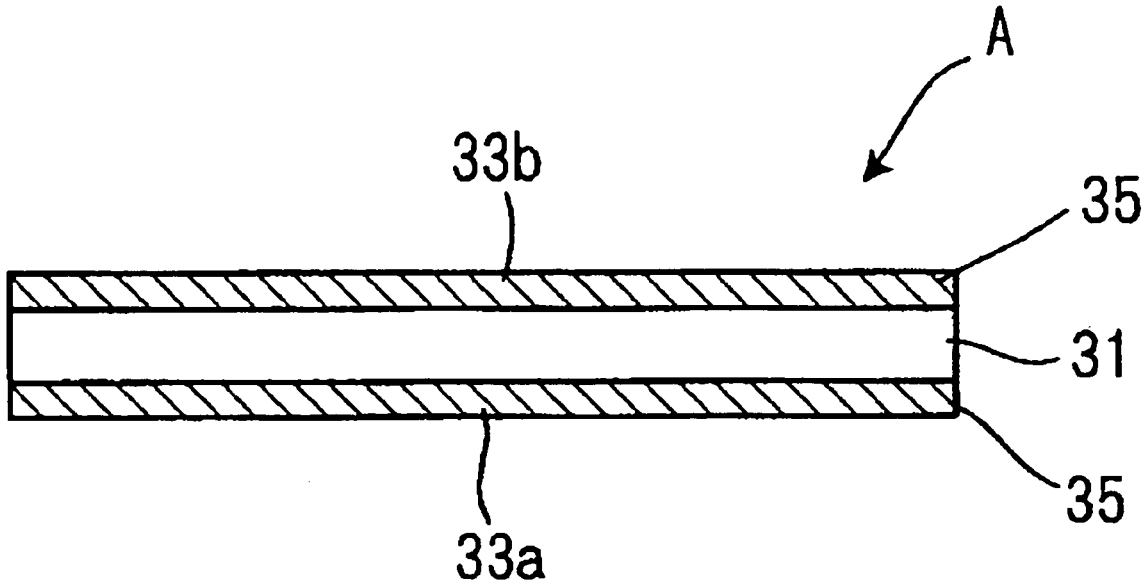
FIG. 3 is a sectional view showing a photothermographic material.
Figure 4:
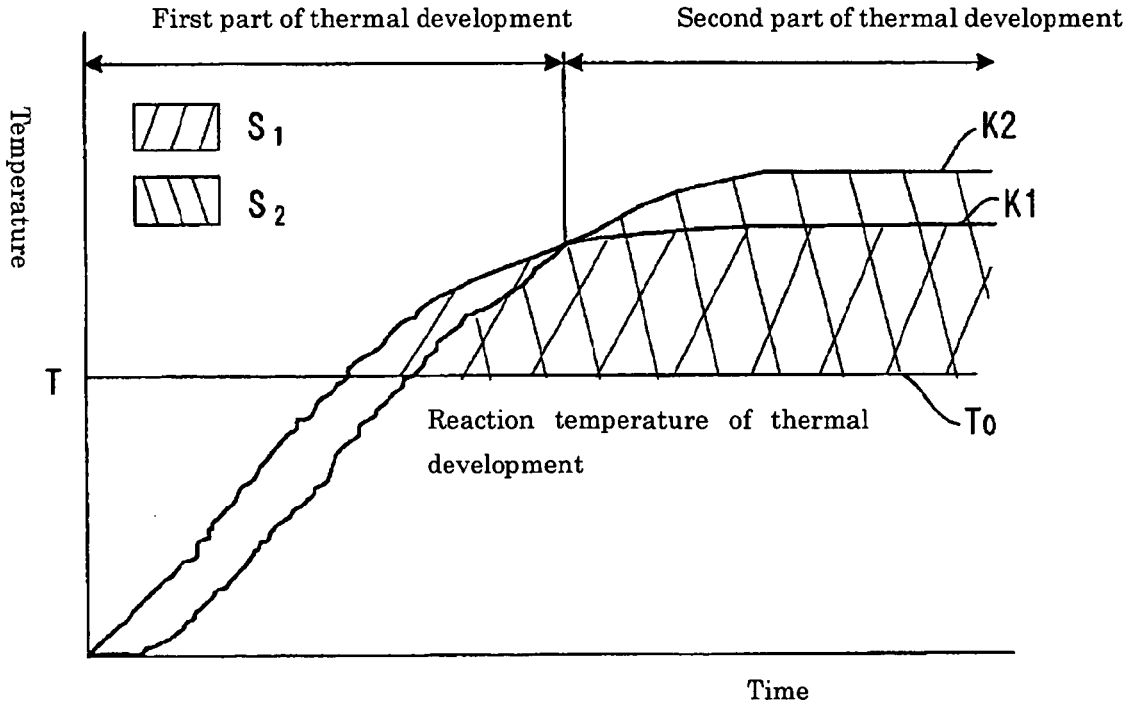
FIG. 4 is an explanatory diagram indicating a correlation between temperatures of the front and back surfaces of a photothermographic material respectively heated by first and second heating means and time.
Figure 5:
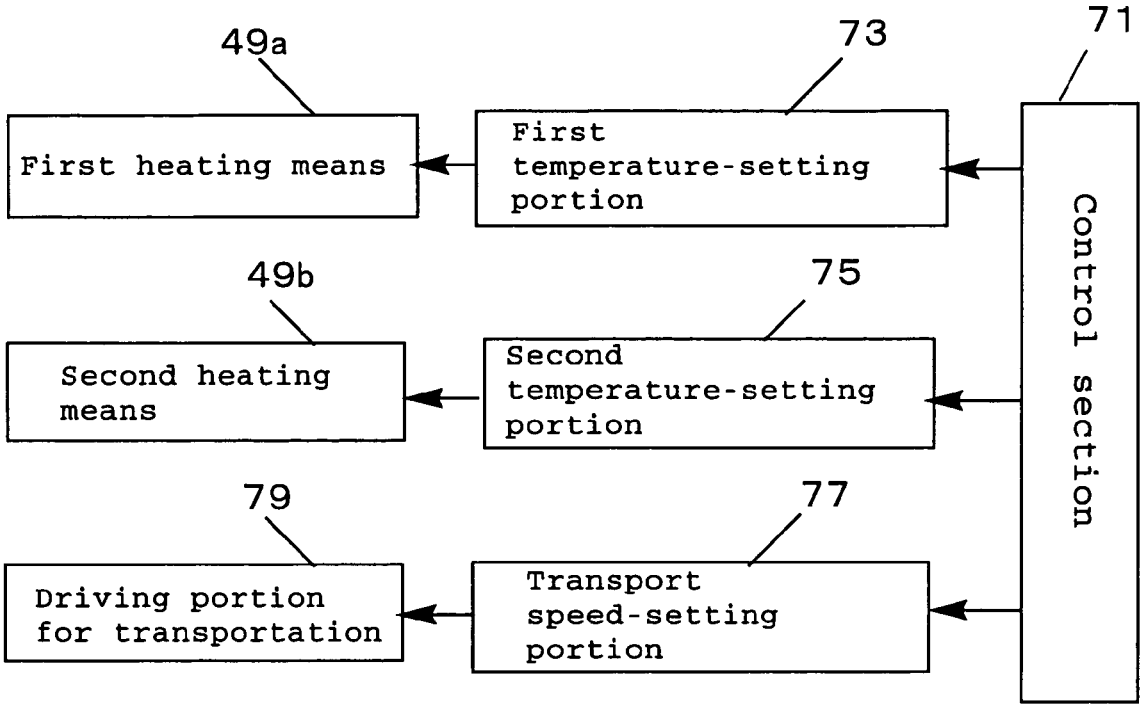
FIG. 5 is a block diagram showing a control means.

FIG. 2 is a structural diagram illustrating a first embodiment of a thermal developing apparatus for practicing the present invention. FIG. 3 is a sectional view showing the photothermographic material of the present invention. FIG. 4 is an explanatory diagram indicating a correlation between temperatures of the back and front surfaces of a recording material respectively heated by first and second heating means and time. FIG. 5 is a block diagram showing a control means.

Symbols used in FIG. 2 to FIG. 9 are explained below.

10: Photothermographic material
20: Heating means
21: first plate
22: Second plate
23: Third plate
24: Fourth plate
25: Fifth plate
26: Sixth plate
30: Conveying roller
31: Support
33*a*: First surface
33*b*: Second surface
35: Image forming layer
37: Cassette
39: Opening and closing cover
40: Travelling direction
41: Suction cup
43: Conveying roller pair
45: Transporting guide
47: Thermal developing section
49*a*,81*a*,91*a*, 101*a*: First heating means
49*b*, 81*b*, 91*b*,101*b*: Second heating means
51: Plate
53: Pressing roller
61: Gradual rolling section
63: Cooling roller
65, 67: Discharging roller pair
69: Tray
71: Control section
73: First temperature-setting portion
75: Second temperature-setting portion
77: Transport speed-setting portion
79: Driving portion for transportation
83: Drum
85: Pressing roller
93: Carrier
95: Endless belt
97: Pressing roller
100, 200, 300, 400: Thermal developing apparatus
A: Recording material (photothermographic material)
C: Conveying route
H: Heater
T: Development reaction temperature
δ: Clearance The thermal developing apparatus 100 according to the first embodiment of the present invention can heat the photothermographic material A to make visible the latent image recorded in the image forming layer. The photothermographic material A used for the thermal developing apparatus 100 comprises image forming layers 35, 35 coated both on a first surface 33*a* as one side of the support 31 and the other face, a second surface 33*b* as shown in FIG. 3.

In the thermal developing apparatus 100, for example, when a fluorescent intensifying screen (not shown) is placed on both sides of the first surface 33*a* and the second surface 33*b* of the photothermographic material A, the photothermographic material A will be used for the direct radiography. The fluorescent intensifying screen can emit a fluorescent light by exposure to X-ray beam. The image forming layers 35, 35 coated on the first surface 33*a* and the second surface 33*b* respectively have a sensitivity to the fluorescent light emitted by the fluorescent intensifying screen and then can be sensitized by a small amount of X-ray beam thereby. Further the photothermographic material A will be explained in detail hereinafter.

The photothermographic material having a latent image in the image forming layer 35 is usually stocked in a cassette 37 one by one, and the cassette 37 including the materials is loaded to the thermal developing apparatus 100. An opening and closing cover 39 of the cassette 37 loaded in the thermal developing apparatus 100 is opened and the photothermographic material A included is taken out from the cassette by means of a suction cup 41.

Further, the thermal developing apparatus 100 may have a structure of a magazine (not shown) where a plurality of the photothermographic materials A are accommodated together. In this case, each of the photothermographic material A having a latent image is taken out from the cassette 37 in the darkroom and then stacked in the magazine. The photothermographic material A stacked and accommodated in the magazine is taken out one by one by means of the suction cup 41. In place of the suction cup 41, a pick-up roller can be applied.

The photothermographic material A taken out thereby is conveyed to a thermal developing section 47 located downstream to a travelling direction via a conveying roller pair 43 and a transporting guide 45. A width aligning portion which aligns the photothermographic material A taken out in the direction normal to that of the travelling direction and the position of the photothermographic material A in the thermal developing section 47 located downstream may be installed between the conveying roller pair 43 and the thermal developing section 47.

In the thermal developing section 47, a first heating means 49*a* for heating the first surface 33*a* of the photothermographic material A and a second heating means 49*b* for heating the second surface 33*b* of the photothermographic material A are equipped alternatively crossing the conveying route C of the photothermographic material A. According to the embodiment, the first heating means 49*a* and the second heating means 49*b* are composed of a plate 51 and rotary pressing rollers 53 to push the photothermographic material A against the plate 51. Either the plate 51 or the pressing rollers 53 may include a heater as a heating source.

According to the embodiment, the heater as a heating source is included in the plate 51. Therefore, in the first heating means 49*a*, the plate 51 is placed facing the first surface 33*a* of the photothermographic material A, and in the second heating means 49*b*, the plate 51 is placed facing the second surface 33*b* of the photothermographic material A. The first surface 33*a* and the second surface 33*b* may be heated alternatively thereby. The "heated alternatively" used herein includes a heating method where the first surface 33*a* is heated at first, thereafter the second surface 33*b* is heated, and finish heating, that is the case where the back and front sides of the material are heated only one time respectively.

The plate 51 has a circular-arc configuration and install a plurality of the pressing rollers 53 along the inner side. The photothermographic material A is inserted to the conveying route C formed in a clearance between the plate 51 and the pressing rollers 53, and conveyed tightly in contact with the plate 51 while pushing against the plate 51 by the pressing rollers 53. And then the material A is developed by the heat of the plate 51.

The heating source for the plate 51 is not particularly restricted, but a heat generating body such as a nichrome wire, a light source such as a halogen lamp, hot air heating or other well-known heating means can be applied.

The pressing rollers 53 are selected from a metal roller, a heat-resistant resin roller, a heat-resistant rubber roller, and the like. Overall region in the plate 51, it is preferable to install a plurality of the rollers.

According to the thermal developing section 47, in the first heating means 49*a*, wherein the second surface 33*b* of the photothermographic material A is pushed by the pressing rollers 53, the first surface 33*a* is pushed against the plate 51. Thereafter the photothermographic material A is conveyed to the second heating means 49*b*, wherein the first surface 33*a* is pushed by the pressing rollers 53, the second surface 33*b* is pushed against the plate 51. As the result, the first surface 33*a* and the second surface 33*b* of the photothermographic material A are heated alternatively. Thereby, the rapid temperature raise of the photothermographic material A can be avoided and also uniform heating of both surfaces can be attained. In addition, the above-mentioned configuration has an advantage of decreasing the movable parts and miniaturizing the apparatus structure, because the pressing roller 53 rotates alone.

In the thermal developing section 47, with respect to the total heating amount which is more than the development reaction temperature for the image forming layer 35 heated by the first surface 33*a* and the second surface 33*b* of the photothermographic material A, if the total heating amount for the first surface 33*a* is taken as 100, the total heating amount for the second surface 33*b* is set to be in the range of 100±30.

The temperature of both the first heating means 49*a* and the second heating means 49*b* is set at the glass transition temperature of the photothermographic material A or higher. The temperature of the heating means (the first heating means 49*a*) located upstream to the travelling direction of the photothermographic material A is set a lower temperature than that of the heating means (the second heating means 49*b*) located downstream to the travelling direction.

The above-mentioned total heating amount can be derived from the integral value of the temperature of greater than the development reaction temperature and the time lapse from the time the temperature is reached to the development reaction temperature. Namely, in the graph shown in FIG. 4, the total heating amount of the first surface 33*a* can be obtained from the area $S_1$ which is enclosed between the line segment To representing the development reaction temperature T and the curve K1 representing the temperature change of the first surface 33*a*. The total heating amount of the second surface 33*b* can be obtained from the area $S_2$ which is enclosed between the line segment To representing the development reaction temperature T and the curve K2 representing the temperature change of the second surface 33*b*. Thereby, the total heating amount can be controlled by the specific parameters of the temperature and the time lapse for the first heating means 49*a* and the second heating means 49*b*, because the total heating amount ($S_1$, $S_2$) on the first surface 33*a* and the second surface 33*b* can be determined from the integral value of the temperature and the time lapse respectively. As the result, uniformity of the total heating amount on both surfaces of the photothermographic material A can be easily attained.

Further, as for the total heating amount, if the heating temperature of the first heating means 49*a* and the second heating means 49*b* and a contact length L1, L2 of the photothermographic material A with the first heating means 49*a* and the second heating means 49*b* are used as a parameter, and the total heating amount on the first surface 33*a* is taken as 100, then the total heating amount on the second surface 33*b* may be set to a range of 100±30. Thereby, the total heating amount can be controlled by the specific parameter of the temperature and the contact length L1, L2, and then the uniformity of the total heating amount on both surfaces of the photothermographic material A can be easily attained.

According to the above configuration, the temperature of the photothermographic material A becomes the glass transition temperature or higher when the heating face is the first surface 33*a*, and also the temperature becomes the glass transition temperature or higher when the heating face is transferred from the first surface 33*a* to the second surface 33*b*. Therefore the photothermographic material A is maintained to be in a softening state during the heating process. Thereby, the generation of a wrinkle caused by pushing the photothermographic material A by the pressing rollers 53 can be prevented. Because the heating temperature of the first heating means 49*a* is set to be lower than the heating temperature of the second heating means 49*b*, the rapid temperature rise on the first surface 33*a* is avoided at the beginning stage of the heating. The generation of a wrinkle caused by a rapid thermal swelling of the photothermographic material A can be prevented thereby.

Furthermore, in the thermal developing section 47, the clearance δ between the first heating means 49*a* and the second heating means 49*b* is set to 100 mm or less. Therefore, when the photothermographic material A whose first surface 33*a* is heated by the heating means 49*a* is conveyed to the second heating means 49*b* to heat the second surface 33*b*, the temperature drop of the photothermographic material A heated by the first heating means 49*a* is prevented because of the narrow clearance on the order of 100 mm or less. Thereby, the photothermographic material A is kept at more than the predetermined temperature shown in FIG. 4, even if the heating face is changed between the back and front sides, and the development reaction can proceed successively without any delay.

The photothermographic material A developed in the thermal developing section 47 is then conveyed to a gradual cooling section 61 located downstream to the travelling direction as shown in FIG. 2. The gradual cooling section 61 installs a plurality of cooling roller pairs 63 and can gradually cool the thermally developed photothermographic material A. The photothermographic material A cooled in the gradual cooling section 61 is then conveyed to the downstream direction by a discharging roller pairs 65, and 67 and then discharged to a tray 69.

The thermal developing apparatus 100 also includes a control section 71 which can control the first heating means 49*a*, the second heating means 49*b* and the transporting speed of the photothermographic material A. As shown in FIG. 5, the control section 71 can control the first heating means 49*a* via the first temperature-setting portion 73, the second heating means 49*b* via the second temperature-setting portion 75, and also control a driving portion for transportation 79 such as a driving motor via a transporting speed-setting portion 77. The control section 71 can control the total heating amount for heating the first surface 33*a* and the second surface 33*b* to be in the above described range using the temperature and the transporting speed as the parameter.

According to the thermal developing apparatus 100, the first surface 33*a* of the photothermographic material A may be heated first, and then the second surface 33*b* is heated. Therefore, the both surfaces of the photothermographic material A can be thermally developed, while suppressing a rapid temperature raise. Also, because the total heating amount of the second surface 33*b* is set to be in the prescribed range of the total heating amount of the first surface 33*a*, the total heating amount of both surfaces of the photothermographic material A result in an approximately equal amount. Thereby, the photothermographic material A can be thermally developed evenly without any wrinkle generation, color tone difference and density fluctuation.

According to the thermal developing method using the thermal developing apparatus 100, the first surface 33*a* and the second surface 33*b* of the photothermographic material A are heated alternatively, and with respect to each of the total heating amount which is more than the development reaction temperature to the image forming layer 35 heated by the first surface 33*a* and the second surface 33*b*, if the total heating amount of the first surface 33*a* is taken as 100, the total heating amount of the second surface 33*b* is set to be in the range of 100±30. Thereby, both sides of the photothermographic material A are heated evenly and then can be thermally developed uniformly. In addition, even if the first surface 33*a* and the second surface 33*b* are heated alternatively, both surfaces can be heated evenly while suppressing a rapid temperature raise. Thereby, for the case of the photothermographic material A which has an image forming layer on both sides, uniformly heat development of both surfaces can be attained without the generation of wrinkles, and also without color tone difference and density fluctuation. The loading of the photothermographic material A to the thermal developing apparatus and the development thereof can be carried out without any consideration about the back and front sides.

The other embodiments of the thermal developing apparatus used for the present invention are explained hereinafter.

In the following embodiments, only the main portions of the thermal developing apparatus (thermal developing section) are shown. Every thermal developing section has a construction where the first surface 33*a* and the second surface 33*b* of the photothermographic material A are heated alternatively by the first heating means and the second heating means respectively, and the total heating amount of the second surface 33*b* is set to be in a range of 100±30 when the total heating amount of the first surface 33*a* is taken as 100.

Figure 6:
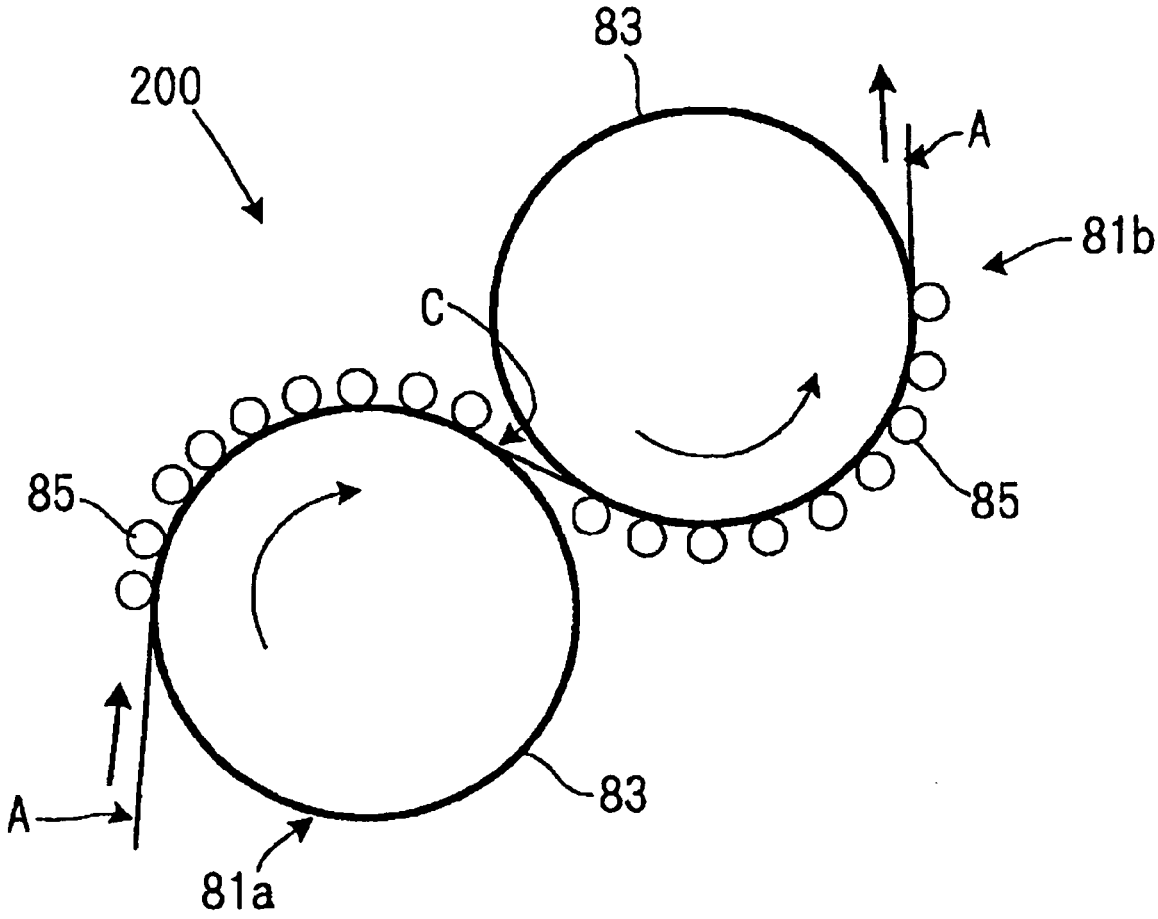
FIG. 6 is a structural view showing an essential part of a thermal developing apparatus having a drum and pressing rollers.

FIG. 6 show a schematic diagram of a main portion of a thermal developing apparatus installed with a drum and a plurality of pressing rollers according to the second embodiment.

The thermal developing apparatus 200 has a construction in which both of a fist heating means 81*a* and a second heating means 81*b* use a rotary driven cylindrical drum 83 and a plurality of rotary pressing rollers 85 pushing the photothermographic material A against the circumferential surface of the drum 83. A heater as a heating source may be equipped in either the drum 83 or the pressing rollers 85. In this embodiment, the drum 83 contains the heater as the heating source.

The first heating means 81*a* and the second heating means 81*b* are disposed close together, and the drum 83 of the first heating means 81*a* rotates reversely to the drum 83 of the second heating means 81*b*. Therefore, the first heating means 81*a* and the second heating means 81*b* form an S-shaped conveying route C. Even in the thermal developing apparatus 200 according to the embodiment, the first surface 33*a* of the photothermographic material A is heated by the first heating means 81*a* and then the second surface 33*b* is heated by the second heating means 81*b*.

The photothermographic material A transported by the first heating means 81*a* is conveyed with nipping by the drum 83 and the pressing rollers 85 while the first surface 33*a* is conveyed in close contact with the drum 83. As a result, the material is heated by the heat of the drum 83 to make visible the latent image formed by the exposure. Next to the above, the photothermographic material A in which the first surface 33*a* is heated is conveyed to the second heating means 81*b*, and then conveyed with nipping by the drum 83 and the pressing rollers 85 while the second surface 33*b* is conveyed in close contact with the drum 83 in a similar way as the above. Thereby the material is thermally developed by the heat of the drum 83.

According to the thermal developing apparatus 200, the first surface 33*a* of the photothermographic material A is pushed against the drum 83 in the heating means 81*a*, and then the second surface 33*b* is pushed against the drum 83 in the second heating means 81*b*. As a result, the first surface 33*a* and the second surface 33*b* of the photothermographic material A are heated alternatively. Therefore, the rapid temperature raise of the photothermographic material A can be avoided and then the uniform heating of both faces is attained. Also, a configuration where the drum 83 and the pressing rollers 85 are rotated synchronously with the transporting speed of the photothermographic material A advantageously results in no rubbing between the heating means and the photothermographic material A.

The thermal developing apparatus of the third embodiment of the present invention is explained hereinafter.

Figure 7:
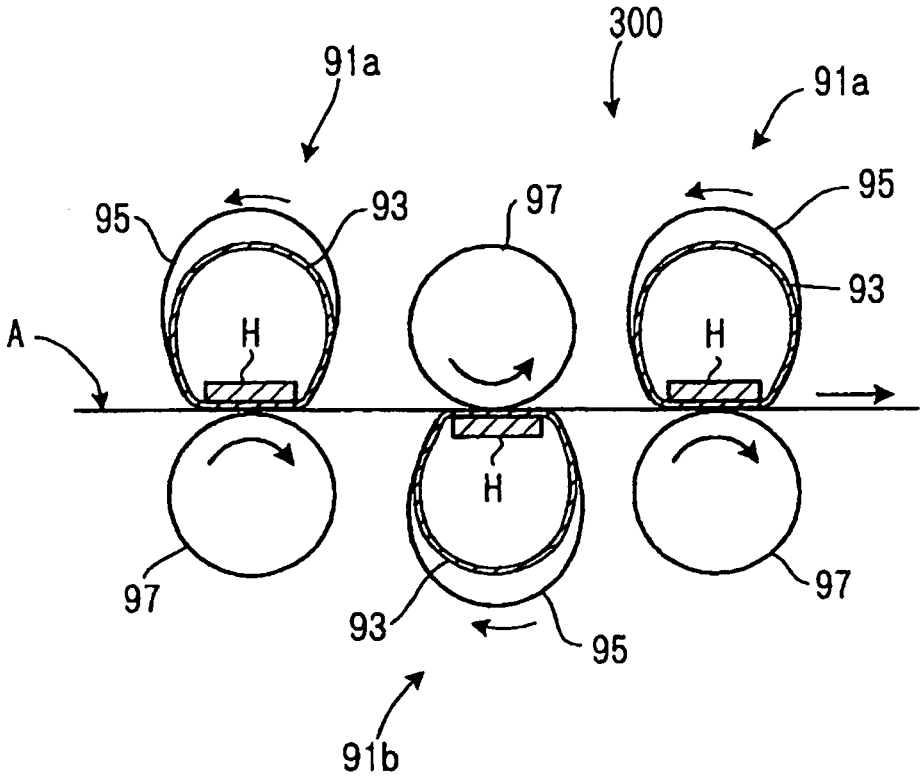
FIG. 7 is a structural view showing an essential part of a thermal developing apparatus having a carrier, an endless belt, and pressing rollers.

FIG. 7 shows a schematic diagram of the main portion of a thermal developing apparatus having a carrier, an endless belt and a pressing roller.

The thermal developing apparatus 300 has a construction in which each of the first heating means 91*a* and the second heating means 91*b* consist of a pipe type carrier 93 installed with a heater H as a heat source, the endless belt 95 surrounding the carrier 93, and the pressing roller 97 rotating the endless belt 95 at the same speed while pushing the endless belt 95 against the carrier 93. The endless belt 95 may be made of a material having enough heat conductivity such as aluminum, resin and the like, or a rubber heater. With respect to the heating amount of the first heating means 91*a* and the second heating means 91*b*, if each heating means is adjusted to heat the back and front surfaces of the photothermographic material A evenly, the number of the first heating means 91*a* and the heating means 91*b* disposed is not necessary the same.

According to the thermal developing apparatus 300, for example, in the heating means 91*a* shown in the left side of FIG. 7, while pushing the second surface 33*b* of the photothermographic material A by the pressing roller 97, the first surface 33*a* is pushed against the carrier 93 by means of the endless belt 95. Then the photothermographic material A is conveyed to the second heating means 91*b*, in succession, while pushing the first surface 33*a* by the pressing roller 97, the second surface 33*b* is pushed against the carrier 93 by means of the endless belt 95. Thereby, the first surface 33*a* and the second surface 33*b* of the photothermographic material A are heated alternatively. Both surfaces of the photothermographic material A can be heated uniformly, and the gradual heating with the plural heating means prevents the rapid temperature raise. And also, the configuration in which the endless belt 95 surrounding the carrier 93 is moved synchronized with the transporting speed of the photothermographic material A may result in no rubbing between the heating means and the photothermographic material A. Therefore no damage in the image forming layer is occurred.

The thermal developing apparatus of the fourth embodiment of the present invention will be explained in detail hereinafter.

Figure 8:
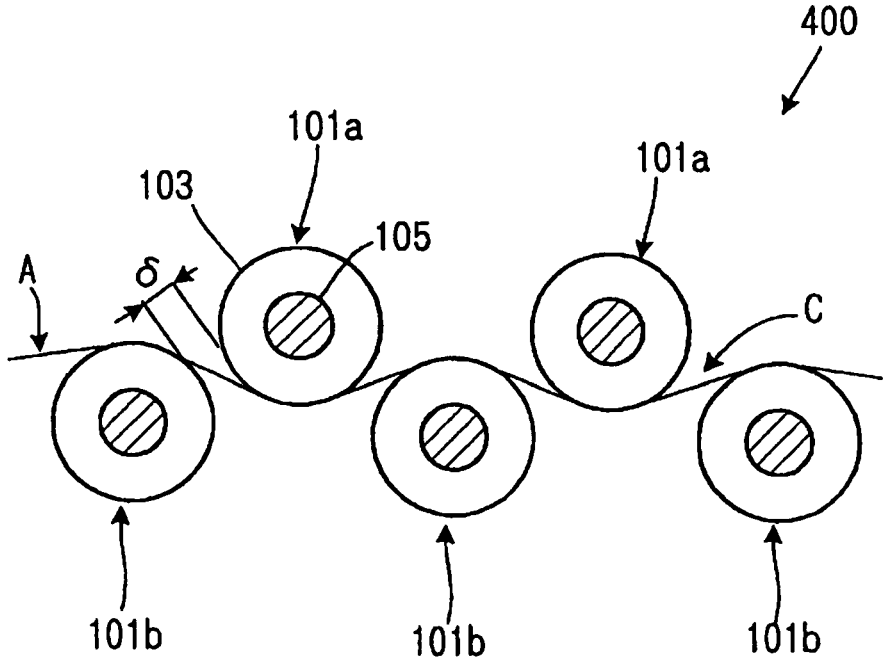
FIG. 8 is a structural view showing an essential part of a thermal developing apparatus having plural pairs of first and second heating means.

FIG. 8 shows a schematic diagram of a main portion of the thermal developing apparatus installed with plural sets of a first heating means and a second heating means.

The thermal developing apparatus 400 installs plural sets of a first heating means 101*a* composed of a heating roller 101 along the conveying route C of the photothermographic material A and a second heating means 101*b* composed of similar heating roller 101. The heating roller 101 consists of a cylindrical heating body 103 and a heating source 105 such as a halogen heater and the like to heat the inner side of the heating body 103.

Especially, according to the embodiment, the first heating means 101*a* and the second heating means 101*b* are disposed in the staggered form along the conveying route C of the photothermographic material A.

3. Application of the Invention

The image forming method in which the photothermographic material of the invention is preferably employed is an image forming method for medical imaging, through forming black and white images by silver imaging.

EXAMPLES

The present invention is specifically explained by way of Examples below, which should not be construed as limiting the invention thereto.

Example 1

1. Preparation of PET Support 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film having such a thickness that the thickness should become 175 μm after tentered and thermal fixation.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 KVA·minute·m$^2$ was executed, judging from the readings of current and voltage on that occasion. The frequency upon this treatment was 9.6 kHz, and the gap clearance between the electrode and dielectric roll was 1.6 mm.

1-3. Undercoating

1)Preparations of Coating Solution for Undercoat Layer

| | |
|---|---|
| Pesresin A-520 manufactured by Takamatsu Oil & Fat Co., Ltd. (30% by weight solution) | 46.8 g |
| BAIRONAARU WD-1200 manufactured by Toyo Boseki Co., Ltd. | 10.4 g |
| Polyethylene glycol monononylphenylether (average ethylene oxide number = 8.5) (1% by weight solution) | 11.0 g |
| MP-1000 manufactured by Soken Chemical & Engineering Co., Ltd. (PMMA polymer fine particle, mean particle diameter of 0.4 μm) | 0.91 g |
| distilled water | 931 mL |

2) Undercoating

Both surfaces of the aforementioned biaxially tentered polyethylene terephthalate support having the thickness of 175 μm were subjected to the corona discharge treatment as described above. Thereafter, the aforementioned formula of coating solution for the undercoat was coated with a wire bar so that the amount of wet coating became 6.6 mL/m$^2$ (per one side), and dried at 180° C. for 5 minutes. This was subjected to both sides, and thus an undercoated support was produced.

2. Preparations of Coating Materials

1) Preparation of Silver Halide Emulsion

<Preparation of Silver Halide Emulsion 1A1 (Tabular AgI host grains of 0.68 μm)>

A solution was prepared by adding 4.3 mL of a 1% by weight potassium iodide solution, and then 3.5 mL of 0.5 mol/L sulfuric acid, 4.6 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. And after that, 32.7 g of phthalated gelatin was added. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The silver halide emulsion 1A1 was a pure silver iodide emulsion, and the obtained silver halide grains had a mean projected area equivalent diameter of 1.869 μm, a variation coefficient of a projected area equivalent diameter distribution of 19.7%, a mean thickness of 0.06 μm and a mean aspect ratio of 31.2. Tabular grains having an aspect ratio of 2 or more occupied 80% or more of the total projected area. The mean equivalent spherical diameter of the grains was 0.68 μm. 30% or more of the silver iodide existed in γ phase from the result of powder X-ray diffraction analysis.

<Preparation of Silver Halide Emulsion 1A2 (Epitaxial Grains of 0.68 μm)>

1 mol of the silver iodide tabular grains prepared in the silver halide emulsion 1A1 was added to the reaction vessel. The pAg measured at 38° C. was 10.2. 0.5 mol/L potassium bromide solution and 0.5 mol/L silver nitrate solution were added at an addition speed of 10 mL/min over 20 minutes by double jet addition to precipitate substantially a 10 mol % of silver bromide on the silver iodide host grains as epitaxial form while keeping the pAg at 10.2 during the operation.

Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion 1A2.

<Preparation of Emulsion 1A for Coating Solution>

The silver halide emulsion 1A2 was dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide. Thereafter, as "a compound having an adsorptive group and a reducible group", the compound Nos. 1 and 2 were added respectively in an amount of $8\times10^{-3}$ mol per 1 mol of silver halide. Further, water was added thereto to give the content of silver halide of 15.6 g in terms of silver, per 1 liter of the mixed emulsion for a coating solution.

2) Preparation of Dispersion of Silver Salt of Fatty Acid A

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Reducing Agent-1 Dispersion

To 10 kg of reducing agent-1 (1,1-bis(2-hydroxy-3,5-dimethylphenyl)-3,5,5-trimethylhexane) and 16 kg of a 10% by weight aqueous solution of modified polyvinyl alcohol (manufactured by Kuraray Co., Ltd., Poval MP203) is added 10 kg of water, and thoroughly mixed to give a slurry. This slurry is fed with a diaphragm pump, and is subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water are added thereto, thereby adjusting the concentration of the reducing agent to be 25% by weight. This dispersion is subjected to heat treatment at 60° C. for 5 hours to obtain reducing agent-1 dispersion. Particles of the reducing agent included in the resulting reducing agent dispersion have a median diameter of 0.40 μm, and a maximum particle diameter of 1.4 μm or less. The resultant reducing agent dispersion is subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Dispersions of Development Accelerator and Color-Tone-Adjusting Agent <Preparation of Development Accelerator-1 Dispersion>

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<Preparations of Solid Dispersions of Development Accelerator-2 and Color-Tone-Adjusting Agent-1>

Also concerning solid dispersions of development accelerator-2 and color-tone-adjusting agent-1, dispersion was executed similar to the development accelerator-1, and thus dispersions of 20% by weight and 15% by weight were respectively obtained.

6) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified polyvinyl alcohol (manufactured by Kurary Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Silver Iodide Complex-forming Agent (Compound No. 22) Solution 8 kg of modified polyvinyl alcohol MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of silver iodide complex-forming agent (compound No. 22). Accordingly, a 5% by weight solution of silver iodide complex-forming agent compound was prepared.

8) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.) and pH of 8.4.

9) Preparations of Aqueous Solution of Mercapto Compound

<Preparation of Aqueous Solution of Mercapto Compound-1>

Mercapto compound-1 (1(3-sulfophenyl)-5-mercaptotetrazole sodium salt) in an amount of 7 g was dissolved in 993 g of water to give a 0.7% by weight aqueous solution.

<Preparation of Aqueous Solution of Mercapto Compound-2>

Mercapto compound-2 (1-(3-methylureidophenyl)-5-mercaptotetzole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (¼G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

11) Preparation of Nucleator Dispersion 2.5 g of polyvinyl alcohol (manufactured by Kuraray Co., Ltd., PVA-217) and 87.5 g of water are added to 10 g of nucleator SH-7, and thoroughly admixed to give a slurry. This slurry is allowed to stand for 3 hours. Zirconia beads having a mean particle diameter of 0.5 mm are provided in an amount of 240 g, and charged in a vessel with the slurry. Dispersion is performed with a dispersing machine (¼G sand grinder mill: manufactured by AIMEX Co., Ltd.) for 10 hours to obtain a solid fine particle dispersion of nucleator. Particles of the nucleator included in the resulting nucleator dispersion have a mean particle diameter of 0.5 μm, and 80% by weight of the particles has a particle diameter of 0.11 μm to 1.0 μm.

Also concerning nucleators SH-4 and SH-5, dispersion was executed similar to that described above, and thus solid fine particle dispersions were respectively obtained.

3. Preparations of Coating Solution

1) Preparation of Coating Solution for Crossover Cut Layer 17 g of polyvinyl alcohol PVA-205 (manufactured by Kuraray Co., Ltd.), 9.6 g of polyacrylamide, 4.2 g of the following ultraviolet absorber-1, 0.03 g of benzisothiazolinone, 2.2 g of poly(sodium styrenesulfonate), and 844 mL of water were admixed to give a coating solution for the crossover cut layer.

The coating solution for the crossover cut layer was fed to the coating station by controlling the flow speed of the coating solution to give the coating amount of solid content of the ultraviolet absorber-1 of 0.04 g/m$^2$.

Ultraviolet absorber-1

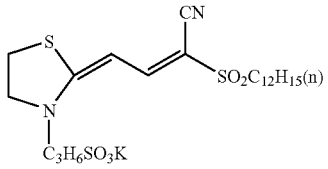

2) Preparations of Coating Solution for Image Forming Layer

<Preparation of Coating Solution for Image Forming Layer-1>

To the dispersion of silver salt of fatty acid obtained as described above in an amount of 1000 g and 276 mL of water were serially added the organic polyhalogen compound-1 dispersion, the organic polyhalogen compound-2 dispersion, the SBR latex (Tg: 17° C.) solution, the reducing agent-1 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the emulsion 1A for coating solution was added thereto in an amount of 0.255 mol per 1 mol of silver salt of fatty acid, followed by thorough mixing just prior to the coating, which is fed directly to a coating die.

<Preparations of Other Coating Solutions for Image Forming Layer>

Preparations of other coating solutions for image forming layer were conducted in a similar manner to the process in the preparation of coating solution for image forming layer-1 except that changing the kind and amount of nucleator as shown in Table 1 and Table 2.

3) Preparation of Coating Solution for Intermediate Layer

To 772 g of a 10% by weight aqueous solution of polyvinyl alcohol PVA-205 (manufactured by Kuraray Co., Ltd.), 5.3 g of pigment-1 dispersion, and 226 g of a 27.5% by weight solution of methyl methacrylate/styrene/butyl acrylate/hydroxyethyl methacrylate/acrylic acid copolymer (weight ratio of the copolymerization of 64/9/20/5/2) latex, were added 2 mL of a 5% by weight aqueous solution of aerosol OT (manufactured by American Cyanamid Co.), 10.5 mL of a 20% by weight aqueous solution of ammonium secondary phthalate and water to give total amount of 880 g. The mixture was adjusted with sodium hydroxide to give the pH of 7.5. Accordingly, the coating solution for the intermediate layer was prepared, and was fed to a coating die to provide 10 mL/m$^2$.

Viscosity of the coating solution was 65 [mPa·s] which was measured with a B type viscometer at 40° C. (No. 1 rotor, 60 rpm).

4) Preparation of Coating Solution for Furst Layer of Surface Protective Layers

In water was dissolved 64 g of inert gelatin, and thereto were added 80 g of a 27.5% by weight solution of methyl methacrylate/styrene/butyl acrylate/hydroxyethyl methacrylate/acrylic acid copolymer (weight ratio of the copolymerization of 64/9/20/5/2) latex, 23 mL of a 10% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT, 0.5 g of phenoxyethyl alcohol, and 0.1 g of benzisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

5) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 3.2 mL of a 5% by weight solution of a fluorocarbon surfactant (F-1), 32 mL of a 2% by weight aqueous solution of another fluorocarbon surfactant (F-2), 23 mL of a 5% by weight aqueous solution of aerosol OT, 4 g of polymethyl methacrylate fine particles (mean particle diameter of 0.7 μm), 21 g of polymethyl methacrylate fine particles (mean particle diameter of 4.5 μm), 1.6 g of 4-methyl phthalic acid, 4.8 g of phthalic acid, 44 mL of 0.5 mol/L sulfuric acid, and 10 mg of benzisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparations of Photothermographic Material

On one side of the support, simultaneous overlaying coating by a slide bead coating method was subjected in order of the crossover cut layer, front-side image forming layer, intermediate layer, first layer of the surface protective layers, and second layer of the surface protective layers, starting from the undercoated face. Subsequently on the other side of the support, similarly, overlaying coating was subjected in order of the crossover cut layer, back-side image forming layer, intermediate layer, first layer of the surface protective layers, and second layer of the surface protective layers, and thus Sample Nos. 1 to 20 of double-sided type photothermographic materials were produced. In this method, the temperature of the coating solution was adjusted to 31° C. for the image forming layer and intermediate layer, to 36° C. for the first layer of the surface protective layers, and to 37° C. for the second layer of the surface protective layers. The amount of coated silver was 0.862 g/m$^2$ per one side, with respect to the sum of silver salt of fatty acid and silver halide. The compositions of the front-side image forming layer and back-side image forming layer for each sample are shown in Table 1 and Table 2.

The coating amount of each compound (g/m) for the image forming layer per one side is as follows.

| | |
|---|---|
| Silver salt of fatty acid | 2.85 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.46 |
| Nucleator | (see Tables 1 and 2) |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Conditions for coating and drying were as follows.

The support was decharged by ionic wind. Coating was performed at the speed of 160 m/min.

Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared Sample No. 1 had a matt degree of 550 seconds as Beck's smoothness. In addition, measurement of the pH of the film surface gave the result of 6.0.

TABLE 1

| | Front-side Image Forming Layer | | | | | Back-side Image Forming Layer | | | | | Ratio of |
|---|---|---|---|---|---|---|---|---|---|---|---|
| | Reducing Agent | | Nucleator | | | Reducing Agent | | Nucleator | | | Nucleation |
| Sample No. | No. | Addition Amount (mol/m$^2$) | No. | Addition Amount (mol/m$^2$) | Nucleation Property (y/x value) | No. | Addition Amount (mol/m$^2$) | No. | Addition Amount (mol/m$^2$) | Nucleation Property (y/x value) | Property of Front-side to Back-side |
| 1 | Reducing agent-1 | $1.2 \times 10^{-3}$ | SH-7 | $7.4 \times 10^{-5}$ | 25 | Reducing agent-1 | $1.2 \times 10^{-3}$ | SH-7 | $7.4 \times 10^{-5}$ | 25 | 1 |
| 2 | Reducing agent-1 | $1.2 \times 10^{-3}$ | SH-7 | $2.5 \times 10^{-5}$ | 9 | Reducing agent-1 | $1.2 \times 10^{-3}$ | SH-7 | $8.9 \times 10^{-5}$ | 31 | 3.4 |
| 3 | Reducing agent-1 | $1.2 \times 10^{-3}$ | — | — | 1 | Reducing agent-1 | $1.2 \times 10^{-3}$ | SH-7 | $12.3 \times 10^{-5}$ | 42 | 42 |
| 4 | Reducing agent-1 | $1.2 \times 10^{-3}$ | — | — | 1 | Reducing agent-1 | $1.2 \times 10^{-3}$ | — | — | 1 | 1 |
| 5 | Reducing agent-1 | $1.2 \times 10^{-3}$ | SH-4 | $7.4 \times 10^{-5}$ | 22 | Reducing agent-1 | $1.2 \times 10^{-3}$ | SH-4 | $7.4 \times 10^{-5}$ | 22 | 1 |
| 6 | Reducing agent-1 | $1.2 \times 10^{-3}$ | SH-4 | $2.5 \times 10^{-5}$ | 7 | Reducing agent-1 | $1.2 \times 10^{-3}$ | SH-4 | $8.9 \times 10^{-5}$ | 27 | 3.9 |
| 7 | Reducing agent-1 | $1.2 \times 10^{-3}$ | — | — | 1 | Reducing agent-1 | $1.2 \times 10^{-3}$ | SH-4 | $12.3 \times 10^{-5}$ | 38 | 38 |
| 8 | Reducing agent-1 | $1.2 \times 10^{-3}$ | SH-5 | $7.4 \times 10^{-5}$ | 19 | Reducing agent-1 | $1.2 \times 10^{-3}$ | SH-5 | $7.4 \times 10^{-5}$ | 19 | 1 |
| 9 | Reducing agent-1 | $1.2 \times 10^{-3}$ | SH-5 | $2.5 \times 10^{-5}$ | 6 | Reducing agent-1 | $1.2 \times 10^{-3}$ | SH-5 | $8.9 \times 10^{-5}$ | 24 | 4 |
| 10 | Reducing agent-1 | $1.2 \times 10^{-3}$ | — | — | 1 | Reducing agent-1 | $1.2 \times 10^{-3}$ | SH-5 | $12.3 \times 10^{-5}$ | 33 | 33 |
| 11 | Reducing agent-1 | $1.2 \times 10^{-3}$ | SH-4 | $2.5 \times 10^{-5}$ | 7 | Reducing agent-1 | $1.2 \times 10^{-3}$ | SH-7 | $8.9 \times 10^{-5}$ | 31 | 4.4 |
| 12 | Reducing agent-1 | $1.2 \times 10^{-3}$ | SH-5 | $2.5 \times 10^{-5}$ | 6 | Reducing agent-1 | $1.2 \times 10^{-3}$ | SH-7 | $8.9 \times 10^{-5}$ | 31 | 5.2 |
| 13 | Reducing agent-1 | $1.2 \times 10^{-3}$ | SH-9 | $2.5 \times 10^{-5}$ | 8 | Reducing agent-1 | $1.2 \times 10^{-3}$ | SH-7 | $8.9 \times 10^{-5}$ | 31 | 3.9 |

TABLE 2

| | Front-side Image Forming Layer | | | | | Back-side Image Forming Layer | | | | | Ratio of |
|---|---|---|---|---|---|---|---|---|---|---|---|
| | Reducing Agent | | Nucleator | | | Reducing Agent | | Nucleator | | | Nucleation |
| Sample No. | No. | Addition Amount (mol/m$^2$) | No. | Addition Amount (mol/m$^2$) | Nucleation Property (y/x value) | No. | Addition Amount (mol/m$^2$) | No. | Addition Amount (mol/m$^2$) | Nucleation Property (y/x value) | Property of Front-side to Back-side |
| 14 | R1-3<br>Reducing agent-1 | $1.0 \times 10^{-3}$<br>$0.2 \times 10^{-3}$ | — | — | 31 | Reducing agent-1 | $0.2 \times 10^{-3}$ | SH-7 | $8.9 \times 10^{-5}$ | 31 | 1 |
| 15 | R1-3<br>Reducing agent-1 | $0.3 \times 10^{-3}$<br>$0.9 \times 10^{-3}$ | — | — | 9 | Reducing agent-1 | $0.2 \times 10^{-3}$ | SH-7 | $8.9 \times 10^{-5}$ | 31 | 3.4 |
| 16 | R1-1<br>Reducing agent-1 | $0.3 \times 10^{-3}$<br>$0.9 \times 10^{-3}$ | — | — | 7 | Reducing agent-1 | $0.2 \times 10^{-3}$ | SH-7 | $8.9 \times 10^{-5}$ | 31 | 4.4 |
| 17 | R1-3<br>Reducing agent-1 | $0.8 \times 10^{-3}$<br>$0.4 \times 10^{-3}$ | — | — | 26 | R1-3<br>Reducing agent-1 | $0.8 \times 10^{-3}$<br>$0.4 \times 10^{-3}$ | — | — | 26 | 1 |
| 18 | R1-3<br>Reducing agent-1 | $0.3 \times 10^{-3}$<br>$0.9 \times 10^{-3}$ | — | — | 9 | R1-3 | $1.2 \times 10^{-3}$ | — | — | 45 | 5 |
| 19 | R1-1<br>Reducing agent-1 | $0.3 \times 10^{-3}$<br>$0.9 \times 10^{-3}$ | — | — | 7 | R1-3 | $1.2 \times 10^{-3}$ | — | — | 45 | 6.4 |
| 20 | Reducing agent-1 | $1.2 \times 10^{-3}$ | SH-7 | $2.5 \times 10^{-5}$ | 9 | R1-3<br>Reducing agent-1 | $1.0 \times 10^{-3}$<br>$0.2 \times 10^{-3}$ | — | — | 31 | 3.4 |

Chemical structures of the compounds used in Examples of the invention are shown below.

Tellurium sensitizer C

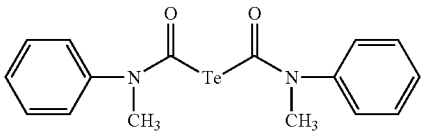

Compound 1 that can be one-electron-oxidized to provide a one-electron oxidation product which releases one or more electrons

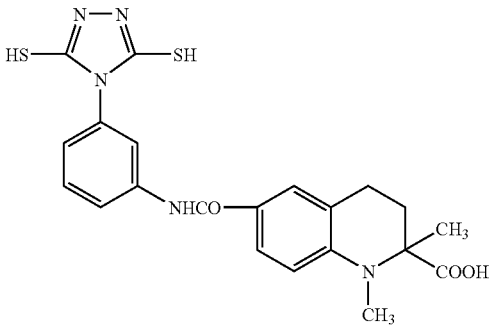

Compound 2 that can be one-electron-oxidized to provide a one-electron oxidation product which releases one or more electrons

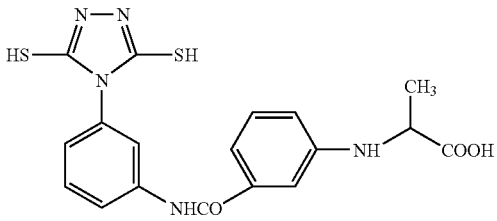

Compound 3 that can be one-electron-oxidized to provide a one-electron oxidation product which releases one or more electrons

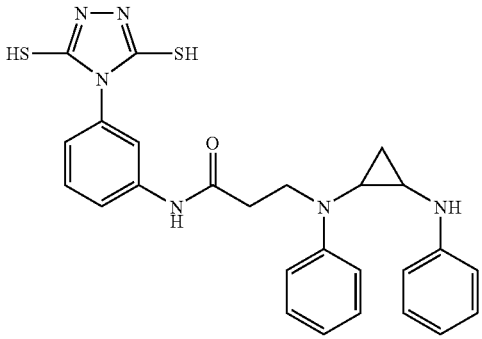

Compound 1 having adsorptive group and reducible group

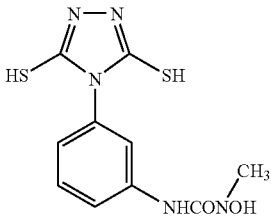

Compound 2 having adsorptive group and reducible group

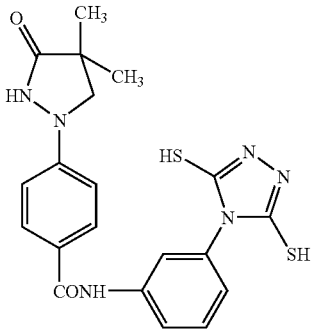

Reducing agent-1

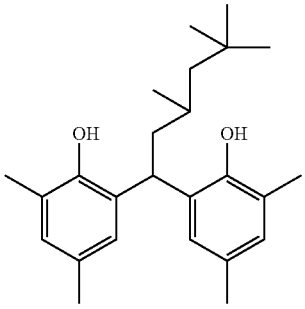

Hydrogen bonding compound-1

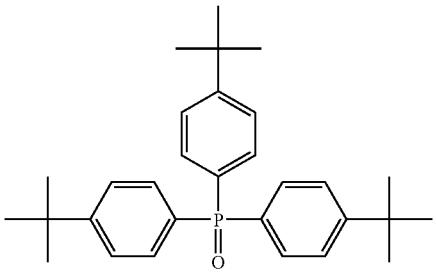

Organic polyhalogen compound-1

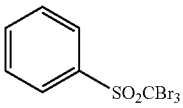

-continued

Organic polyhalogen compound-2

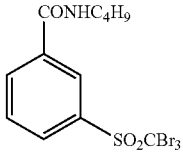

Mercapto compound-1

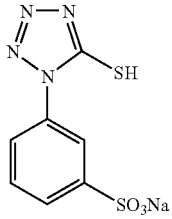

Mercapto compound-2

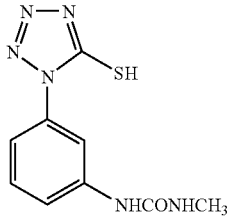

Silver iodide complex-forming agent

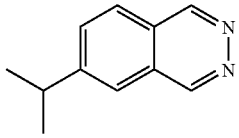

Development accelerator-1

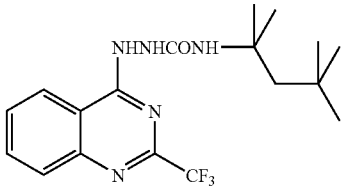

Development accelerator-2

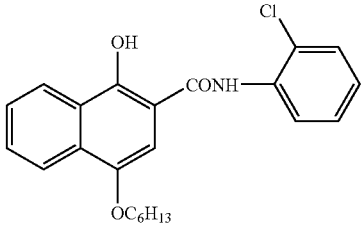

Color-tone-adjusting agent-1

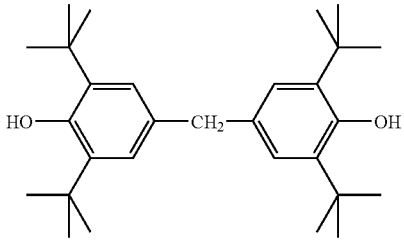

(F-1)

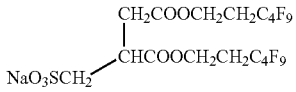

-continued (F-2)

Mixture of

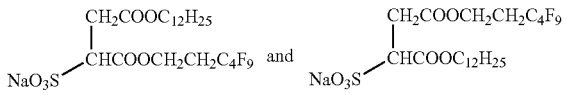

5. Evaluation of Photographic Properties

Thus prepared photothermographic materials were evaluated as follows.

5-1. Preparation

The resulting sample was cut into a half-cut size, and a notch was added according to the usual way. The notch was set so that the observer side being the front-side image forming layer side when the sample was put being the notch at the right upper end.

The obtained sheet was wrapped with the following packaging material under an environment of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$, vapor permeability at 25° C.: 0.10 $g \cdot atm^{-1}m^{-2}day^{-1}$.

5-2. Preparation of Fluorescent Intensifying Screen A (1) Undercoating

A light reflecting layer comprising alumina powder was coated on a polyethylene terephthalate film (support) having a thickness of 250 μm in a similar manner to the Example 4 in JP-A. No.2001-124898. The light reflecting layer which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 101) and 0.5 g of isocyanate compounds (manufactured by Nippon Polyurethane Industry Co., Ltd., trade name: CORONATE A) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 $kgw/cm^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

The emission spectrum of the intensifying screen A was measured by X-ray at 40 kVp and is shown in FIG. 1. The fluorescent intensifying screen A showed an emission having a peak at 390 nm and a narrow half band width.

5-3. Condition of Exposure and Development (Exposure)

Two sheets of the aforementioned fluorescent intensifying screen A were used. The assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E.

(Evaluation of Infectious Development Property of the Back and Front)

Fuji Medical dry laser Imager FM-DP L was used for the thermal developing apparatus, where the temperature of the four panel heaters were set to 112° C.-119° C.-121° C.-121° C. The total time period for thermal development was set to be 24 seconds.

Each sample was conveyed through the thermal developing apparatus at two conditions as follows.

A. The photothermographic material was conveyed so that the backside thereof became in direct contact with the panel heater, and B. the photothermographic material was conveyed so that the front side thereof became in direct contact with the panel heater.

An ultra thin section of a thickness of 0.1 μm was prepared by slicing an undeveloped sample in the direction parallel to the support using a diamond knife. Thus obtained ultra thin section was placed on a mesh and observed with a transmission electron microscope while cooled to a temperature of liquid nitrogen. The number (x) of silver halide grains per unit area were counted therefrom. In a similar manner, an ultra thin section was prepared from the maximum density part of the exposed and thermally developed sample and observed with a transmission electron microscope. The number (y) of developed silver grains per unit area were counted therefrom.

Therefrom, the values y/x corresponding to the above development condition A and B were determined. The nucleation property is higher, the value y/x becomes bigger. Further, the difference in nucleation property of the front side and the backside was determined as the ratio of y/x value of the both sides.

The obtained results are shown in Table 1 and Table 2.

(Evaluation of General Photographic Properties)

Figure 9:
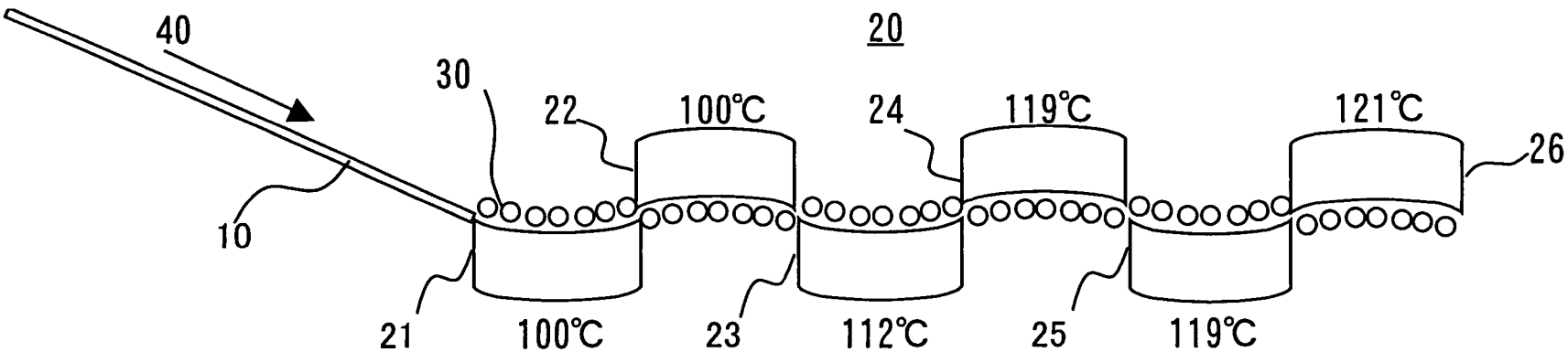
FIG. 9 is a conceptual view of a heating means comprising 6 sets of plate heaters.

As shown in FIG. 9, the thermal developing portion of Fuji Medical dry laser Imager FMP-DP L was modified so that 6 sheets of panel heater were set to be arranged in a staggered form. The photothermographic material was conveyed so that the front side and the backside of the material became in direct contact with the panel heater surface alternatively. The temperature of 6 panel heaters were set to 100° C.-100° C.-12° C.-119° C.-119° C.-121° C. The total time period for passing through the 6 panel heaters was set to be 33 seconds. The above thermal developing apparatus which could heat both sides simultaneously was used for the evaluation of general photographic properties.

Using the photothermographic material having the same photographic properties for both sides when each side was evaluated separately such as Sample No. 1, the modified thermal developing apparatus proved to give the same photographic properties for the both sides by thermal development thereby of the above material.

5-4. Items for Evaluation and Results

General photographic properties of Sample Nos. 1 to 20 were evaluated using the above thermal developing apparatus, by which both sides of the sample were thermally developed simultaneously.

Average gradient: Average gradient is gradient of a straight line connecting the points at fog+(optical density of 0.25) and fog+(optical density of 2.0) on the photographic characteristic curve (i.e., the value equals to tan when the angle between the line and the abscissa is).

Graininess: The sample was subjected to X-ray exposure using a chest phantom image while adjusting the exposure value to give a proper density (D=1.8) for lung field portion. The obtained chest phantom image was evaluated by visual observation with respect to the graininess of overall image and classified into the following criteria such as ○, Δ, and X.

Distinguishability: the imaging characteristics of mediastinum portion of the chest phantom image and the distinguishability of artificial blood vessels were evaluated by visual observation and classified into the following criteria as ◎, ○, Δ, and X.

Color tone of Developed Silver Image: Concerning the color tone of a developed silver image, the overall image was evaluated by visual observation and classified into the following criteria as ○, Δ, and X.

The obtained results are shown in Table 3.

From the results in Table 3, it is revealed that the photothermographic materials of the present invention (Sample Nos. 2, 3, 6, 7, 9 to 13, 15, 16, and 18 to 20) exhibit excellent results in gradation suitable for medical diagnosis, graininess, color tone of a developed silver image, and image distinguishability.

TABLE 3

| Sample | General Photographic Properties | | | | Evaluation of Chest Phantom Image | | | |
|---|---|---|---|---|---|---|---|---|
| No. | Fog | Sensitivity | Gradation | Dmax | Graininess | Color Tone of Developed Silver Image | Distinguishability of Mediastinum Portion | Distinguishability of Lung Field Portion |
| 1 | 0.15 | 100 | 3.4 | 2.8 | Δ | × | × | Δ |
| 2 | 0.15 | 105 | 2.8 | 3.4 | ○ | ○ | ◎ | ◎ |
| 3 | 0.16 | 110 | 2.6 | 3.2 | ○ | ○ | ◎ | ◎ |
| 4 | 0.14 | 15 | — | 0.5 | ○ | ○ | × | × |
| 5 | 0.17 | 85 | 3.8 | 2.4 | Δ | × | × | Δ |
| 6 | 0.17 | 90 | 3.2 | 3.2 | ○ | ○ | ○ | ◎ |
| 7 | 0.18 | 95 | 3 | 3 | ○ | ○ | ○ | ○ |
| 8 | 0.18 | 75 | 4 | 2 | Δ | × | × | Δ |
| 9 | 0.18 | 80 | 3.2 | 3 | ○ | ○ | ○ | ◎ |
| 10 | 0.19 | 85 | 3 | 2.8 | ○ | ○ | ○ | ○ |
| 11 | 0.16 | 98 | 3 | 3.3 | ○ | ○ | ○ | ◎ |
| 12 | 0.17 | 92 | 3 | 3.2 | ○ | ○ | ○ | ◎ |
| 13 | 0.17 | 102 | 2.8 | 3.4 | ○ | ○ | ◎ | ◎ |
| 14 | 0.18 | 110 | 3.5 | 3.2 | Δ | × | × | Δ |
| 15 | 0.17 | 108 | 3 | 3.3 | ○ | ○ | ○ | ◎ |
| 16 | 0.18 | 112 | 2.9 | 3.4 | ○ | ○ | ◎ | ◎ |
| 17 | 0.19 | 108 | 3.4 | 3.1 | Δ | × | × | Δ |
| 18 | 0.17 | 105 | 3.1 | 3.4 | ○ | ○ | ○ | ◎ |
| 19 | 0.18 | 114 | 3 | 3.4 | ○ | ○ | ○ | ◎ |
| 20 | 0.17 | 105 | 3.1 | 3.2 | ○ | ○ | ○ | ◎ |

Fog: The density of the unexposed part is expressed as fog.

Sensitivity: Sensitivity is the inverse of the exposure value necessary to give a density of fog+(optical density of 1.0). The sensitivities are shown in relative value, detecting the sensitivity of Sample No. 1 to be 100.

Dmax: Dmax is a maximum density obtained by increasing the exposure values.

EXAMPLE 2

The thermal developing apparatus for heating both sides simultaneously in Example 1 was modified so that the temperature of the 6 panel heaters were set to 70° C.-110° C.-112° C.-119° C.-119° C.-121° C. The total time period for passing through the 6 panel heaters was set to be 36 seconds. The above thermal developing apparatus was used for evaluation of general photographic properties of the processed samples after thermally developing both sides simultaneously.

Using the photothermographic material having the same photographic properties for both sides when each side was evaluated separately such as Sample No. 1, thermal development was performed with the above thermal developing apparatus. The above thermal developing apparatus gave the photographic properties for both sides where one side which was not contacted with the first panel heater of 70° C. had sensitivity relatively higher by 20% compared to the other side.

Under the thermal developing condition described above, thermal development was performed with the above thermal developing apparatus where Sample Nos. 1 to 10 were inserted to the apparatus so that the backsides thereof being not contacted with the first panel heater of 70° C. General photographic properties of the processed samples were evaluated after thermally developing both sides simultaneously.

As a result, it is revealed that, even in the above condition, the samples of the present invention exhibit excellent results in gradation suitable for medical diagnosis, graininess, color tone of a developed silver image, and image distinguishability.

EXAMPLE 3

Using the thermal developing apparatus used for the evaluation condition of each single side of samples in Example 1, the following thermal developing process was performed. Fuji Medical dry laser Imager FM-DP L was used as the thermal developing apparatus where the temperature of 4 panel heaters were set to 100° C.-117° C.-119° C.-121° C. The total time period for thermal development was set to be 30 seconds. Thermal development of a single side was performed with the said thermal developing apparatus where Sample Nos. 1 to 10 were inserted to the apparatus so that the backsides thereof being not contacted with the heating plate. General photographic properties of the processed samples were evaluated after thermally developing one side.

As a result, it is revealed that, even in the above condition, samples of the present invention exhibit excellent results in gradation suitable for medical diagnosis, graininess, color tone of a developed silver image, and image distinguishability.

EXAMPLE 4

1. Undercoating on the Support

The following undercoating was performed on the support of Example 1.

1)Preparations of Coating Solution for Undercoat Layer

Formula (1) (for first layer of undercoat layers)

| | |
|---|---|
| Styrene-butadiene copolymer latex (solid content of 40% by weight, styrene/butadiene weight ratio = 68/32 | 158 g |
| 2,4-Dichloro-6-hydroxy-S-triazine sodium salt (8% by weight aqueous solution) | 20 g |
| Sodium laurylbenzenesulfonate (1% by weight aqueous solution) | 10 mL |
| distilled water | 854 mL |

Formula (2) (for second layer of undercoat layers)

| | |
|---|---|
| Gelatin | 89.2 g |
| METOLOSE TC-5 manufactured by Shin-Etsu Chemical Co., Ltd. (2% by weight aqueous solution) | 8.6 g |
| MP-1000 manufactured by Soken Chemical Co., Ltd. | 0.01 g |
| Sodium dodecylbenzenesulfonate (1% by weight aqueous solution) | 10 mL |
| NaOH (1% by weight) | 6 mL |
| Proxel (manufactured by Imperial Chemical Industries PLC) | 1 mL |
| distilled water | 805 mL |

2) Undercoating

Both surfaces of the biaxially tentered polyethylene terephthalate support having the thickness of 175 μm were subjected to the corona discharge treatment as described above. Thereafter, the aforementioned formula (1) of the coating solution for the undercoat was coated with a wire bar so that the amount of wet coating became 5.7 mL/m$^2$, and dried at 180° C. for 5 minutes. Then, the aforementioned formula (2) of the coating solution for the undercoat was coated with a wire bar so that the amount of wet coating became 7.7 mL/m$^2$, and dried at 180° C. for 5 minutes. Thus, an undercoated support was produced.

2. Crossover Cut Layer, Image Forming Layer, Intermediate Layer, and Surface Protective Layer 2-1. Preparations of Coating Materials 1) Preparation of Dispersion Solution of Solid Fine Particles of Base Precursor 2.5 kg of base precursor-1,300 g of a surfactant (trade name: DEMOL N, manufactured by Kao Corporation), 800 g of diphenyl sulfone, and 1.0 g of benzisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process for dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor becomes 25% by weight, and filtrated (with a polypropylene filter having a mean fine pore diameter of 3 μm) for eliminating dust to put into practical use.

2) Preparation of Dispersion Solution of Solid Fine Particle of Orthochromatic Thermal Bleaching Dye Orthochromatic thermal bleaching dye-1 (λ max=566 nm) described in JP-A No. 11-231457 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed solution was subjected to dispersion with 0.5 mm zirconia beads using a horizontal sand mill (UVM-2: manufactured by AIMEX Co., Ltd.).

The dispersion was dispersed until the ratio of the optical density at 650 nm and the optical density at 750 nm for the spectral absorption of the dispersion ($D_{650}/D_{750}$) becomes 5.0 or higher upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

3) Preparation of Silver Halide Emulsion

<Preparation of Tabular Silver Iodobromide Emulsion 1B>

(Grain Formation)

1178 mL of an aqueous solution prepared by dissolving 0.8 g of potassium bromide and 3.2 g of acid-treated gelatin having an average molecular weight of 20,000 was stirred while maintaining the temperature at 35° C. An aqueous solution containing 1.6 g of silver nitrate, an aqueous solution containing 1.16 g of potassium bromide, and an aqueous solution containing 1.1 g of acid-treated gelatin having an average molecular weight of 20,000 were added to the mixture over a period of 45 seconds by the method of triple jet addition. The concentration of the silver nitrate solution was 0.3 mol/L. Thereafter, the temperature of the mixture was increased to 76° C. over a period of 20 minutes. And then an aqueous solution containing 26 g of succinated gelatin having an average molecular weight of 100,000 was added thereto. An aqueous solution containing 209 g of silver nitrate and the aqueous potassium bromide solution were added by controlled double jet method at an accelerated flow rate over a period of 75 minutes while keeping the pAg at 8.0. For the stage where the grain growth reached to an equivalent to 30 mol % to 90 mol % with respect to total silver amount, silver iodide fine grain having a diameter of 0.03 μm was concurrently added to make the iodide content to a concentration of 6 mol %. The entire amount of potassium hexachloroiridate (III) was added thereto to give a concentration of $2\times10^{-5}$ mol % per 1 mol of silver at 30 minutes after starting the addition of the aqueous silver nitrate solution and the aqueous potassium bromide solution. After addition of gelatin having an average molecular weight of 100,000, the mixture was desalted according to the conventional method. Thereafter, the mixture was dispersed by adding gelatin having an average molecular weight of 100,000. The pH and pAg of the resulting emulsion was then adjusted to 5.8 and 8.0 at 40° C., respectively. Thus prepared emulsion contained 1 mol of silver and 40 g of gelatin per 1 kg of emulsion.

(Chemical Sensitization)

The emulsion prepared above was stirred and subjected to chemical sensitization while keeping the temperature at 56° C. Thiosulfonate compound-1 set forth below was added in an amount of $10^{-4}$ mol per 1 mol of silver halide, and then silver iodide grain having a diameter of 0.03 μm was added thereto in an amount of 0.15 mol %, based on the total silver amount. Three minutes later, thiourea dioxide was added in an amount of $1\times10^{-6}$ mol per 1 mol of silver and was subjected to reduction sensitization while keeping the temperature for 22 minutes. Thereafter, 4-hydroxy-6-methyl-1,3,3a,7-tetrazaindene was added in an amount of $3\times10^{-4}$ mol equivalent per 1 mol of silver halide, then the dispersion of sensitizing dye-3 was added in an amount of $1\times10^{-3}$ mol equivalent per 1 mol of silver halide with respect to sensitizing dye-3, and sensitizing dye-1 and -2 were added in an amount of $1\times10^{-4}$ mol equivalent per 1 mol of silver halide, respectively. Furthermore, calcium chloride was added thereto.

Sequentially, sodium thiosulfate and selenium compound-1 were added in an amount of $6\times10^{-6}$ mol equivalent, $4\times10^{-6}$ mol equivalent per 1 mol of silver halide, respectively. After the addition, chloroauric acid was added in an amount of $2\times10^{-3}$ mol equivalent per 1 mol of silver halide. Further, nucleic acid (RNA-F, trade name, available from SanyoKokusaku Pulp Co., ltd.) was added thereto in an amount of 67 mg equivalent per 1 mol of silver halide. 40 minutes later, water-soluble mercapto compound-1 was added in an amount of $1\times10^{-4}$ mol equivalent per 1 mol of silver halide, and the mixture was then cooled to 35° C. Thereby, chemical sensitization was finished.

(Shape of Obtained Grains)

The obtained tabular silver halide grains were tabular silver iodobromide grains having an average iodide content of 3.75 mol %, and 30 mol % to 90 mol % of total silver amount had an iodide content of 6 mol %. The shape of the prepared grains was observed by an electron microscope. The grains had a mean projected area equivalent diameter of 1.004 μm, a mean equivalent spherical diameter of 0.420 μm, a mean grain thickness of 0.049 μm, a mean aspect ratio of 21, and a variation coefficient of a projected area equivalent diameter distribution of 21%.

<Preparation of Emulsion 1B for Coating Solution>

The silver halide emulsion 1B was dissolved and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the emulsion for a coating solution.

4) Preparation of Dispersion of Non-Photosensitive Organic Silver Salt

A solution prepared by dissolving 85 g of lime processed gelatin, 25 g of phthalated gelatin in 2 liters of ion-exchange water in a reaction vessel and stirred well (solution A), a solution containing 185 g of benzotriazole and 1405 mL of ion-exchange water (solution B), and 680 g of 2.5 mol/L sodium hydroxide solution were prepared. The solution of the reaction vessel was adjusted to keep the pAg and pH at 7.25 and 8.0, respectively, if required, by adding solution B and 2.5 mol/L sodium hydroxide solution. And the temperature of the mixture was kept at 36° C.

Solution C containing 228.5 g of silver nitrate and 1222 mL of ion-exchange water was added into the reaction vessel at an accelerated flow rate (flow rate: $16(1+0.002t^2)$ mL/min, wherein t represents time expressed in minute). And then solution B was concurrently added to keep the pAg at 7.25. When the addition of solution C was finished, the process was stopped. And then, solution D containing 80 g of phthalated gelatin and 700 mL of ion-exchange water was added thereto at 40° C., while stirring the resulting reaction solution mixture, the pH of the mixture was adjusted at 2.5 by adding 2 mol/L sulfuric acid to aggregate silver salt emulsion. The aggregates were washed well twice by 5 liters of ion-exchange water. Thereafter the pH and pAg were adjusted to 6.0 and 7.0, respectively, by adding 2.5 mol/L sodium hydroxide solution and solution B to redisperse the aggregates. The obtained silver salt dispersion contained fine crystals of silver salt of benzotriazole.

<Shape of Particles>

The shape of the obtained fine particles of silver salt of benzotriazole was evaluated by an electron microscope. The particles were flake shaped crystals having a mean equivalent projected area diameter of 0.05 μm, a long axis length of 0.2 μm, a short axis length of 0.05 μm, a grain thickness of 0.05 μm, and a variation coefficient of an equivalent projected area diameter distribution of 21%.

5) Preparation of Toner Dispersion

The dispersions of compound Nos. T-59 and T-3 used for toner dispersions were prepared as follows.

4 g of triazole compound No. T-59 (5-hydroxymethyl-4-benzyl-1,2,4-triazole-3-thiol), 10% by weight polyvinyl pyrrolidone solution and 18 mL of ion-exchange water were thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 05 mm for 3 hours. 15 g of 30% by weight lime processed gelatin was added to the above dispersion and the mixture was heated to 50° C. to obtain fine particle dispersion of mercaptotriazole No. T-59.

Dispersion of triazole compound No. T-3 (4-benzyl-1,2,4-triazole-3-thiol) was prepared in a similar manner.

6) Preparations of Various Solutions

<Preparation of Reducing Agent Solution>

A 10% by weight aqueous solution of ascorbic acid was prepared.

<Preparations of Aqueous Solution of Mercapto Compound>

Mercapto compound-1 (113-sulfophenyl)-5-mercaptotetrazole sodium salt) in an amount of 7 g was dissolved in 993 g of water to give a 0.7% by weight aqueous solution.

Mercapto compound-2 (1-(3-methylureidophenyl)-5-mercaptotetrazole) in an amount of 20 g was dissolved in 980 g of water to give a 2.0% by weight aqueous solution.

<Preparations of Thermal Solvent Solution>

A 5% by weight aqueous solution of 1,3-dimethylurea and a 10% by weight aqueous solution of succinimide were prepared.

2-2. Preparations of Coating Solution

1) Preparation of Coating Solution for Crossover Cut Layer 17 g of polyvinyl alcohol PVA-205 (manufactured by Kuraray Co., Ltd.), 9.6 g of polyacrylamide, 70 g of the dispersion solution of the solid fine particles of the base precursor, 56 g of the dispersion solution of the solid fine particles of the orthochromatic thermal bleaching dye, 0.03 g of benzisothiazolinone, 2.2 g of sodium polystyrenesulfonate, and 844 mL of water were admixed to give a coating solution for the crossover cut layer.

The coating solution for crossover cut layer was fed to the coating station by controlling the flow speed so that the coating solution for the crossover layer gave the coating amount of solid content of orthochromatic thermal bleaching dye of 0.04 g/m$^2$.

2) Preparation of Coating Solution for Image Forming Layer

To the dispersion of the non-photosensitive organic silver salt obtained as described above in an amount of 1000 g were serially added the aqueous solution of gelatin, the pigment-1 dispersion, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound aqueous solutions, the thermal solvent aqueous solution, and the nucleator dispersion prepared similar to Example 1. The emulsion for coating solution 1B was added thereto followed by thorough mixing just prior to the coating, which was fed directly to a coating die.

2-3. Coating

On one side of the support, simultaneous overlaying coating by a slide bead coating method was subjected in order of the crossover cut layer, front-side image forming layer, intermediate layer same as Example 1, first layer of the surface protective layers same as Example 1, and second layer of the surface protective layers same as Example 1, starting from the undercoated face. Subsequently on the other side of the support, similarly, simultaneous overlaying coating was subjected in order of the crossover cut layer, back-side image forming layer, intermediate layer same as Example 1, first layer of the surface protective layers same as Example 1, and second layer of the surface protective layers same as Example 1, and thus Sample Nos. 21 to 30 of photothermographic materials were produced. In this method, the temperature of the coating solution was adjusted to 31° C. for the image forming layer and intermediate layer, to 36° C. for the first layer of the surface protective layers, and to 37° C. for the second layer of the surface protective layers.

The amount of coated silver was 0.862 g/m$^2$ per one side, with respect to the sum of organic silver salt and silver halide. The compositions of the front-side image forming layer and the back-side image forming layer for each sample are shown in Table 4.

The total coating amount of each compound (g/m$^2$) for the image forming layers of both sides is as follows.

Concerning the coating amounts of the front side and the backside, the coating amount of each compound is distributed so that the ratio become the same as the ratio of the amounts of coated silver in each side.

| | |
|---|---|
| Non-photosensitive organic silver salt (on the basis of Ag content) | 0.686 |
| Gelatin | 3.5 |
| Pigment (C.I. Pigment Blue 60) | 0.036 |
| Triazole compound No. T-59 | 0.04 |
| Triazole compound No. T-3 | 0.04 |
| Ascorbic acid | 1.1 |
| Nucleator (kind and amount) | (see Table 4) |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Thermal solvent: 1,3-dimethlyurea | 0.24 |
| Thermal solvent: succinimide | 0.08 |
| Silver halide (on the basis of Ag content) | 0.175 |

Chemical structures of the compounds used in Examples of the invention are shown below.

Base precursor-1

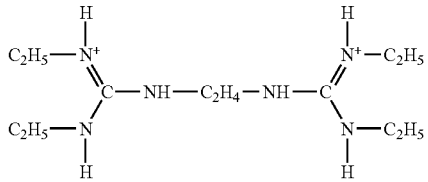

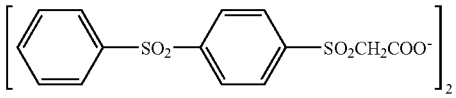

Orthochromatic thermal bleaching dye-1

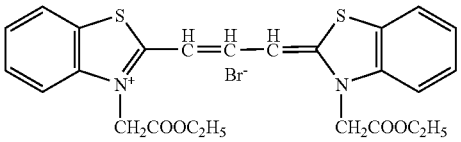

Thiosulfonate compound-1

$C_2H_5SO_2SNa$

Selenium compound-1

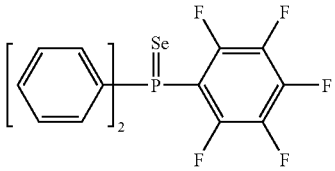

Water-soluble mercapto compound-1

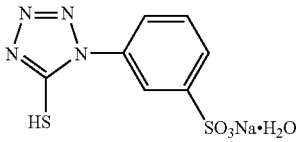

Sensitizing dye-1

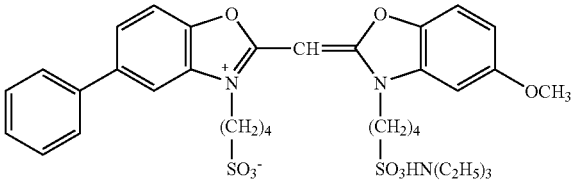

Sensitizing dye-2

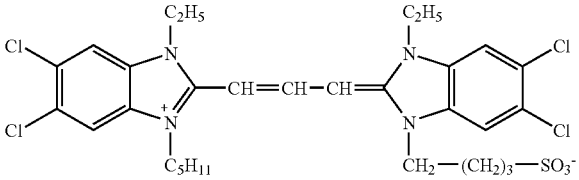

Sensitizing dye-3

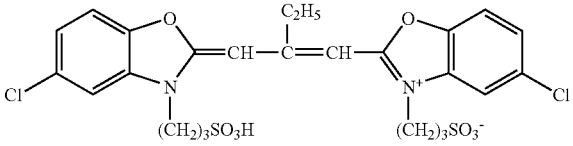

3. Evaluation

Evaluation was performed in a similar manner to that in Example 1 except that using X-ray Orthochomatic screen HG-M (using as fluorescent substance a terbium activated gadolinium oxysulfide fluorescent substance, emission peak wavelength of 545 nm) produced by Fuji Photo Film Co., Ltd., as a fluorescent screen.

As a result, it is revealed that the samples of the present invention (Sample Nos. 22, 23, 26, 27, 29, and 30) exhibit excellent results in gradation suitable for medical diagnosis, graininess, color tone of a developed silver image, and image distinguishability.

TABLE 4

| | Front-side Image Forming Layer | | Back-side Image Forming Layer | |
|---|---|---|---|---|
| Sample No. | Nucleator No. | Addition Amount ($mol/m^2$) | Nucleator No. | Addition Amount ($mol/m^2$) |
| 21 | SH-7 | $7.4 \times 10^{-5}$ | SH-7 | $7.4 \times 10^{-5}$ |
| 22 | SH-7 | $2.5 \times 10^{-5}$ | SH-7 | $8.9 \times 10^{-5}$ |
| 23 | — | — | SH-7 | $12.3 \times 10^{-5}$ |
| 24 | — | — | — | — |
| 25 | SH-4 | $7.4 \times 10^{-5}$ | SH-4 | $7.4 \times 10^{-5}$ |
| 26 | SH-4 | $2.5 \times 10^{-5}$ | SH-4 | $8.9 \times 10^{-5}$ |
| 27 | — | — | — | $12.3 \times 10^{-5}$ |
| 28 | SH-5 | $7.4 \times 10^{-5}$ | SH-5 | $7.4 \times 10^{-5}$ |
| 29 | SH-5 | $2.5 \times 10^{-5}$ | SH-5 | $8.9 \times 10^{-5}$ |
| 30 | — | — | SH-5 | $12.3 \times 10^{-5}$ |

EXAMPLE 5

1. Preparation of PET Support

Both sides of the biaxially tentered polyethylene terephthalate support having the thickness of 175 μm were subjected to undercoating respectively. Thus, an undercoated support was produced.

2. Preparations of Coating Material

1) Photosensitive Silver Halide Emulsion

<Preparation of Silver Halide Emulsion 2A1 (Tabular AgI Host Grain of 0.42 μm)>

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The silver halide emulsion 2A1 was a pure silver iodide emulsion, and the obtained silver halide grains had a mean projected area equivalent diameter of 0.93 μm, a variation coefficient of a projected area equivalent diameter distribution of 17.7%, a mean thickness of 0.057 μm and a mean aspect ratio of 16.3. Tabular grains having an aspect ratio of 2 or more occupied 80% or more of the total projected area. The mean equivalent spherical diameter of the grains was 0.42 μm. 30% or more of the silver iodide existed in γ phase from the result of powder X-ray diffraction analysis.

<Preparation of Silver Halide Emulsion 2A2 (Epitaxial Grain of 0.42 μm)>

1 mol of the silver iodide tabular grains prepared in the silver halide emulsion 2A1 was added to the reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation.

Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $85\times10^{-3}$ mol per 1 mol of silver were added to produce silver halide emulsion 2A2.

<Preparation of Silver Halide Emulsion 2B 1 (Tabular AgI Host Grain of 0.71 μm)>

Preparation of silver halide emulsion 2B 1 was conducted in a similar manner to the process in the preparation of the silver halide emulsion 2A1 except that adequately changing the addition amount of a 5% by weight methanol solution of 2,2'-ethylene dithio)diethanol, the temperature at grain formation step, and the time for adding the solution A. The silver halide emulsion 2B 1 was a pure silver iodide emulsion. The obtained silver halide grains had a mean projected area equivalent diameter of 1.384 μm, a variation coefficient of a projected area equivalent diameter distribution of 19.7%, a mean thickness of 0.125 μm and a mean aspect ratio of 11.1. Tabular grains having an aspect ratio of 2 or more occupied 80% or more of the total projected area. The mean equivalent spherical diameter of the grains was 0.71 μm. 15% or more of the silver iodide existed in γ phase from the result of powder X-ray diffraction analysis.

<Preparation of Silver Halide Emulsion 2B2 (Epitaxial Grain of 0.71 μm)>

Preparation of silver halide emulsion 2B2 was conducted in a similar manner to the process in the preparation of silver halide emulsion 2A2, except that using silver halide emulsion 2B 1. Thereby, silver halide emulsion 2B2 containing 10 mol % of epitaxial silver bromide was prepared.

<Preparation of Silver Halide Emulsion 2C1 (Tabular AgI Host Grain of 0.30 μm)>

Preparation of silver halide emulsion 2C1 was conducted in a similar manner to the process in the preparation of the silver halide emulsion 2A1 except that adequately changing the addition amount of a 5% by weight methanol solution of 2,2'-(ethylene dithio)diethanol, the temperature at grain formation step, and the time for adding the solution A. The silver halide emulsion 2C1 was a pure silver iodide emulsion. The obtained silver halide grains had a mean projected area equivalent diameter of 0.565 μm, a variation coefficient of a projected area equivalent diameter distribution of 18.5%, a mean thickness of 0.056 μm and a mean aspect ratio of 10.0. Tabular grains having an aspect ratio of 2 or more occupied 80% or more of the total projected area. The mean equivalent spherical diameter of the grains was 0.30 μm. 90% or more of the silver iodide existed in γ phase from the result of powder X-ray diffraction analysis.

<Preparation of Silver Halide Emulsion 2C2 (Epitaxial Grain of 0.30 μm)>

Preparation of silver halide emulsion 2C2 was conducted in a similar manner to the process in the preparation of silver halide emulsion 2A2, except that using silver halide emulsion 2C1. Thereby, silver halide emulsion 2C2 containing 10 mol % of epitaxial silver bromide was prepared.

<Preparation of Emulsion 2A, 2B, and 2C for Coating Solution>

Each of the silver halide emulsion 2A2, 2B2, and 2C2 was dissolved respectively, and thereto was added benzothiazolium iodide at $7\times10^{-3}$ mol per 1 mol of silver with a 1% by weight aqueous solution. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide. Thereafter, as "a compound having an adsorptive group and a reducible group", the compound Nos. 1 and 2 were added respectively in an amount of $8\times10^{-3}$ mol per 1 mol of silver halide. Further, water was added thereto to give the content of silver halide of 15.6 g in terms of silver, per 1 liter of the emulsion for a coating solution.

2) Other Additives

The dispersion A of silver salt of fatty acid, the reducing agent-1 dispersion, the hydrogen bonding compound-1 dispersion, the development accelerator-1 dispersion, the development accelerator-2 dispersion, the color-tone-adjusting agent-1 dispersion, the organic polyhalogen compound-1 dispersion, the organic polyhalogen compound-2 dispersion, the silver iodide complex-forming agent (compound No. 22) solution, the SBR latex solution, the mercapto compound-1 aqueous solution, and the mercapto compound-2 aqueous solution, the pigment-1 dispersion, and the nucleator dispersion were prepared similar to Example 1.

3. Preparations of Coating Solution

1) Preparation of Coating Solution for Crossover Cut layer

It was done similar to Example 1.

2) Preparation of Coating Solution for Image Forming Layer

To the dispersion of silver salt of fatty acid A in an amount of 1000 g and 276 mL of water were serially added the organic polyhalogen compound-1 dispersion, the organic polyhalogen compound-2 dispersion, the SBR latex solution, the reducing agent-1 dispersion, the nucleator (compound No. SH-7) dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the silver halide emulsion for coating solution (kind and amount are shown in Table 5) was added thereto in an amount of 0.25 mol per 1 mol of silver salt of fatty acid with respect to the amount of silver, followed by thorough mixing just prior to the coating, which is fed directly to a coating die.

3) Preparation of Coating Solution for Intermediate Layer

It was done similar to Example 1.

4) Preparation of Coating Solution for First Layer of Surface Protective Layers

It was done similar to Example 1.

5) Preparation of Coating Solution for Second Layer of Surface Protective Layers It was done similar to Example 1.

4. Preparations of Photothermographic Material-101 to -109

On both sides of the support, simultaneous overlaying coating by a slide bead coating method was subjected in order of the crossover cut layer, image forming layer, intermediate layer, first layer of the surface protective layers, and second layer of the surface protective layers, starting from the undercoated face. The composition of silver halide emulsion used in each side is shown in Table 5.

The total amount of coated silver of front side and backside was 1.722 g/m$^2$ with respect to the sum of organic silver salt and silver halide. The ratio of the amount of coated silver in the front side and the backside is shown in Table 5.

The total coating amount of each compound (g/m$^2$) for the image forming layers of both sides is as follows.

The coating amount of each compound is distributed among the front side and the backside so that the ratio become the same as the ratio of the amounts of coated silver in each side.

| | |
|---|---|
| Silver salt of fatty acid | 5.70 |
| Organic polyhalogen compound-1 | 0.056 |
| Organic polyhalogen compound-2 | 0.188 |
| Silver iodide complex-forming agent | 0.92 |
| SBR latex | 10.4 |
| Reducing agent-1 | 0.92 |
| Nucleator SH-7 | 0.036 |
| Hydrogen bonding compound-1 | 0.30 |
| Development accelerator-1 | 0.010 |
| Development accelerator-2 | 0.070 |
| Color-tone-adjusting agent-1 | 0.004 |
| Mercapto compound-1 | 0.002 |
| Mercapto compound-2 | 0.006 |
| Silver halide (on the basis of Ag content) | 0.350 |

Conditions for coating and drying were similar to Example 1.

Thus prepared photothermographic material had a matt degree of 550 seconds as Beck's smoothness. In addition, measurement of the pH of the film surface gave the result of 6.0.

TABLE 5

| | Front-side | | | | Back-side | | | | Difference between Front-side and Back-side | |
|---|---|---|---|---|---|---|---|---|---|---|
| | | | | | | | | | Difference | |
| Sample No. | Silver Halide No. | Coating Amount | Sensitivity ($S_1$) | Dmax1 | Silver Halide No. | Coating Amount | Sensitivity ($S_2$) | Dmax2 | in Sensitivity | Difference in Dmax |
| 101 | A | 50 | 100 | 1.5 | A | 50 | 100 | 1.5 | 0 | 0 |
| 102 | B | 50 | 483 | 0.8 | B | 50 | 483 | 0.8 | 0 | 0 |
| 103 | C | 50 | 36 | 2.4 | C | 50 | 36 | 2.4 | 0 | 0 |
| 104 | B/C (Ag molar ratio: 50/50) | 50 | 250 | 1.2 | B/C (Ag molar ratio: 50/50) | 50 | 250 | 1.2 | 0 | 0 |
| 105 | A/C (Ag molar ratio: 50/50) | 50 | 75 | 1.2 | A/C (Ag molar ratio: 50/50) | 50 | 75 | 1.2 | 0 | 0 |
| 106 | C | 50 | 36 | 2.4 | B | 50 | 483 | 0.8 | 1.1 | 1.6 |
| 107 | C | 50 | 36 | 2.4 | B/C (Ag molar ratio: 50/50) | 50 | 250 | 1.2 | 0.84 | 1.2 |
| 108 | C | 50 | 36 | 2.4 | A | 50 | 100 | 1.5 | 0.44 | 0.9 |
| 109 | C | 50 | 36 | 2.4 | A/C (Ag molar ratio: 50/50) | 50 | 75 | 1.2 | 0.32 | 1.2 |

5. Evaluation of Photographic Properties

Thus prepared photothermographic material was evaluated as follows.

1) Preparation

Each sample was cut into a half-cut size, and a notch was added according to the usual way, similar to Example 1. The obtained sheet was wrapped with the moisture proofing-packaging material and stored for 2 weeks at an ambient temperature.

2) Condition of Exposure and Development

Similar to Example 1, the photothermographic material was subjected to X-ray exposure using two sheets of fluorescent intensifying screen A and thermal development.

Fuji Medical dry laser Imager FM-DP L was used for the thermal developing apparatus, where the temperature of the four panel heaters were set to 112° C.-119° C.-121° C.-121° C. The total time period for thermal development was set to be 24 seconds.

Each sample was conveyed through the thermal developing apparatus at two conditions as follows.

A. The photothermographic material was conveyed so that the backside thereof became in direct contact with the panel heater, and B. the photothermographic material was conveyed so that the front side thereof became in direct contact with the panel heater.

3) Evaluation of Photographic Properties

<Evaluation of Photographic Properties of Each Image Forming Layer>

Evaluation of Front Side: The sample was thermally developed at the condition A described above, and the coated layer of the backside was removed to obtain a new sample. Density of the resulting image was measured and a photographic characteristic curve was made to evaluate photographic properties.

Evaluation of Backside: The sample was thermally developed at the condition B described above, and the coated layer of the front side was removed to obtain a new sample. Density of the resulting image was measured and a photographic characteristic curve was made to evaluate photographic properties.

Sensitivity of each layer is shown as the inverse of the exposure value necessary to give a density of fog+(optical density of 1.0). (Sensitivity of the front-side image forming layer is expressed by $S_1$ and sensitivity of the back-side image forming layer is expressed by $S_2$.) As for Dmax, maximum density of the front side is expressed by $Dmax_1$ and maximum density of the backside is expressed by $Dmax_2$. The sensitivities and Dmaxs are shown in relative value, detecting the values of Sample No. 101 to be 100. Further, difference in sensitivity of front side and backside is shown in a logarithmic value ($\Delta S=\log(S_2/S_1)$). Difference in Dmax is shown in absolute value ($\Delta Dmax=Dmax_2-Dmax_1$).

The obtained results are shown in Table 5.

<Evaluation of General Photographic Properties>

As shown in FIG. 9, the thermal developing portion of Fuji Medical dry laser Imager FM-DP L was modified so that 6 sheets of panel heater were arranged to have a staggered form. The photothermographic material was conveyed so that front side and the backside of the material became in direct contact with the panel heater surface alternatively. The temperature of 6 panel heaters were set to 100° C.-100° C.-112° C.-119° C.-119° C.-121° C. The total time period for passing through the 6 panel heaters was set to be 33 seconds. The above thermal developing apparatus which could heat both sides simultaneously was used for the evaluation of general photographic properties.

Using the photothermographic material having the same photographic properties for both sides when each side was evaluated separately such as Sample No. 101, the modified thermal developing apparatus proved to give the same photographic properties for the both sides by thermal development thereby of the above material.

General photographic properties of Sample Nos. 101 to 109 were evaluated using the above thermal developing apparatus, by which both sides of the sample were thermally developed simultaneously.

The items of evaluation were similar to Example 1. However, sensitivities are shown in relative value, detecting the sensitivity of Sample No. 101 to be 100.

The obtained results are shown in Table 6.

From the results in Table 6, it is revealed that the photothermographic materials of the present invention (Sample Nos. 106 to 109) exhibit excellent results in gradation suitable for medical diagnosis, graininess, color tone of a developed silver image, and image distinguishability.

TABLE 6

| Sample | General Photographic Properties | | | | Evaluation of Chest Phantom Image | | | |
|---|---|---|---|---|---|---|---|---|
| No. | Fog | Sensitivity | Gradation | Dmax | Graininess | Color Tone of Developed Silver Image | Distinguishability of Mediastinum Portion | Distinguishability of Lung Field |
| 101 | 0.15 | 100 | 4.0 | 3.0 | Δ | × | Δ | Δ |
| 102 | 0.17 | 483 | 3.8 | 1.6 | × | × | Δ | × |
| 103 | 0.14 | 36 | 4.3 | 4.8 | Δ | × | × | Δ |
| 104 | 0.17 | 250 | 2.2 | 2.4 | ○ | Δ | Δ | × |
| 105 | 0.15 | 75 | 2.4 | 2.4 | ○ | Δ | Δ | × |
| 106 | 0.14 | 261 | 2.6 | 3.2 | ○ | ○ | ⊙ | ⊙ |
| 107 | 0.14 | 150 | 2.8 | 3.6 | ○ | ○ | ⊙ | ⊙ |
| 108 | 0.15 | 75 | 3.0 | 3.9 | ○ | ○ | ⊙ | ⊙ |
| 109 | 0.15 | 70 | 3.2 | 3.6 | ○ | ○ | ⊙ | ⊙ |

EXAMPLE 6

The thermal developing apparatus for heating both sides simultaneously in Example 5 was modified so that the temperature of the 6 panel heaters were set to 70° C.-110° C.-112° C. -119° C.-119° C.-121° C. The total time period for passing through the 6 panel heaters was set to be 36 seconds. The above thermal developing apparatus was used for evaluation of general photographic properties of the processed samples after thermally developing both sides simultaneously.

Using the photothermographic material having the same photographic properties for both sides when each side was evaluated separately such as Sample No. 101, thermal development was performed with the above thermal developing apparatus. The above thermal developing apparatus gave the photographic properties for both sides where one side which was not contacted with the first panel heater of 70° C. had sensitivity relatively higher by 20% compared to the other side.

Under the thermal developing condition described above, thermal development was performed with the above thermal developing apparatus where the backsides of Sample Nos. 101 to 109 were inserted to the apparatus while not contacted with the first panel heater of 70° C. General photographic properties of the processed samples were evaluated after thermally developing both sides simultaneously.

As a result, it is revealed that, even in the above condition, the samples of the present invention exhibit excellent results in gradation suitable for medical diagnosis, graininess, color tone of a developed silver image, and image distinguishability.

EXAMPLE 7

(Preparations of Coating Solution for Image Forming Layer-110 to -113)

Preparations of coating solution for image forming layer-110 to −113 were conducted in a similar manner to the process in the preparation of coating solution for image forming layer-105 of Sample No. 105 in Example 6 except that changing the addition amounts of the development accelerator-1 dispersion and the development accelerator-2 dispersion. The addition amounts are shown in Table 7, in a ratio to the addition amount in the coating solution for image forming layer-105.

TABLE 7

| Coating Solution for Image Forming Layer | Development Accelerator-1 | Development Accelerator-2 |
|---|---|---|
| 105 | ×1 | ×1 |
| 110 | ×1.25 | ×1 |
| 111 | ×1.5 | ×1 |
| 112 | ×1 | ×1.25 |
| 113 | ×1 | ×1.5 |

(Preparations of Coated Sample)

Sample Nos. 110 to 113 were prepared by using coating solutions for front-side image forming layer and for back-side image forming layer as shown in Table 8.

TABLE 8

| | Front-side | | | Back-side | | | Difference between Front-side and Back-side | |
|---|---|---|---|---|---|---|---|---|
| Sample No. | Coating Solution for Image Forming Layer | Difference in Development Proceeding Properties (18 to 22 seconds) | Gradation | Coating Solution for Image Forming Layer | Difference in Development Proceeding Properties (18 to 22 seconds) | Gradation | Coating Solution for Image Forming Layer | Difference in Gradation |
| 105 | 105 | 0.3 | 2.0 | 1.0 | 0.3 | 2.0 | 0.0 | 0.0 |
| 110 | 110 | 0.4 | 2.2 | 1.0 | 0.3 | 2.0 | 0.1 | 0.2 |
| 111 | 111 | 0.5 | 2.4 | 1.0 | 0.3 | 2.0 | 0.2 | 0.4 |
| 112 | 112 | 0.6 | 2.7 | 1.0 | 0.3 | 2.0 | 0.3 | 0.7 |
| 113 | 113 | 0.7 | 3.0 | 1.0 | 0.3 | 2.0 | 0.4 | 1.0 |

(Evaluation of Development Proceeding Property)

Development proceeding property was evaluated as follows.

Similar to Example 5, development was carried out for 24 seconds, and besides that, by changing the line speed, time period for development was changed to 22 seconds and 26 seconds. Thereafter, film surface was removed similar to Example 5 and a photographic characteristic curve of each side was obtained. Gradation of one side at 24 seconds, and the difference between Dmax at 26 seconds and Dmax at 22 seconds were calculated, and are shown in Table 8.

General photographic properties of the processed samples were evaluated after thermally developing both side simultaneously, similar to Example 5. Results are shown in Table 9. It is revealed that the photothermographic material of the present invention (Sample Nos. 110 to 113) exhibit excellent results in gradation suitable for medical diagnosis, graininess, color tone of a developed silver image, and image distinguishability.

TABLE 9

| Sample | General Photographic Properties | | | | Evaluation of Chest Phantom Image | | | |
|---|---|---|---|---|---|---|---|---|
| No. | Fog | Sensitivity | Gradation | Dmax | Graininess | Color Tone of Developed Silver Image | Distinguish-ability of Mediastinum Portion | Distinguish-ability of Lung Field |
| 105 | 0.15 | 75 | 2.4 | 2.4 | ○ | Δ | Δ | × |
| 110 | 0.16 | 85 | 2.6 | 2.9 | ○ | ○ | ◎ | ◎ |
| 111 | 0.16 | 90 | 2.7 | 3.1 | ○ | ○ | ◎ | ◎ |
| 112 | 0.16 | 105 | 2.9 | 3.3 | Δ | ○ | ◎ | ◎ |
| 113 | 0.17 | 110 | 3.0 | 3.6 | Δ | ○ | ◎ | ◎ |

EXAMPLE 8

Using the thermal developing apparatus used for evaluation condition of one side of each side in Example 5, the following process was conducted. Fuji Medical dry laser Imager FM-DP L was used for the thermal developing apparatus, where the temperature of the four panel heaters were set to 110° C.-117° C.-119° C.-121° C. The total time period for thermal development was set to be 30 seconds.

Sample Nos. 105, 110 to 113 were inserted to the thermal developing apparatus so that the front side being not contacted with the plate. General photographic properties of the processed samples were evaluated after heating one side.

As a result, it is revealed that, even in the above condition, the photothermographic materials of the present invention exhibit excellent results in gradation suitable for medical diagnosis, graininess, color tone of a developed silver image distinguishability.

EXAMPLE 9

(Preparations of Coating Solution for Image Forming Layer-114 to -117)

Preparations of coating solution for image forming layer-114 to -117 were conducted in a similar manner to the process in the preparation of coating solution for image forming layer-112 of Sample No. 112 in Example 7 except that changing the addition amounts of the color-tone-adjusting agent-1 dispersion and the dispersion of silver iodide complex-forming agent. The addition amounts are shown in Table 10, in a ratio to the addition amount in the coating solution for image forming layer-112.

TABLE 10

| Coating Solution for Image Forming Layer | Color-tone-adjusting Agent-1 | Silver Iodide Complex-forming Agent |
|---|---|---|
| 112 | ×1 | ×1 |
| 114 | ×1.2 | ×1 |
| 115 | ×1.4 | ×1 |
| 116 | ×1 | ×1.2 |
| 117 | ×1 | ×1.4 |

(Preparations of Coated Sample)

Sample Nos. 114 to 117 were prepared by using coating solutions for front-side image forming layer and for back-side image forming layer as shown in Table 11.

TABLE 11

| Sample No. | Front-side Coating Solution for Image Forming Layer | Front-side Hue Angle (°) | Back-side Coating Solution for Image Forming Layer | Back-side Hue Angle (°) | Difference between Front-side and Back-side Difference in Hue Angle (°) |
|---|---|---|---|---|---|
| 112 | 112 | 260 | 112 | 260 | 0 |
| 114 | 114 | 245 | 112 | 260 | 15 |
| 115 | 115 | 230 | 112 | 260 | 30 |
| 116 | 116 | 240 | 112 | 260 | 20 |
| 117 | 117 | 225 | 112 | 260 | 35 |

(Evaluation of Difference in Hue Angle)

Hue angle for each side was evaluated as follows.

For each side of the photothermographic material processed similar to Example 5, the hue angle, $h_{ab}$, at the optical density D=0.5 was calculated. At first, the measurement of color was performed by Spectrolino spectrometer (trade name, produced by Gretag-Macbeth Ltd.). F5 was used as a light source for measurement, and the area for measurement was 3 mmΦ. CIELa*b* are calculated, and the hue angle, $h_{ab}$, can be provided from the following formula. Results are shown in Table 11.

$$h_{ab}=\tan-1(b^*/a^*).$$

General photographic properties of the processed samples were evaluated after thermally developing both sides simultaneously, similar to Example 5. Results are shown in Table 12.

It is revealed that the photothermographic material of the present invention (Sample Nos. 112, 114 to 117) exhibit excellent results in gradation suitable for medical diagnosis, graininess, color tone of a developed silver image, and image distinguishability.

TABLE 12

| Sample | General Photographic Properties | | | | Evaluation of Chest Phantom Image | | | |
|---|---|---|---|---|---|---|---|---|
| No. | Fog | Sensitivity | Gradation | Dmax | Graininess | Color Tone of Developed Silver Image | Distinguish-ability of Mediastinum Portion | Distinguish-ability of Lung Field |
| 112 | 0.16 | 105 | 2.9 | 3.3 | Δ | ○ | ◎ | ◎ |
| 114 | 0.16 | 105 | 2.9 | 3.3 | ○ | ◎ | ◎ | ◎ |
| 115 | 0.16 | 108 | 2.9 | 3.3 | ○ | ◎ | ◎ | ◎ |
| 116 | 0.16 | 110 | 3.0 | 3.4 | ○ | ◎ | ◎ | ◎ |
| 117 | 0.16 | 115 | 3.0 | 3.4 | ○ | ◎ | ◎ | ◎ |

EXAMPLE 10

Sample Nos. 112, 114 to 117 were inserted to the both sides-heating type thermal developing apparatus so that the front side of the sample being not contacted with the first panel heater of 70° C., similar to Example 6. General photographic properties of the processed samples were evaluated after thermally developing both sides simultaneously.

As a result, it is revealed that, even in the above condition, the samples of the present invention exhibit excellent results in gradation suitable for medical diagnosis, graininess, color tone of a developed silver image, and image distinguishability.

EXAMPLE 11

1. Preparation of Support

An undercoated support of poly(ethlene terephthalate) having a thickness of 175 μm, similar to that in Example 4, was prepared.

2. Crossover Cut Layer, Image Forming Layer, Intermediate Layer, and Surface Protective Layers 2-1. Preparations of Coating Material 1) Preparation of Dispersion Solution of Solid Fine Particle of Base Precursor It was done similar to Example 4.

2) Preparation of Dispersion Solution of Solid Fine Particle of Orthochromatic Thermal Bleaching Dye It was done similar to Example 4.

3) Preparations of Silver Halide Emulsion

<Preparation of Tabular Silver Iodobromide Emulsion D>

Preparation of silver halide emulsion D was conducted in a similar manner to the process in the preparation of silver halide emulsion 1B in Example 4.

<Preparations of Silver Halide Emulsion E and F>

Preparation of silver halide emulsion E was conducted in a similar manner to the process in the preparation of silver halide emulsion D, except regulating the reaction temperature of nuclei formation and the amount of silver in nuclei formation and the growth. Accordingly, silver halide emulsion E having a mean equivalent projected area diameter of 1.603 μm, a mean equivalent spherical diameter of 0.58 μm, a mean thickness of 0.052 μm and a mean aspect ratio of 31 was prepared. Similarly, silver halide emulsion F having a mean equivalent projected area diameter of 0.652 μm, a mean equivalent spherical diameter of 0.313 μm, a mean thickness of 0.048 μm and a mean aspect ratio of 14 was prepared.

The addition amounts of chemical sensitizer were adjusted to be optimum for each emulsion.

<Preparations of Emulsion for Coating Solution D, E, F>

Using each silver halide emulsion, emulsion for a coating solution was prepared similar to Example 4.

4) Preparation of Dispersion of Non-photosensitive Silver Salt

Fine crystals of silver salt of benzotriazole were prepared similar to Example 4.

5) Preparation of Toner Dispersion

Dispersions of compound Nos. T-59 and T-3 were prepared similar to Example 4.

6) Preparations of various Solutions

An aqueous solution of ascorbic acid as a reducing agent, aqueous solutions of mercapto compound-1 and -2, and an aqueous solution of thermal solvent were prepared similar to Example 4.

2-2. Preparations of Coating Solution

1) Preparation of Coating Solution for Crossover Cut Layer

It was done similar to Example 4.

2) Preparations of Coating Solution for Image Forming Layer

To the dispersion of the non-photosensitive silver salt obtained as described above in an amount of 1000 g were serially added the aqueous solution of gelatin, the pigment-1 dispersion, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound aqueous solutions, the thermal solvent solution, and the nucleator dispersion. The emulsion for coating solution was added thereto followed by thorough mixing just prior to the coating, which was fed directly to a coating die. The dispersion of SH-4 was used as the nucleator dispersion. The mixture of the emulsions E and F, or D and F was used for a coating solution, as shown in Table 13.

2-3. Coating

On both sides of the support, simultaneous overlaying coating by a slide bead coating method was subjected in order of the crossover cut layer, image forming layer, intermediate layer, first layer of the surface protective layers, and second layer of the surface protective layers, starting from the undercoated face, similar to Example 4, and thus Sample Nos. 121 to 129 was produced.

The total amount of coated silver of front side and backside was 1.722 g/m$^2$ with respect to the sum of organic silver salt and silver halide. The ratio of the amount of coated silver in the front side and the backside is shown in Table 13. For each sample, the silver halide emulsions used in the front-side image forming layer and back-side image forming layer are shown in Table 13.

TABLE 13

| | Front-side | | Back-side | |
|---|---|---|---|---|
| Sample No. | Silver Halide No. | Coating Amount | Silver Halide No. | Coating Amount |
| 121 | D | 50 | A | 50 |
| 122 | E | 50 | B | 50 |
| 123 | F | 50 | C | 50 |
| 124 | E/F (Ag molar ratio: 50/50) | 50 | E/F (Ag molar ratio: 50/50) | 50 |
| 125 | D/F (Ag molar ratio: 50/50) | 50 | D/F (Ag molar ratio: 50/50) | 50 |
| 126 | F | 50 | D | 50 |
| 127 | F | 50 | E/F (Ag molar ratio: 50/50) | 50 |
| 128 | F | 50 | A | 50 |
| 129 | F | 50 | D/F (Ag molar ratio: 50/50) | 50 |

The total coating amount of each compound (g/m$^2$) for the image forming layers of both sides was similar to Example 4. The amount of coated reducing agent SH-4 was 0.036 g/m$^2$.

3. Evaluation

Evaluation was performed in a similar manner to that in Example 4. As a result, it is revealed that the samples of the present invention (Sample Nos. 126 to 129) exhibit excellent results in gradation suitable for medical diagnosis, graininess, color tone of a developed silver image, and image distinguishability.

What is claimed is:

1. A photothermographic material comprising, on both sides of a support, an image forming layer including at least a photosensitive silver halide, a non-photosensitive organic silver salt, a reducing agent for silver ions, and a binder, wherein both of the image forming layer on a first side and the image forming layer on the other side of the support have an infectious development property, and the image forming layer on the other side has an infectious development property that is smaller than that of the image forming layer on the first side.

2. The photothermographic material according to claim 1, wherein a ratio of the infectious development property of the first side to that of the other side is 1.2 to 80.

3. The photothermographic material according to claim 1, wherein the image forming layer having the infectious development property contains a nucleator.

4. The photothermographic material according to claim 3, wherein the nucleator is a compound selected from the group consisting of a hydrazine derivative, a vinyl compound, a quaternary onium compound, and a cyclic olefin compound.

5. The photothermographic material according to claim 4, wherein the hydrazine derivative is a compound represented by formula (H):

Formula (H)

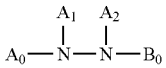

wherein, $A_0$ represents one selected from an aliphatic group, an aromatic group, a heterocyclic group, and a $-G_0-D_0$ group; B represents a blocking group; $A_1$ and $A_2$ both represent hydrogen atoms, or one of $A_1$ and $A_2$ represents a hydrogen atom and the other represents one selected from an acyl group, a sulfonyl group, and an oxalyl group; $G_0$ represents one selected from a —CO— group, a —COCO— group, a —CS— group, a —C(=N$G_1D_1$)- group, an —SO— group, an —$SO_2$— group, and a —P(O)($G_1D_1$)- group; $G_1$ represents one selected from a mere bonding hand, an —O— group, an —S— group, and an —N($D_1$)- group; $D_1$ represents one selected from a hydrogen atom, an aliphatic group, an aromatic group, and a heterocyclic group; and $D_0$ represents one selected from a hydrogen atom, an aliphatic group, an aromatic group, a heterocyclic group, an amino group, an alkoxy group, an aryloxy group, an alkylthio group, and an arylthio group.

6. The photothermographic material according to claim 4, wherein the vinyl compound is a compound represented by formula (G):

Formula (G)

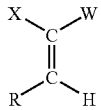

wherein, X represents an electron-attracting group; W represents a hydrogen atom or a substitutable substituent; and R represents a substitutable substituent.

7. The photothermographic material according to claim 1, wherein the image forming layer having the infectious development property contains an infectious development reducing agent.

8. The photothermographic material according to claim 7, wherein the infectious development reducing agent is a compound represented by the following formula (R1):

Formula (R1)

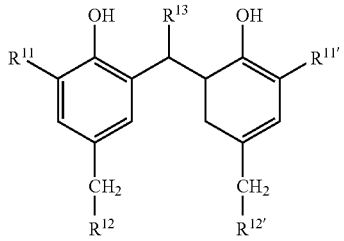

wherein, $R^{11}$ and $R^{11'}$ each independently represent a secondary or tertiary alkyl group having 3 to 20 carbon atoms; $R^{12}$ and $R^{12'}$ each independently represent a hydrogen atom, or a group being connected through a nitrogen, oxygen, phosphorus or sulfur atom; and $R^{13}$ represents a hydrogen atom or an alkyl group having 1 to 20 carbon atoms.

9. The photothermographic material according to claim 1, further comprising at least a phosphate compound selected from phosphoric acid, a phosphate salt and a phosphate ester.

10. The photothermographic material according to claim 1, wherein a sensitivity of the first side thereof and a sensitivity of the other side thereof are different from each other.

11. The photothermographic material according to claim 10, wherein a difference between the sensitivity of the first side and the sensitivity of the other side is in a range from 0.01 to 3.0.

12. The photothermographic material according to claim 1, wherein a development proceeding property of the first side thereof and a development proceeding property of the other side thereof are different from each other.

13. The photothermographic material according to claim 12, wherein a difference between the development proceeding property of the first side and the development proceeding property of the other side is in a range from 0.005 to 1.00.

14. The photothermographic material according to claim 1, wherein a gradation of the first side thereof and a gradation of the other side thereof are different from each other.

15. The photothermographic material according to claim 14, wherein a difference between the gradation of the first side and the gradation of the other side is in a range from 0.005 to 3.0.

16. The photothermographic material according to claim 1, wherein a maximum image density ($Dmax_1$) of the first side thereof and a maximum image density ($Dmax_2$) of the other side thereof are different from each other.

17. The photothermographic material according to claim 16, wherein a difference between $Dmax_1$ and $Dmax_2$ is in a range from 0.05 to 3.0.

18. The photothermographic material according to claim 1, wherein a color tone of a developed silver image of the first side thereof and a color tone of a developed silver image of the other side thereof are different from each other.

19. The photothermographic material according to claim 18, wherein, when a difference between the color tone of a developed silver image of the first side and the color tone of a developed silver image of the other side is represented by a hue angle, the hue angle is in a range from 0.5° to 60°.

20. The photothermographic material according to claim 1, wherein an average silver iodide content of the photosensitive silver halide on at least one side is 40 mol % or higher.

21. The photothermographic material according to claim 20, wherein the average silver iodide content of the photosensitive silver halide on at least one side is 90 mol % or higher.

22. The photothermographic material according to claim 1, wherein 50% or more of a projected area of the photosensitive silver halide on at least one side is occupied by tabular grains having an aspect ratio of 2 or more.

23. The photothermographic material according to claim 22, wherein the tabular grains have a mean equivalent spherical diameter of from 0.2 μm to 10.0 μm.

24. The photothermographic material according to claim 22, wherein the tabular grains have a mean thickness of from 0.005 μm to 0.40 μm.

25. The photothermographic material according to claim 20, further comprising a compound which substantially reduces visible light absorption by the photosensitive silver halide after thermal development.

26. The photothermographic material according to claim 25, comprising a silver iodide complex-forming agent as the compound which substantially reduces visible light absorption by photosensitive silver halide after thermal development.

27. The photothermographic material according to claim 1, wherein the photothermographic material is formed as a sheet and is provided with a means for discriminating between the back and front of the sheet at at least one end of the sheet.

28. The photothermographic material according to claim 27, wherein the means for discriminating between the back and front is at least one selected from a notch, an embossed pattern and a marker.

* * * * *